US012295481B2

(12) United States Patent
Linday

(10) Patent No.: US 12,295,481 B2
(45) **Date of Patent: *May 13, 2025**

(54) CONVERTIBLE BAG

(71) Applicant: Nancy Linday, New York, NY (US)

(72) Inventor: Nancy Linday, New York, NY (US)

( * ) Notice: Subject to any disclaimer, the term of this patent is extended or adjusted under 35 U.S.C. 154(b) by 226 days.

This patent is subject to a terminal disclaimer.

(21) Appl. No.: 17/956,472

(22) Filed: Sep. 29, 2022

(65) Prior Publication Data

US 2023/0024092 A1 Jan. 26, 2023

Related U.S. Application Data

(63) Continuation of application No. 16/723,051, filed on Dec. 20, 2019, now Pat. No. 11,470,947.

(51) Int. Cl.

| | |
|---|---|
| ***A45F 3/02*** | (2006.01) |
| ***A45C 9/00*** | (2006.01) |
| ***A45C 13/30*** | (2006.01) |

(52) U.S. Cl.

CPC ..... *A45F 3/02* (2013.01); *A45C 9/00* (2013.01); *A45C 13/30* (2013.01); *A45C 2009/007* (2013.01)

(58) Field of Classification Search

CPC ..... A45C 13/30; A45C 2009/007; A45C 9/00; A45C 3/06; A45F 3/02; A45F 3/04

USPC ..... 224/191, 264, 578–580, 642–643, 647; D3/287

See application file for complete search history.

(56) References Cited

U.S. PATENT DOCUMENTS

| | | | | |
|---|---|---|---|---|
| 4,189,036 | A | 2/1980 | Pelavin | |
| 4,194,602 | A * | 3/1980 | Allen | A45F 3/02 224/604 |
| 4,240,480 | A | 12/1980 | Strobel | |
| 4,438,876 | A | 3/1984 | Ward | |
| 4,664,382 | A | 5/1987 | Palmer et al. | |
| 4,802,233 | A | 1/1989 | Skamser | |
| 4,815,640 | A | 3/1989 | Johnson | |
| 4,887,751 | A | 12/1989 | Lehman | |
| 4,958,760 | A | 9/1990 | Mule et al. | |
| 4,996,970 | A | 3/1991 | Legare | |

(Continued)

FOREIGN PATENT DOCUMENTS

DE 202014008685 5/2015

OTHER PUBLICATIONS https://www.dooney.com/nylon-large-erica-IN479.html, Dooney & Bourke Nylon Large Erica, pp. 1-24, Mar. 20, 2019.

(Continued)

*Primary Examiner* — Derek J Battisti
*Assistant Examiner* — Matthew T Theis
(74) *Attorney, Agent, or Firm* — Hunton Andrews Kurth LLP

(57) ABSTRACT

Exemplary embodiments include a mechanism that provides a systemized way to attach straps to bags that provides for versatility in attachment of straps for both positioning on the bag and for modifying the length of the straps. These straps may be used as both handles and shoulder straps for the bag through different attachment configurations allowing for the bag to be worn (and used) as one or more different types of bags (e.g., a purse, handbag, satchel, hobo bag, shoulder bag, crossbody bag, laptop bag, messenger bag, and/or tote bag) and a backpack.

18 Claims, 56 Drawing Sheets

(56) References Cited

U.S. PATENT DOCUMENTS

| | | | | |
|---|---|---|---|---|
| 5,193,553 | A | 3/1993 | Kalinoski | |
| 5,209,371 | A | 5/1993 | Daniels | |
| RE34,856 | E | 2/1995 | Daniels | |
| 5,402,869 | A | 4/1995 | Saltzman et al. | |
| 5,676,247 | A | 10/1997 | Shioda | |
| 5,738,401 | A | 4/1998 | Fan | |
| 5,785,427 | A | 7/1998 | Godshaw | |
| 6,006,974 | A | 12/1999 | Varney et al. | |
| 6,217,042 | B1 | 4/2001 | Kurtz et al. | |
| 6,491,193 | B2 | 12/2002 | Dudek et al. | |
| 6,547,114 | B2 | 4/2003 | Smith | |
| 7,160,028 | B1 * | 1/2007 | Linday | A45C 9/00 150/108 |
| 7,350,683 | B2 | 4/2008 | Meyer | |
| 7,481,311 | B1 | 1/2009 | Old | |
| 7,841,374 | B2 | 11/2010 | Berk | |
| 7,857,181 | B2 | 12/2010 | Sacks | |
| D636,603 | S | 4/2011 | Cartwright | |
| D649,784 | S | 12/2011 | Terrell | |
| 8,092,087 | B2 | 1/2012 | Simhoney et al. | |
| 8,231,037 | B2 | 7/2012 | Sacks | |
| 8,231,756 | B2 | 7/2012 | Kim | |
| 8,257,234 | B2 | 9/2012 | Gere | |
| 8,281,970 | B2 | 10/2012 | Demskey | |
| 8,333,310 | B2 | 12/2012 | Tages | |
| 8,353,809 | B2 | 1/2013 | Gere | |
| 8,356,595 | B2 | 1/2013 | Schaeffer, Jr. et al. | |
| 8,365,364 | B2 | 2/2013 | Labelson et al. | |
| 8,443,802 | B2 | 5/2013 | Schaeffer, Jr. et al. | |
| 8,454,236 | B2 | 6/2013 | Ramirez | |
| 8,474,671 | B2 | 7/2013 | Kelly | |
| 8,584,822 | B2 | 11/2013 | Buller et al. | |
| 8,622,264 | B2 | 1/2014 | Messner | |
| 8,636,412 | B2 | 1/2014 | Wang et al. | |
| 8,657,169 | B2 | 2/2014 | Demskey | |
| 8,672,342 | B2 | 3/2014 | McCarthy | |
| 8,672,544 | B2 | 3/2014 | Andochick | |
| 8,684,053 | B2 | 4/2014 | Platt et al. | |
| 8,684,054 | B2 | 4/2014 | Church et al. | |
| 8,827,072 | B2 | 9/2014 | Herron et al. | |
| 8,827,073 | B2 | 9/2014 | Herron et al. | |
| 8,866,841 | B1 | 10/2014 | Distler | |
| 8,925,779 | B1 | 1/2015 | Twigg et al. | |
| 8,950,450 | B2 | 2/2015 | Hedaya | |
| 8,950,643 | B2 | 2/2015 | Shen | |
| 8,955,242 | B2 | 2/2015 | Bruce | |
| 8,956,715 | B2 | 2/2015 | Kim | |
| 8,973,579 | B2 | 3/2015 | Contino et al. | |
| 8,980,412 | B2 | 3/2015 | Kim | |
| 8,998,051 | B2 | 4/2015 | Demskey | |
| 9,049,916 | B2 | 6/2015 | Berei | |
| 9,056,585 | B2 | 6/2015 | Kelly | |
| 9,061,808 | B2 | 6/2015 | Echauz | |
| D739,303 | S | 9/2015 | Kinskey | |
| 9,121,164 | B1 | 9/2015 | Babiarz | |
| 9,155,342 | B2 | 10/2015 | Kim | |
| 9,167,883 | B2 | 10/2015 | Demskey | |
| 9,211,458 | B2 | 12/2015 | Kelly | |
| 9,260,061 | B1 | 2/2016 | Rudd | |
| D750,371 | S | 3/2016 | Kinskey | |
| 9,289,323 | B2 | 3/2016 | Marton et al. | |
| 9,303,353 | B2 | 4/2016 | Audet et al. | |
| D759,370 | S | 6/2016 | Godzich et al. | |
| 9,387,956 | B1 | 7/2016 | Hirshberg | |
| 9,403,630 | B2 | 8/2016 | Bowman | |
| 9,409,679 | B2 | 8/2016 | Rumbough et al. | |
| 9,427,049 | B2 | 8/2016 | Shelton | |
| 9,439,501 | B2 | 9/2016 | Demskey | |
| 9,445,654 | B2 | 9/2016 | Drew et al. | |
| 9,463,914 | B2 | 10/2016 | Andochick | |
| 9,476,630 | B2 | 10/2016 | Andochick | |
| 9,480,315 | B2 | 11/2016 | Goodale | |
| 9,487,421 | B2 | 11/2016 | Coffman et al. | |
| 9,526,366 | B1 | 12/2016 | Kempshall et al. | |
| 9,545,549 | B2 | 1/2017 | Soracco et al. | |
| 9,561,401 | B2 | 2/2017 | Wiseman | |
| 9,578,937 | B2 | 2/2017 | Kern et al. | |
| 9,578,952 | B1 | 2/2017 | Wray | |
| 9,604,442 | B2 | 3/2017 | Kim | |
| 9,615,638 | B2 | 4/2017 | Moskowitz et al. | |
| D787,949 | S | 5/2017 | Andochick | |
| 9,648,934 | B2 | 5/2017 | Tang | |
| 9,724,614 | B2 | 8/2017 | Karsten et al. | |
| 9,737,122 | B1 | 9/2017 | Moore | |
| 9,771,185 | B2 | 9/2017 | Moore | |
| 9,783,351 | B2 | 10/2017 | Bowman | |
| 9,809,287 | B2 | 11/2017 | Messner | |
| 9,809,369 | B2 | 11/2017 | Andochick | |
| 9,821,869 | B2 | 11/2017 | Armstrong et al. | |
| 9,830,783 | B1 | 11/2017 | Kessler et al. | |
| 9,821,948 | B2 | 12/2017 | Noer et al. | |
| 9,839,824 | B2 | 12/2017 | Herron et al. | |
| 9,850,035 | B2 | 12/2017 | Moore | |
| 9,894,789 | B1 | 2/2018 | Hamada et al. | |
| 9,925,416 | B2 | 3/2018 | Wiseman | |
| 9,974,170 | B1 | 5/2018 | Sunshine et al. | |
| D821,092 | S | 6/2018 | Starck | |
| 10,010,146 | B2 | 7/2018 | Moore | |
| 10,021,943 | B2 | 7/2018 | Ferris | |
| 10,040,606 | B2 | 8/2018 | Moore | |
| 10,145,036 | B1 | 12/2018 | Sunshine et al. | |
| 10,154,723 | B2 | 12/2018 | Kreutzer | |
| 10,156,029 | B1 | 12/2018 | Podhajny et al. | |
| 10,166,746 | B2 | 1/2019 | Kim | |
| 10,174,444 | B1 | 1/2019 | Podhajny et al. | |
| 10,180,721 | B2 | 1/2019 | Hoen et al. | |
| 10,182,640 | B2 | 1/2019 | Holtz | |
| 10,191,550 | B1 | 1/2019 | Nussbaum et al. | |
| 10,214,153 | B2 | 2/2019 | Dooling et al. | |
| 11,470,947 | B2 * | 10/2022 | Linday | A45C 9/00 |
| 2016/0120280 | A1 | 5/2016 | Dingler et al. | |
| 2017/0347766 | A1 | 12/2017 | Chung | |

OTHER PUBLICATIONS https://www.macys.com/shop/product/i.n.c.-averry-snake-drawstring-bucket-bag-created-for-macys?ID=7972053&CategoryID=63441#fn=sp%3D1%26, Macy's/Handbags & Accessories, INC International Concepts, pp. 1-4, 2019.

https://www.michaelkors.com/cece-medium-leather-shoulder-bag/_/R-US_30S9G0EL2L?ecid=MKS_GOOGLE_MKO_USA_EN_SEM_GOO_ALL_DS, Michael Kors, pp. 1-6, 2019.

https://www.calvinklein.us/en/womens-clothing/womens-handbags/monogram-hobo-bag-36208181, Calvin Klein, pp. 1-2, Mar. 20, 2019.

https://www.calvinklein.us/en/womens-clothing/womens-handbags/box-zip-crossbody-city-bag-36091948, Calvin Klein, pp. 1-3, Mar. 20, 2019.

https://www.calvinklein.us/en/womens-clothing/womens-handbags/sonoma-reversible-tote-bag-zip-pouch-36097030-100, Calvin Klein, pp. 1-5, Mar. 20, 2019.

https://www.rebeccaminkoff.com/collections/handbags/products/darren-shoulder-bag-hs19ednd28-ice-grey, Rebecca Minkoff, pp. 1-6, Mar. 19, 2019.

https://www.rebeccaminkoff.com/products/chevron-quilted-love-crossbody-hu17mcqx08-black, Rebecca Minkoff, pp. 1-6, Mar. 19, 2019.

https://www.rebeccaminkof.com/products/jean-crossbody-hf18ejcd30-black, Rebecca Minkoff, pp. 1-6, Mar. 19, 2019.

https://www.michaelkors.com/whitney-large-butterfly-camo-convertible-shoulder-bag/_/R-US_30S9GWHL3Y, pp. 1-10, 2019.

https://www.timbuk2.com/collections/all-backpacks/products/507-forge-backpack-tote?variant=12733980377130, TIMBUK2, pp. 1-11, Mar. 19, 2019.

https://www.pcna.com/leeds/en-us/leeds-bags-totes/product/3400-38_reg, Eclipse Convertible Backpack Tote, pp. 1-4, Mar. 19, 2019.

https://www.magellans.com/itemdy00.aspx?T1=ME8529+BK, Megellan's, pp. 1-4, Mar. 19, 2019.

https://www.baggallini.com/securtex-anti-theft-convertible-backpack/ANB357-BG.html, securtex™ anti-theft convertible backpack, pp. 1-3, Mar. 19, 2019.

(56) References Cited

OTHER PUBLICATIONS https://www.baggallini.com/home, travel must-haves, pp. 1-8, Mar. 19, 2019.
https://www.rebeccaminkoff.com/collections/handbags, Rebecca Minkoff Handbags, pp. 1-13, Mar. 19, 2019.
https://www.etsy.com/listing/549417381/yoga-mat-strap-yoga-strap-carrier-yoga?ga_order=most_relevant&ga_search_type=all&ga_view_type=gallery&ga_search, Etsy adjustable purse strap, pp. 1-2, Sep. 20, 2018.
https://www.etsy.com/listing/629066560/100-organic-hemp-yoga-mat-carrier-hemp?ga_order=most_relevant&ga_search_type=all&ga_view_type=gallery&ga_search, Etsy yoga mat strap, pp. 1-6, Sep. 20, 2018.
https://shop.lululemon.com/p/women-mats-props/W-Loop-It-Up-Mat-Strap-Squad/_/prod9040090?color-33712, Loop It Up Mat StrapSquad, Men's Yoga Mats + Props, lululemon athletica, pp. 1-4, Sep. 20, 2018.
https://www.etsy.com/listing/593742694/1-piece-black-removable-leather-purse?ga_order=most_relevant&ga_search_type=all&ga_view_type=gallery, Etsy detachable handle, pp. 1-8, Sep. 5, 2018.
https://www.etsy.com/listing/211174987/byhands-genuine-leather-shoulder-bag?ref=listing-shop-header-1, Etsy, pp. 1-2, Sep. 20, 2018.
https://www.etsy.com/listing/626113488/cowhide-adjustable-changeable-bag-straps ?ga_order=most_relevant&ga_search_type=all&ga_view_type=gallery&ga, Etsy adjustable purse strap, pp. 1-2, Sep. 20, 2018.
https://www.etsy.com/listing/494068786/replacement-leather-strap-in-black-or?ga_order=most_relevant&ga_search_type=all&ga_view_type=gallery&ga_search, Etsy adjustable purse strap, pp. 1-2, Sep. 20, 2018.
https://www.etsy.com/listing/631009123/1-pcs-pu-leather-ends-adjustable-purse?ga_order=most_relevant&ga_search_type=all&ga_view_type=gallery&ga_search, Etsy adjustable purse strap, pp. 1-4, Sep. 20, 2018.
https://handbagsbydesign, miche.com/Shop/Category/517, Switch Out Your Handles For A Whole Different Look!, pp. 1-4, Dec. 6, 2013.
https://myemail.constantcontact.com/Miche-Bag-of-Portland—THE-URBAN-BAG-IS-HERE, Miche Bag of Portland, pp. 1-3, Dec. 6, 2013.
https://www.etsy.com/listing/516626853/1-pcs-adjustable-leather-purse-strap?ga_order=most_relevant&ga_search_type=all&ga_view_type=gallery, Etsy detachable handle, pp. 1-2, Sep. 5, 2018.
https://www.etsy.com/listing/510583374/1-pcs-both-ends-adjustable-leather-purse?ref=related-3, 1 Pcs Both Ends Adjustable Leather Purse Strap Metal Clasps, Etsy, pp. 1-2, Sep. 5, 2019.
https://www.etsy/listing/540454003/replacement-strap-travel-bag-wide?ga_order=most relevant&ga_search_type=all&ga_view_type=gallery&ga_search, Etsy adjustable purse strap, pp. 1-2, Sep. 20, 2019.
https://www.etsy/listing/621189623/leather-adjustable-strap-leather-purse?ga_order=most_relevant&ga_search_type=all&ga_view_type=gallery&ga_search, Etsy adjustable purse strap, pp. 1-2, Sep. 20, 2019.
https://www.etsy.com/listing587719941/102cm-to-110cm-adjustable-length-pearl?ga_order-most_relevant&ga_search_type=all&ga_viewtype=gallery&ga_search, Etsy adjustable purse strap, pp. 1-2, Sep. 20, 2018.
https://www.etsy.com/listing/645149463/removable-adjustable-monogram-canvas?ref=listing-shop-header-2, removable adjustable Monogram canvas & patent calf leather, Etsy, pp. 1-2, Sep. 20, 2018.
https://www.etsy.com/listing/586338021/46-synthetic-leather-purse-strap-34-wide?ga_order=most_relevant&ga_search_type =all&ga_view_type=gallery&ga_search, Etsy adjustable purse strap, pp. 1-2, Sep. 20, 2019.
https://www.etsy.com/listing/620690517/1pc-107-117cmx12cm-adjustable-leather?ga_order=most_relevant&ga_search_type=all&ga_view_type=gallery&ga_search, Etsy adjustable purse strap, pp. 1-2, Sep. 20, 2019.
Https://www.etsy.com/listing/191667956/byhands-100-genuine-leather-adjustable?ga_order=most_relevant&ga_search_type=all&ga_view_type=gallery&ga_search Etsy adjustable purse strap, pp. 1-2, Sep. 20, 2018.
https://www.etsy.com/listing/572041248/chain-strap-for-handba-pu-leather?ga_order=most_relevant&ga_search_type=all&ga_view_type=gallery&ga_search, Etsy adjustable purse strap, pp. 1-2, Sep. 20, 2018.
https://www.etsy.com/listing/279697650/large-leather-handmade-tote-natural?ga_order=most_relevant&ga_search_type=all&ga_view_type=gallery&ga_search, Etsy adjustable purse strap, pp. 1-2, Sep. 20, 2018.
https://www.etsy.com/listing/588483758/1-pair-black-carmel-coffee-brown?ga_order=most_relevant&ga_search_type=all&ga_view_type=gallery&ga_seach, Etsy detachable handle, pp. 1-2, Sep. 5, 2018.
https://www.etsy.com/listing/60773165/1-pc-black-coffee-removable-leather?ga_order=most_relevant&ga_search_type=all&ga_view_type=gallery&ga_search, Etsy detachable handle, pp. 1-4, Sep. 5, 2018.
https://www.etsy.com/listing/516626853/1-pcs-adjustable-leather-purse-strap?ga_order=most_relevant&ga_search_type=all&ga_view_type=gallery&ga_search, Etsy detachable handle, pp. 1-2, Sep. 5, 2018.
https://www.etsy.com/listing/578291048/yoga-mat-strap-by-zen-yoga-strap?ga_order=most_relevant&ga_view type=gallery&ga_search, Etsy yoga mat strap, pp. 1-2, Sep. 20, 2018.
https://www.etsy.com/listing/616679785/yoga-mat-strap-yogi-gift-yoga-mat?ga_order=most_relevant&ga_search_type=all&ga_view_type=gallery&ga_search, Yoga Mat Strap, Yoga Gift, Yoga Mat Carrier, Mt Holder Bag, Etsy, pp. 1-2, Sep. 20, 2018.
https://shop.lululemon.com/p/women-mats-props/Loop-It-Up-Mat-Strap/_/prod1720372?CID=Google-Women_DSA-Category_CA&gclid=EAlalQobChMitc2yk, Loop It Up Mat Strap, Women's Yoga Mats, lululemon athletica, pp. 1-4, Sep. 20, 2018.
https://www.simplychicforyou.com/2013/07/02/miche-urban-prima-bag-rachel-soon-retires/, Simply Chic For You, pp. 1-2, Dec. 6, 2013.
http://handbagsbydesign.com/the-all-new-urban-bags-are-here/, The All New Miche Urban Bags Are Here!! , pp. 1-4, Dec. 6, 2013.
https://www.katespade.com/products/margaux-medium-satchel/PXRUA161-1.html, Marguax Medium Satchel—Kate Spade New York, pp. 1-7, 2019.
https://michestore.com/product/laurie-prima-shell/, Laurie Urban Prima Urban Backpack Shell, pp. 1-2, 2019.
https://puttinontheglitz.files.wordpress.com/2011/08/urbanflyer.jpg, The Urban Bag, So You, So Now, So Miche!, p. 1, 2019.
https://wwwpurseschwag.com/products/chelsey-prima-backpack, Chelsey Prima (Backpack)—Purse Schwag, pp. 1-8, 2019.
https://www.purseschwag.com/collections/base-bags/products/prima-base-bag, Prima Base Bag—Purse Schwag, pp. 1-7, 2019.

* cited by examiner

CONVERTIBLE BAG

CROSS-REFERENCE TO RELATED PATENT APPLICATIONS

This application is a continuation of U.S. application Ser. No. 16/723,051, filed Dec. 20, 2019, the contents of which are incorporated herein in its entirety.

This application is related to U.S. application Ser. No. 10/417,589, filed Apr. 17, 2003 and issued as U.S. Pat. No. 7,160,028, entitled "Convertible Tote Bag," the disclosure of which is herein incorporated by reference in its entirety.

FIELD OF THE INVENTION

The present disclosure relates generally to bags, specifically bags with straps that enable conversion of the bag from one style to another, such as from a purse, handbag, satchel, hobo bag, shoulder bag, crossbody bag, laptop bag, messenger bag, and/or tote bag to a backpack. The disclosure also relates to mechanisms for altering the length of the straps for bags.

BACKGROUND OF THE INVENTION

Bags of varying width, depth and length, both closed and open on top, are known and popular items in the women's and men's accessory market. These bags can become very heavy once filled with objects. When carried on one side of the body, either in the hand or on the shoulder, these heavy bags shift the posture of the user out of proper alignment due to the weight of the bag. It is important for the user to be able to modify the carrying position of the bag to maintain proper posture, as well as to provide greater bag functionality.

Additionally, although various bags having detachable and interchangeable components are known in the art and provide for many configurations of the components, these bags suffer from various deficiencies. These deficiencies include: (1) having to swap out straps to change strap length for use in different configurations (i.e., no strap length adjustment mechanism), (2) use of sliders to adjust strap length that are limited in adjustment range and can be difficult to manipulate, (3) limited attachment points for other adjustment mechanisms that constrains the ability to adjust the strap length, (4) limited attachment points for straps, (5) strap attachment points that are small and can only be used with one type of strap mechanism and prevent threading the strap through the attachment point to shorten the strap, (6) strap attachment points that are small and can only be used with one type of strap mechanism and prevent rotating the strap after it has been threaded the strap through the attachment point to shorten the strap, (7) the bag only being usable in one configuration (e.g., as a tote, purse, messenger bag, or backpack), and, (8) for bags that have multiple carrying configurations, having straps that are fixed at one or both ends to the bag for different configurations (i.e., the bag has one set of straps for use as a tote bag and a second set of straps for use as a backpack) resulting in extra straps that add weight, are unsightly, and get in the way.

These and other deficiencies exist.

SUMMARY OF THE INVENTION

An exemplary embodiment includes a bag unit having an internal compartment formed by an external surface of the bag unit, the external surface having an upper extremity forming a top opening to the internal compartment; a first strap and a second strap, each having a first free end and a second free end such that each of the first and second ends comprise a releasable coupling, the first and second straps comprising a plurality of attachment points for the releasable coupling located longitudinally along a central axis of a body of the first and second straps; a first and second set of attachment points for the releasable coupling of the first and second straps, the attachment points being configured for the threading through and rotating of either of the free ends of the first and second straps to adjust the length of each of the first and second straps by coupling of the free end that was threaded through to one of the plurality of attachment points; the first set of attachment points comprising at least two attachment points and being located proximal the upper extremity of the bag unit proximal either lateral extremity of the top opening; the second set of attachment points comprising two attachment points with each being located proximal a lower portion of the bag unit such that each one of the two attachment points is located below each of the first set of attachment points; the bag unit comprising a first configuration such that the first free end of the first strap is attached to one of the attachment points of the first set of attachment points and the second free end of the first strap is attached to the other of the first set of attachment points and the first and second free ends of the second strap are attached in the same manner such that the bag unit is configured as one of a plurality of bag types with each of the first and second straps being located at the top portion of the bag to form top handles; and the bag unit comprising a second configuration such that the first free end of the first strap is attached to one of the attachment points of the first set of attachment points and the second free end of the first strap is attached to one of the second set of attachment points located below the one of the attachment points to which the first free end is attached and the first free end of the second strap is attached to the other of the first set of attachment points and the second free end is attached to the other of the second set of attachment points such that the bag unit is configured as a backpack with the first and second straps located on a left and right side of the back of the bag to form shoulder straps.

Another exemplary embodiment includes a bag unit having an internal compartment formed by an external surface of the bag unit, the external surface having an upper extremity forming a top opening to the internal compartment; a first strap and a second strap, each having a free end comprising a releasable coupling, the first strap and the second strap comprising a plurality of attachment points for the releasable coupling located longitudinally along a central axis of a body of the first and second straps; a first set of attachment points for the releasable coupling of the free end of the first and second straps; a second set of attachment points for the releasable coupling of the free end of the first and second straps; the first set of attachment points comprising two attachment points with a first attachment point located proximal the upper extremity of the bag unit proximal a lateral extremity of the top opening and a second attachment point located at the other lateral extremity of the top opening; the second set of attachment points comprising two attachment points with each being located proximal a lower portion of the bag unit such that one of the two attachment points is located below each of the first set of attachment points; the first and second straps each comprising a secured end such that the secured end is secured to the second attachment point of the first set of attachment points; the bag unit comprising a first configuration such that the free end of the first strap is attached to one of the first set of attachment points without the secured end of the first strap and the free end of the second strap is attached in the same manner such that the bag unit is configured as one of a plurality of bag types with each of the first and second straps being located at the top portion of the bag to form top handles; and the bag unit comprising a second configuration such that the free end of the first strap is attached to the one of the second set of attachment points located below the attachment point of the first set of attachment points having the secured end of the first strap and the free end of the second strap is attached to the one of the second set of attachment points located below the attachment point of the first set of attachment points have the secure end of the second strap such that the bag unit is configured as a backpack with the first and second straps forming shoulder straps.

Another exemplary embodiment includes a bag unit having an internal compartment formed by an external surface of the bag unit, the external surface having an upper extremity forming a top opening to the internal compartment; a first strap having a free end comprising a releasable coupling, the first strap comprising a plurality of attachment points for the releasable coupling located longitudinally along a central axis of a body of the first strap; a second strap has two free ends each comprising a releasable coupling, the second strap comprising a plurality of attachment points for the releasable coupling located longitudinally along a central axis of a body of the second strap; a first set of attachment points for the releasable coupling of the free end of the first strap and the free ends of second strap; the first set of attachment points comprising two attachment points with a first attachment point located proximal an upper portion of the bag unit proximal a lateral extremity of the top opening and a second attachment point located at the other lateral extremity of the top opening; the second set of attachment points comprising two attachment points with each being located proximal a lower portion of the bag unit such that one of the two attachment points is located below each of the first set of attachment points; the first strap further comprising a secured end such that the secured end is secured to the second attachment point of the first set of attachment points; the bag unit comprising a first configuration such that the free end of the first strap is attached to the attachment point of the first set of attachment points without the secured end of the first strap and the free ends of the second strap are attached to each of the first attachment points such that the bag unit is configured as one of a plurality of bag types with each of the first and second straps being located at the top portion of the bag to form top handles; and the bag unit comprising a second configuration such that the free end of the first strap is attached to the one of the second set of attachment points located below the attachment point of the first set of attachment points having the secured end of the first strap and one free end of the second strap is attached to the other one of the first set of attachment points and the other free end is attached to the second set of attachment points located below that attachment point of the first set of attachment points such that the bag unit is configured as a backpack with the first and second straps forming shoulder straps.

Another exemplary embodiment includes a bag unit having an internal compartment formed by an external surface of the bag unit, the external surface having an upper extremity forming a top opening to the internal compartment; four straps, comprising a first strap, a second strap, a third strap, and a fourth strap, each having a free end and an end that is permanently secured to the bag unit; a set of attachment points including two attachment points with each being located proximal a lower portion of the bag unit; the bag unit having a first configuration such that the free ends of two straps of the four straps are configured to be mated and the free ends of the remaining two straps are configured to be mated such that the respective free ends are tied together such that two top handles are formed for the bag unit; and the bag unit having a second configuration such that the free ends of two straps of the four straps are attached to one of the set of attachment points and the free ends of the remaining two straps are attached to the remaining set of attachment points such that the bag unit is configured as a backpack having four shoulder straps and the free ends are attached to each of the set of attachment points by threading and rotating the free end through each attachment point and tying them back on themselves and tying the free ends to at least one of the set of attachment points.

This and other embodiments and advantages will become apparent from the following detailed description, taken in conjunction with the accompanying drawings, illustrating by way of example, the principles of the various embodiments.

BRIEF DESCRIPTION OF THE DRAWINGS

For a more complete understanding of the various embodiments, the objectives and advantages thereof, reference is now made to the following descriptions taken in connection with the accompanying figures in which.

DETAILED DESCRIPTION OF PREFERRED EMBODIMENTS

Figure 1:
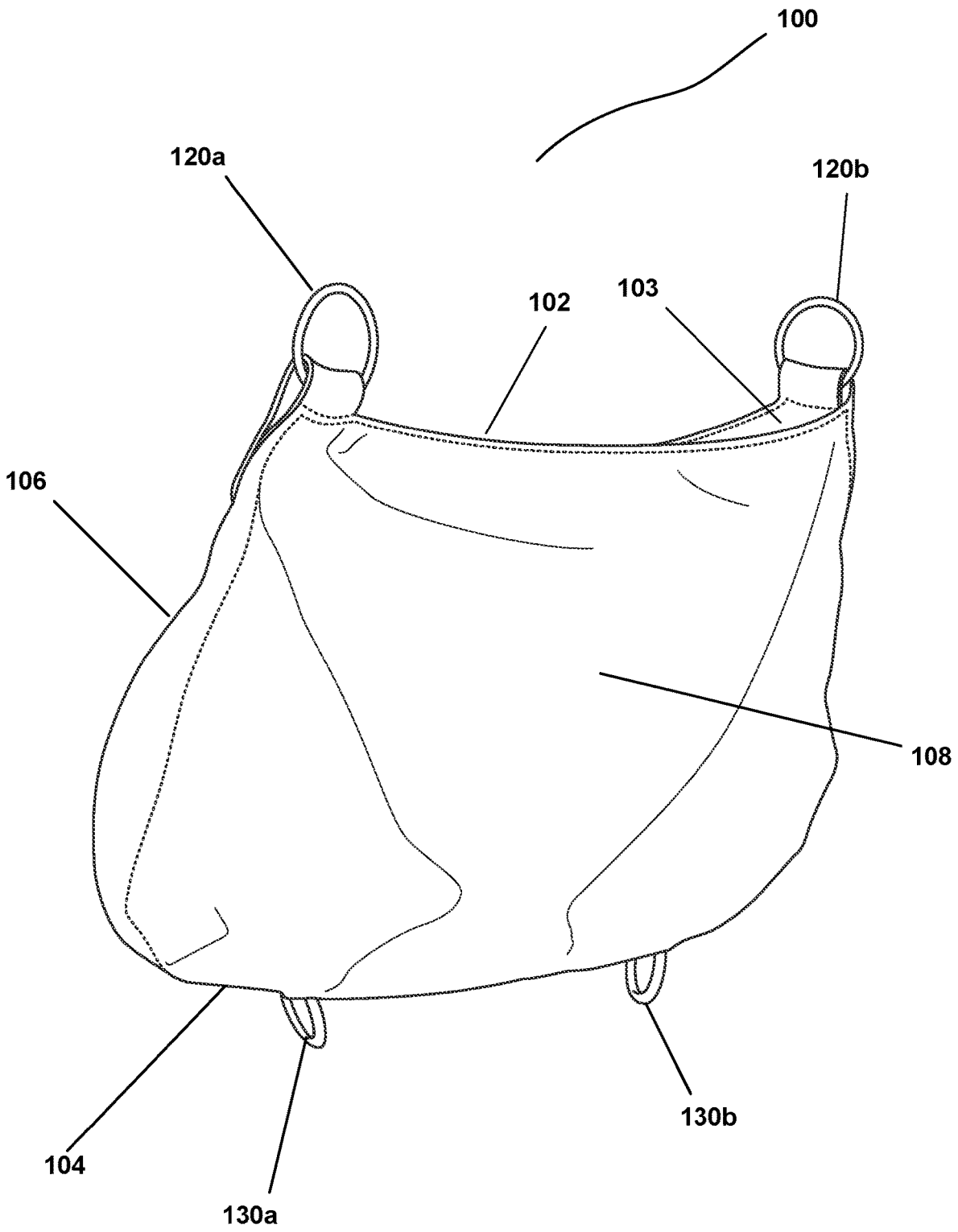
FIG. 1 depicts a bag according to an exemplary embodiment.

The following description provides different configurations and features according to an exemplary embodiment. While certain nomenclature is used in the description, other names are possible. Accordingly, the nomenclature provided is used by way of a non-limiting example. Further, while particular embodiments are described, it should be appreciated that the features and functions of each embodiment may be combined in any combination as is within the capability of one of ordinary skill in the art. The figures provide additional exemplary details regarding the various embodiments. It also should be appreciated that the following exemplary embodiments are provided as non-limiting examples only.

The described embodiments are exemplary because there are a variety of ways to carry out the methods according to the present disclosure.

Exemplary embodiments include a bag, which may be referred to as a bag unit. The bag may be of any width, depth and length. The bag may include two side portions and a bottom portion. The side portions, along with the bottom portion, form a compartment. The compartment may be accessible through a top. The top may be open or closed or the top portion may include a cover for opening and closing the top portion. The cover may include one or more of a zipper, Velcro, buttons, snaps, a flap, or any other suitable mechanism or combination of mechanisms for securing the cover. In various embodiments, the bag may include a front portion, a back portion, a bottom portion, and two sidewalls. The front portion, the back portion, the sidewalls, and the bottom portion may form a compartment. In various embodiments, the bag may have an amorphous shape. For example, the bag may lack a defined front, back, bottom, and sidewalls. In various embodiments, the bag unit may include one or more shells. The shells may be used to cover a bag base unit and be used to change the exterior appearance of the bag base unit (e.g., the shells may come in a variety of colors and materials which alter the appearance of the bag base unit). The shells may come in a variety of forms from a set of panels that wrap the exterior portions of all or part of the bag base unit to a bag like structure that wraps the entire bag base unit. In some embodiments, the shell may include the various structures described here, such as attachment points and/or straps. The shell may be attached to the bag base unit in a variety of manners should as using snaps or magnets or other suitable securing mechanisms. It should be understood that the shell and its structures are considered part of the bag or bag unit for purposes of this disclosure.

Exemplary embodiments include a mechanism that provides a systemized way to attach straps to bags that provides for versatility in attachment of straps for both positioning on the bag and for modifying the length of the straps. The bag may be of any type. By way of non-limiting examples, the bag may be a purse, handbag, satchel, hobo bag, shoulder bag, crossbody bag, laptop bag, messenger bag, and/or tote bag. The bag may be made of any suitable material. For example, the bag may be made of leather, fabric, synthetic material, plastic, recycled material, 3D printed material, and/or combinations thereof. Various embodiments of the bag may be made of two or more materials.

The bag may have two straps. In various embodiments, the bag may have more than two straps. For example, the bag may have three or four straps. These straps may be used as handles or shoulder straps for the bag. Herein, the straps may alternatively be referred to as strap handles or straps. The straps can be attached to two or more attachment points allowing for the bag to be worn (and used as) as one or more different types of bags (e.g., a purse, handbag, satchel, hobo bag, shoulder bag, crossbody bag, laptop bag, messenger bag, and/or tote bag) and a backpack. In the base configuration of the bag (i.e., non-backpack configuration), the straps may form top handles that can be carried in a hand (e.g., a purse or handbag configuration) or looped over a shoulder (e.g., messenger or hobo type bag configuration). In various embodiments, only one of the straps may be used to carry the bag and the other strap(s) may serve a decorative purpose. Alternatively, in various embodiments, four straps may be used to carry the bag, or three straps, or two straps, with the other straps not being used (e.g., hanging loosely either on the outside of the bag or tucked within the bag's interior volume. In the backpack configuration, the straps may form shoulder straps that can be looped over one or both shoulders. The strap attachment points may include rings, buckles, grommets, and loops. The strap attachment points may be made of the same material as the bag. In various embodiments, the strap attachment points may be made of different material than the bag. The strap attachment points may be made of a combination of materials. The strap length may be changed through altering the strap end point attachment locations. The strap attachment points may be of sufficient size to allow for threading the strap and its attachment mechanism through the attachment as well as rotating of the strap once threaded through the attachment point. The straps may be made of any suitable material. For example, the straps may be made of leather, fabric, synthetic material, plastic, recycled material, 3D printed material, and/or combinations thereof. In various embodiments, the straps may be made of two or more materials.

In exemplary embodiments, straps may be non-permanently or releasably attached to the bag. Stated differently, the straps may be removable from the bag by both ends (e.g., the strap may have two free ends). The strap may have a mechanism that may be used to secure the strap to the bag and also be releasable to remove the strap from its attachment point to the bag. In some embodiments, one end of each strap may be fixed to the bag in a non-removable manner. In other embodiments, one strap may include two free ends (i.e., both ends of the straps may be releasably attached to the bag) and one strap may have one end fixed to the bag and the other end may be a free end. In various embodiments with more than two straps, one or more of the straps may have a fixed end and a free end. In some embodiments, one or more straps may have both ends fixed to the bag and two straps may have one free end to support converting to a different configuration. For example, in a bag with three or four straps, one (in the three strap configuration) or two (in the four strap configuration) straps may have both ends fixed and two straps may have either one end fixed and one end free or both ends free (i.e., removable attachment mechanisms at both ends). Alternatively, in various embodiments the straps can be attached at one end or detached at both ends such that four straps are attached at one end with the other end free; three straps are attached at one end with the other end free and one strap is detachable at both ends; two straps are attached at one end with the other end free and two straps are detachable at both ends; one strap is attached at one end with the other end free and three straps are detachable at both ends; four straps are detachable at both ends.

It should be appreciated that the use of the terms permanently attached and/or non-removably attached are meant to indicate that the attachment of the strap end is such that this end of the strap is meant to remain attached to the bag in the normal course of use. This strap end does not have a mechanism enabling a user to remove this end of the strap from the attachment point without using destructive methods. This is in contrast to the strap free ends that have an attachment mechanism as described below. The use of the same terms (i.e., permanently, non-removably) for other parts of the bag is meant to have the same meaning as with the strap ends.

In various embodiments with ends of the straps fixed to the bag, the fixed end may be attached to the bag at a different location than the attachment point. For example, the fixed end may be attached to a loop that is part of the bag material, the fixed end may be attached to a loop that is attached to the bag material, or the fixed end may be attached to the bag proximal the attachment point.

The free ends of the straps may each have an attachment mechanism. The attachment mechanism is configured to be manipulated (such as by a user) to allow for removal, and subsequent reattachment, of the strap to/from the attachment points on the bag. The attachment mechanism may be configured to securely attach the strap end to the bag. According to exemplary embodiments, the attachment mechanism may be a clip or a swivel hook. However, other types of mechanisms may be used. For example, the attachment mechanism may be a snap or buckle or "knob and keyhole" or knot/loop (by tying the end of the strap to itself) or a magnet(s). The snap configuration may use structures that are configured to mate together (e.g., one side may have a cut-out that is configured to mate with a protrusion on the other side). The buckle configuration may have a post on one side that is configured to mate with a hole on the other side (e.g., it may be similar to a belt buckle configuration). The "knob and keyhole" configuration may use a knob or knob-like structure (e.g., a post structure that may have a lip or other protrusion on it) that is configured to mate with or be inserted into a keyhole or keyhole like structure (e.g., a slit or cut-out). The magnet structure may have a magnet that is configured to mate with another magnet (e.g., the magnets may have the appropriate polarity to attract each other to facilitate mating and staying mated until physically separated by a user). Further, the depictions of attachment mechanisms in the figures of this application are meant to be exemplary and non-limiting. The straps and attachment mechanism may be made of any suitable material or combination of materials.

The strap free ends may be configured to be threaded through the strap attachment points and looped upward and clipped to the body of the strap itself. To this end, the strap may be configured so that at least a portion of its length is structured to allow for the free end of the strap to be coupled to the strap itself. In doing so, the strap may be shortened. The strap may then be lengthened in a reverse manner (e.g., moving the strap to a lower position on the strap body or attaching the strap directly to the attachment point without threading through). Further, the strap may be rotated or twisted once threaded through the strap attachment points. To accommodate clipping of the strap free end to itself, a portion of the strap body may include one or more attachment points. The attachment points may include, but not be limited to, chain links, grommets, cut-outs, slits, loops, holes, or other structures which allow attachment of the strap clip to the strap. These attachment points may be spaced out along a portion of the length of the strap from the strap end towards the center of the strap. The attachment points may also extend from each end towards the center.

In various embodiments, the strap may have at least one additional attachment point for the free end of the strap to thread through and shorten the strap by attaching it to the lower opening. This additional attachment point may be located furthest from the free end of the strap. This additional attachment point may be of a different structure and configuration than the remainder of the attachment points and may serve as a transition from one material to another. The strap may have a lower section, adjacent each free end, that is of one material and structural configuration to accommodate the attachment mechanism of the free end. The remainder of the strap (i.e., the portion located at the central portion of the strap between the free ends) may be made of another material and structure. This may be the portion of the strap designed for carrying of the bag (i.e., where the user holds the bag or the portion in contact with the shoulder when used as a backpack or shoulder bag). For example, the strap may have a metal chain portion adjacent each free end which is connected to a leather portion forming the remainder of the strap. The additional attachment point may be a ring to which the chain portion is connected on one hand and the leather portion is connected on the other. This ring may be of sufficient size to accommodate those connections as well as allow clipping of the attachment mechanism thereto.

According to an exemplary embodiment, all attachment points on the bag may be of sufficient size to allow for attachment of the attachment mechanism. Further, all attachment points on the bag may be configured so that the strap free ends and strap body may be completely threaded through them. The attachment points may be further configured to allow for the strap to be rotated as threaded through or once threaded through the attachment points. This may make it possible to shorten the strap handles and may allow the user more choice in how to shorten the strap handles, as well as allow the user to orient the strap in a desired orientation (e.g., to allow for attachment of the attachment mechanism at a desired location along the strap body) as well as untwist or untangle the strap once threaded through the attachment point. In various embodiments, the straps may be threaded multiple times through the attachment points to allow for further shortening of the straps. This multiple threading may allow for shortening of the strap further. In some embodiments, the straps may be threaded through openings on the bag itself. This threading through bag openings may be done in conjunction with threading the strap through the attachment points. The strap may also be attached to openings on the bag itself (e.g., using the attachment mechanism). This may allow for securing of the free end of the strap with the attachment mechanism. This securing may be done after threading the strap through one, or more, of the attachment points. In other embodiments, threading the strap through openings on the bag itself or securing the strap to openings on the bag itself may be used to shape or configure the bag.

In various embodiments, there may be a covering that slides up and down each strap. The covering may be non-removably affixed to the strap. In other embodiments, there may be a removable covering that can be attached over the strap. The removable covering may have a velcro closure. It should be appreciated that other types of resealable closures may be used, such as snaps, eye and hook, buttons, etc. According to exemplary embodiments, the covering, whether non-removably affixed or removably affixed, may cover a portion of the length of the strap. The covering may be padded in various embodiments.

Descriptions of several exemplary embodiments will now be presented. It should be appreciated that these embodiments are meant to be exemplary. For example, while the figures present depictions of bags and straps of a particular shape and configuration for each embodiment, these bags and straps are used for illustrative purposes only and different bags and straps can be used with each embodiment. From the Figures and description it will be appreciated that certain embodiments share common features. Finally, it should be appreciated that the above features may be incorporated into any of the various embodiments shown in the Figures described below. The Figures depict exemplary embodiments and configurations which should be understood to be non-limiting and the features from the various embodiments described both above and below may be combined.

FIGS. 1-4 depict a bag 100. FIG. 1 depicts the bag 100. The bag 100 may have a top 102, a bottom 104, a first side 106, and a second side 108. The top 102 may have an opening 103 into the internal volume of the bag formed by the bottom, first side, and second side. This opening 103 may be secured with a closure mechanism such as a zipper, snaps, magnets, velcro, or any other suitable closure mechanism. The first side 106 and the second side 108 may be referred to as a front portion and a back portion, respectively. It should be appreciated that some bag embodiments have a defined back and front portion. However, in some embodiments the front and back portion may be interchangeable. In various embodiments, the back side may be the side with the attachment points located at its lower periphery as depicted in FIGS. 1-4. This would be the side that is placed against a user's back with the bag 100 configured in a backpack configuration as described herein.

The first side 106 and the second side 108 may be joined along seams at their periphery and along the bottom portion 104. In some embodiments, the bag 100 may have defined side portions of substantial material between the first side 106 and the second side 108. The bag 100 may lack a defined bottom portion. For example, the front and back side may be joined together at the bag's lower extremity. Similarly, the front and back side may be joined along their edges and the bag 100 may lack a defined first and second side. In various embodiments, the bag 100 may have only a front and back portion. In some embodiments, the bag 100 may have an amorphous shape.

The bag 100, as well as the other bags depicted and described here, may be made of any suitable material or materials. For example, the bag 100 may be made of leather, fabric, synthetic material, plastic, recycled material, 3D printed material, and/or combinations thereof.

Figure 2A:
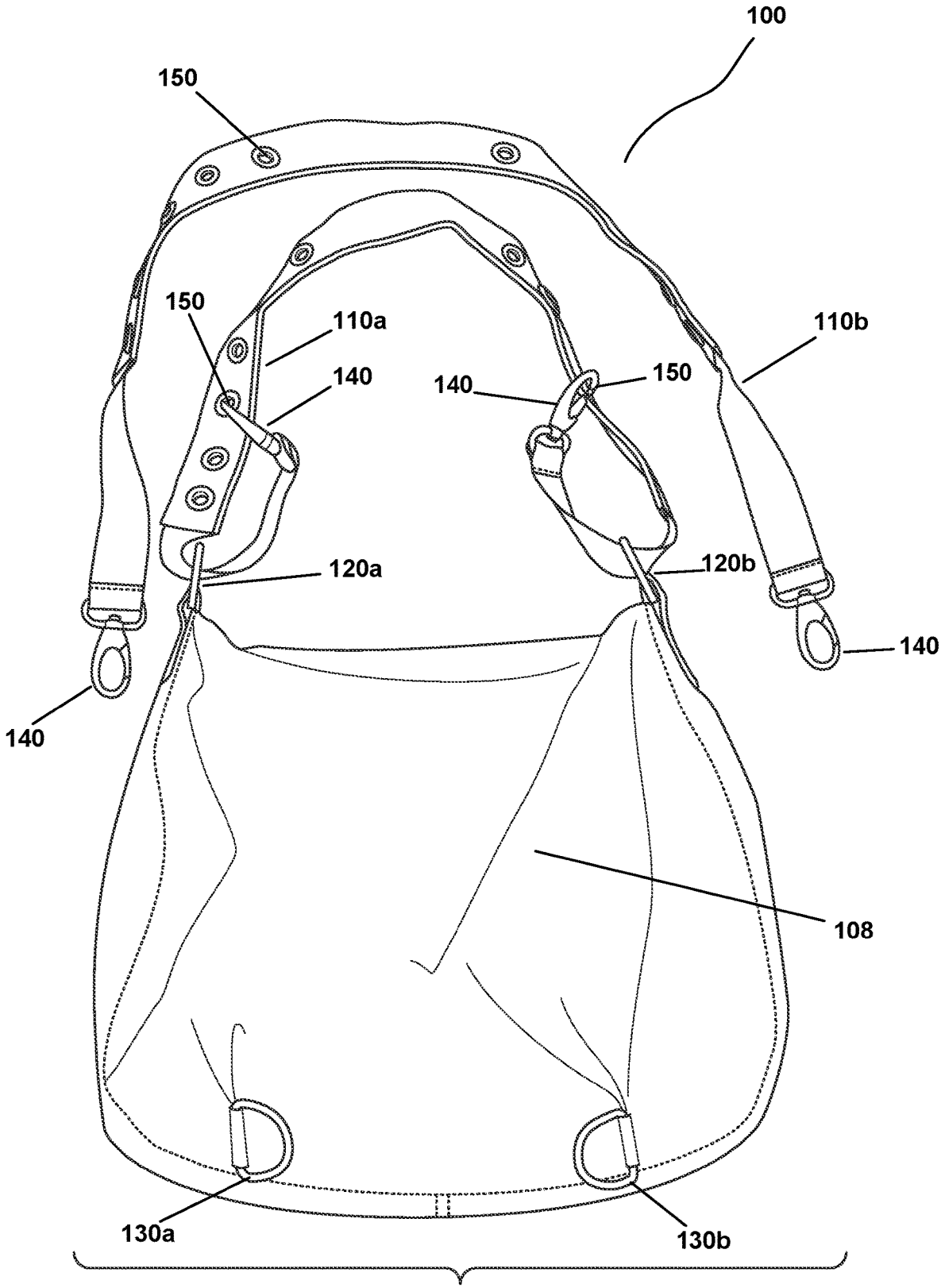
FIG. 2A depicts a first configuration of the bag of FIG. 1 according to an exemplary embodiment.
Figure 2B:
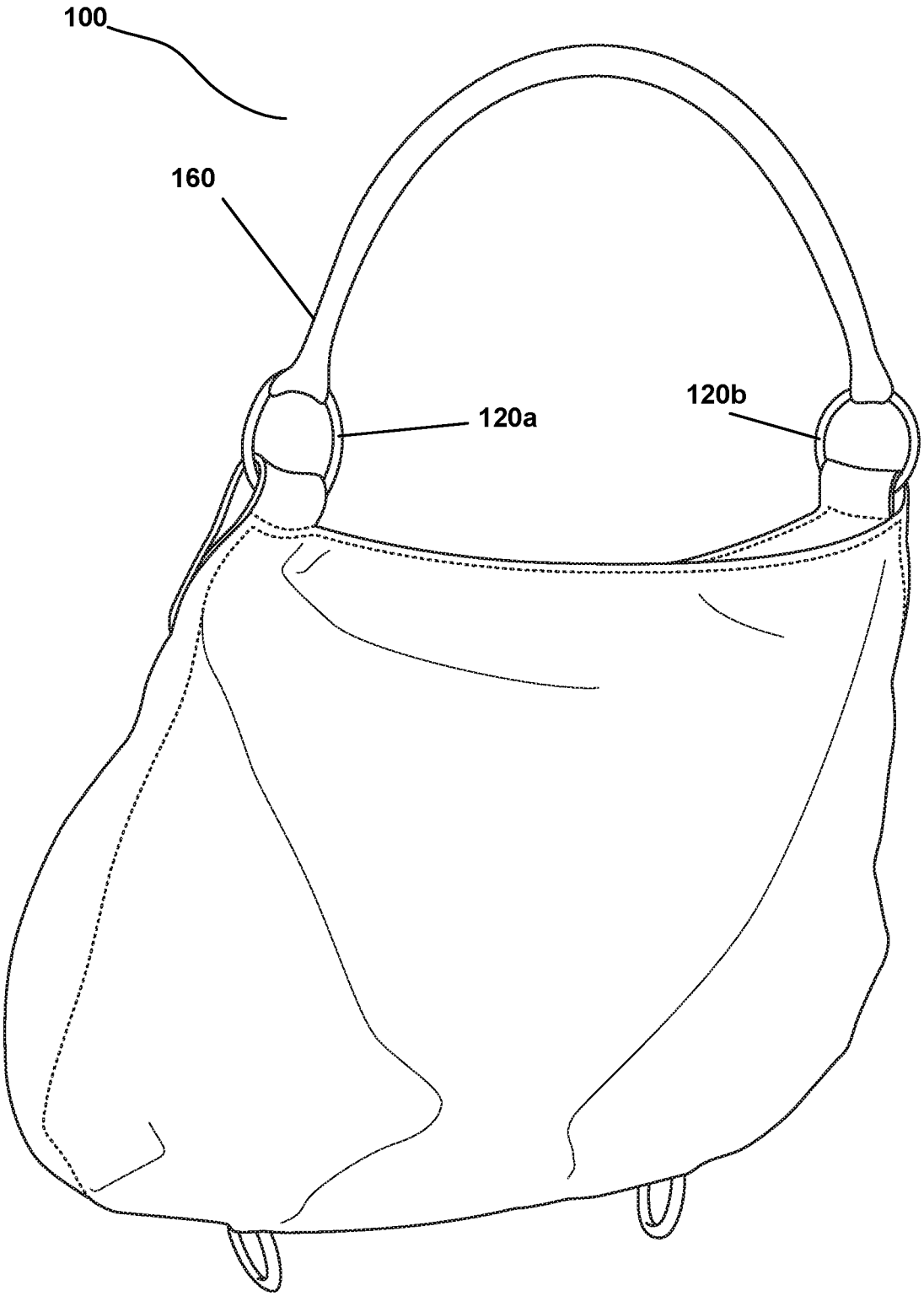
FIGS. 2B and 2C depict alternate strap configurations of the bag of FIG. 1 according to an exemplary embodiment.
Figure 2C:
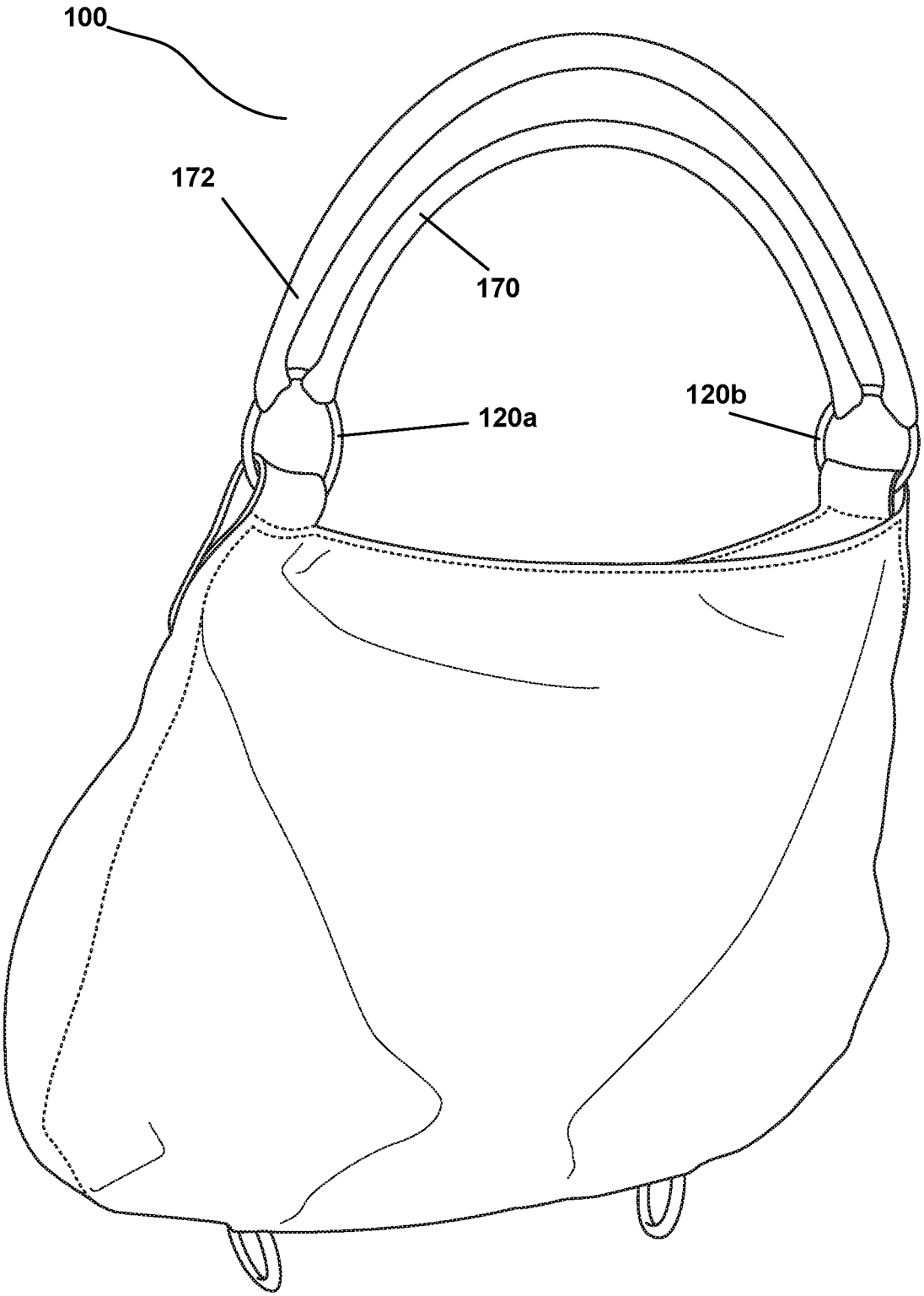
Figure 3:
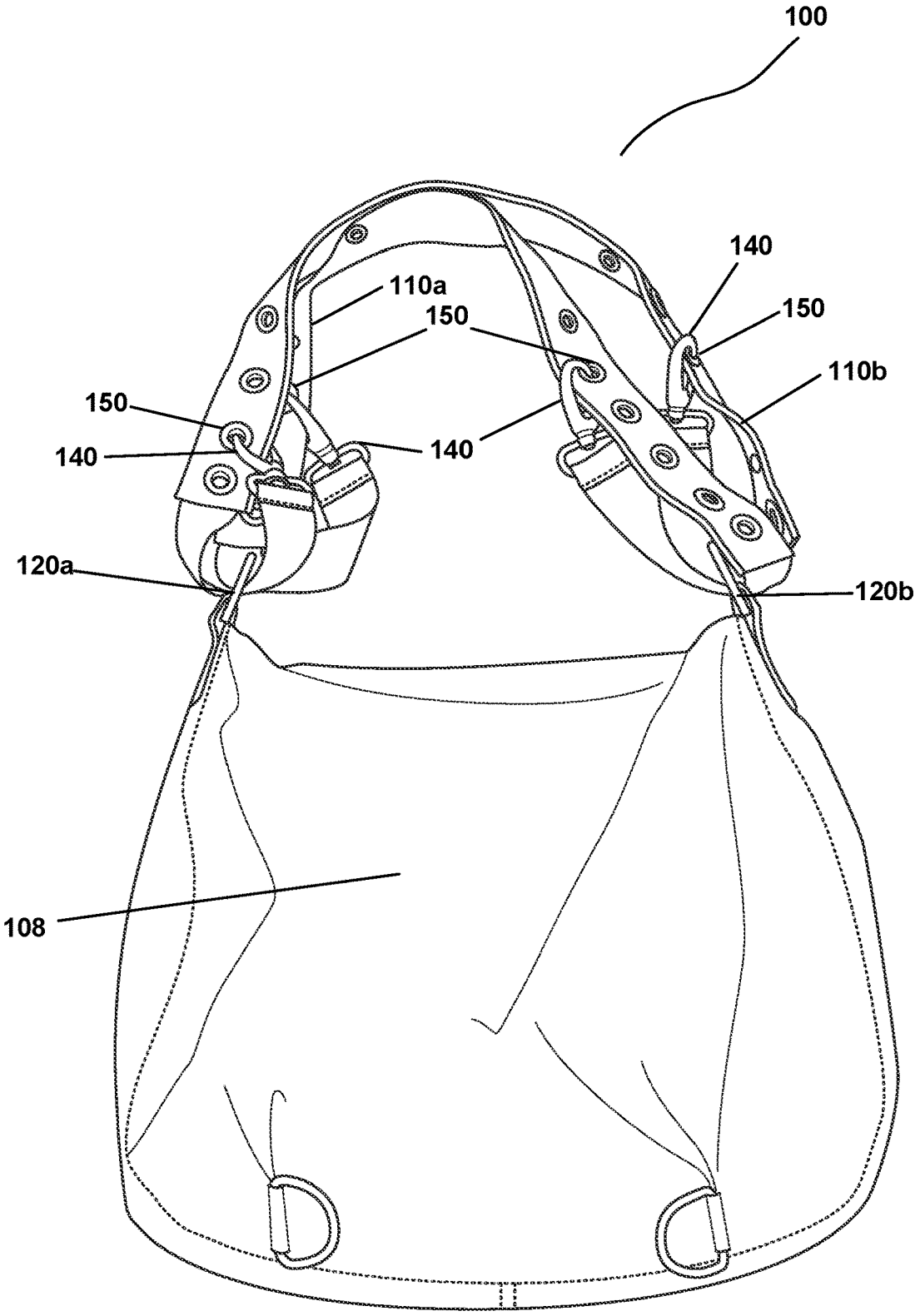
FIG. 3 depicts a second configuration of the bag of FIG. 1 according to an exemplary embodiment.
Figure 4:
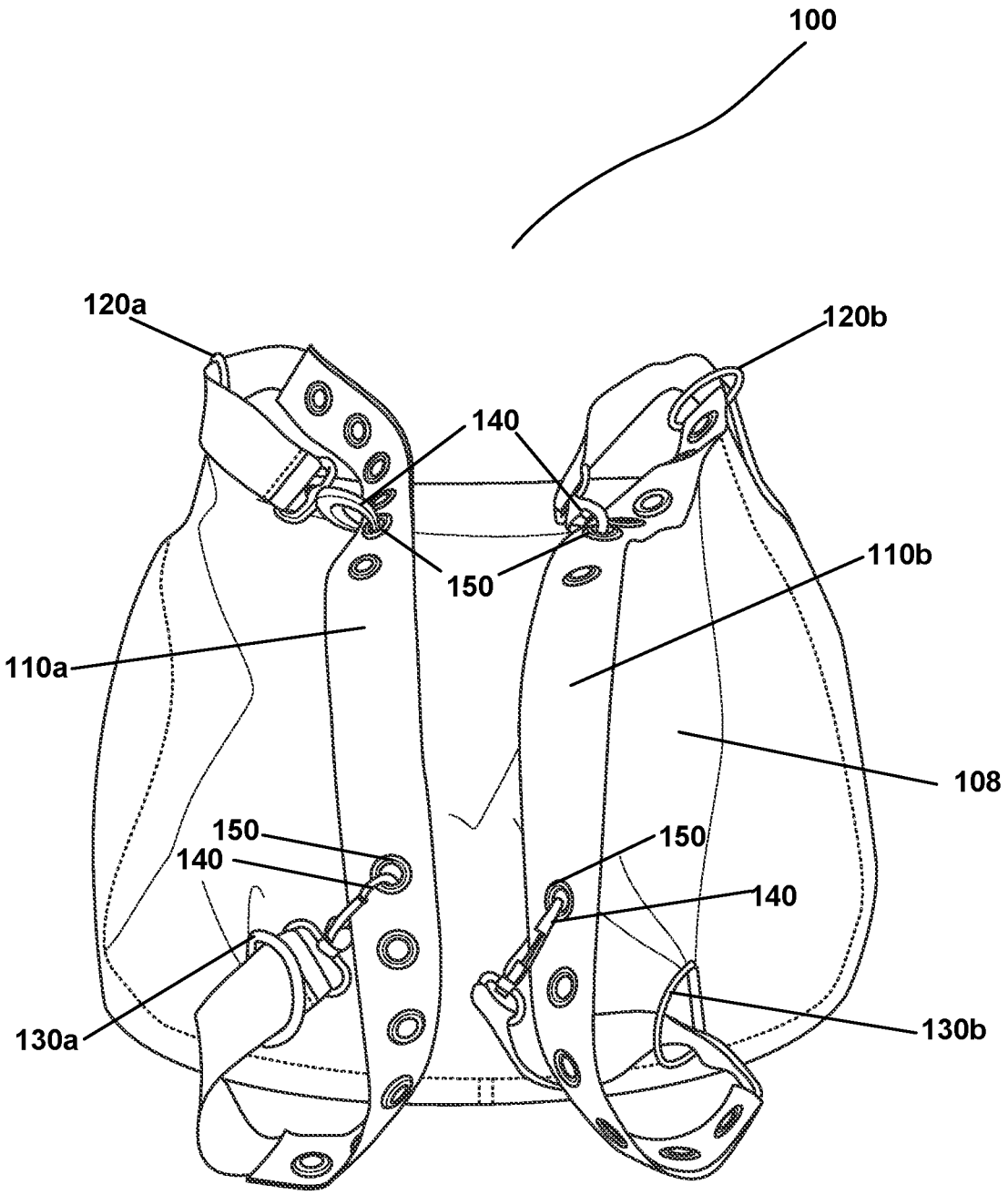
FIG. 4 depicts a third configuration of the bag of FIG. 1 according to an exemplary embodiment.

FIGS. 2-4 depict the bag 100 in a configuration with two handles or straps 110*a* and 110*b* (collectively, straps 110). It should be appreciated, as described above, that the bag 100 may have additional straps. For example, the bag 100 may have three or four straps. The additional straps may be of the same structure as the straps 110. In various embodiments, the additional straps may have a different structure than the straps 110. For example, the straps may be configured in any manner described herein.

FIG. 1, as can be seen, depicts the bag 100 without the straps. Both ends of each strap 110 are selectively attachable. The two handles or strap may be configured to be carried in the hand(s) of a user in a purse or handbag configuration. FIGS. 2 and 3 depicts the bag 100 with the straps 110 attached in a purse or handbag configuration. In FIG. 2A, only one strap 110*a* is attached. In FIG. 2B, one strap is permanently attached. In FIG. 2C, two straps are permanently attached. For clarification of presentation, the straps 110 are not shown in FIGS. 2B and 2C. In FIG. 3, both straps 110*a* and 110*b* are attached. The straps may be made of any suitable material. For example, the straps may be made of leather, fabric, synthetic material, plastic, recycled material, 3D printed material, and/or combinations thereof. The straps 110 may be made of the same material as the bag 100. In various embodiments, the straps 110 may be made of a different material than the bag 100.

The bag 100 has two attachment points 120*a* and 120*b* (collectively, attachment points 120) at a top portion and two attachment points 130*a* and 130*b* (collectively, attachment points 130) proximal a bottom portion as seen in FIG. 1. Each of the attachment points 120 and 130 are permanently attached to the bag. The bottom attachment points may be located above the bottom portion on one side of the bag as depicted in FIG. 1.

In FIG. 2A, a portion of the strap 110*a* is threaded through the attachment points 120 and connected back unto itself using a mechanism 140 which is attached through one of the attachment points 150 located in the strap. In FIG. 2B, a strap 160 is permanently attached at each end to each of the attachment points 120. The straps 110 can be used with this strap 160 to provide up to three straps for the bag 100 in the handbag or purse configuration. In FIG. 2C, straps 170 and 172 are permanently attached at each end to each of the attachment points 120. The straps 110 can be used with these straps 170, 172 to provide up to four straps for the bag 100 in the handbag or purse configuration. In FIG. 3, both of the straps 110 are connected to one each of attachment point 120 and each are threaded back onto itself. Each of the attachment points 120 and 130 are large enough for the attachment mechanisms of the strap to attach to and for the strap itself to thread through and rotate once threaded through. In various embodiments, all attachment points and all openings in the strap may be configured so that the strap free ends may be threaded through them and rotated once threaded through. Further, the various attachment points depicted in the various other figures and described herein may also be configured to be of sufficient size to allow for the attachment mechanisms of the straps to attach to, for the straps to thread through, and for rotation of the straps once threaded through the attachment mechanism.

In various embodiments, the straps 110 may be threaded multiple times through the attachment points to allow for further shortening of the straps. This multiple threading may allow for shortening of the strap further. It should be appreciated that the attachment points of the bag 100 may be of sufficient size to allow for multiple threading of the straps 110. The various attachment points depicted in the various other figures and described herein may be configured in this manner.

FIG. 4 depicts the bag 100 in a backpack configuration with each strap 110 attached at both attachment points 120 and 130. To convert the bag 100 from a handbag to a backpack, a first end of straps may be threaded through loops at bag top (in same direction) (120*a*, 120*b*), and secured using the strap attachment mechanism 140. The second end of strap may be extended down the length of the bag, the second end may be threaded through the loop at the bag bottom (130*a*, 130*b*), and the second end may be secured using the strap attachment mechanism 150. The length of the strap may be adjusted by securing the strap back on itself as shown in FIG. 4 (e.g., using the mechanism 140 to adjust the strap length by using one of the attachment points 150 on the strap). As depicted, the straps may then run the length of the second side 108 of the bag enabling the bag 100 be used in a backpack configuration. In the case of the embodiments of FIGS. 2B and 2C in a backpack configuration, the straps 160, 170, and 172 would not be used and can be laid down against the bag body to be out of the way. Further, the embodiments of FIGS. 2B and 2C can be kept in a backpack configuration (using the straps 110 as described above) and the straps 160, 170, and 172 can be used to carry the bag in a handbag or purse configuration.

The attachment points 120 and 130 are depicted as D-rings. However, other suitable shapes and configurations can be used such as loops, rectangular rings, oblong rings, circular rings, square rings, or other shapes that can serve as an attachment point. In some embodiments, the attachment points can be integral to the bag 100. For example, the attachment point may be a strap directly attached to the bag rather than a separate piece that is attached to the bag.

As depicted, the two straps 110 each have a mechanism 140 at each end that allows for attachment and detachment to the attachment points 120 and/or 130. The mechanism 140 can be any appropriate mechanism such as a clip, snap-hook, etc. Each strap 110 has a portion with multiple attachment points 150 allowing for attachment of the attachment mechanism to the strap itself. The attachment points 150 may be grommets or holes in the body of the strap as depicted in FIGS. 2-4. Other types of suitable structures may be used for attachment points.

Other styles of straps can be used to allow for straps 110 to be permanently attached at one end to the bag (i.e., the strap 110 has one free end), or for one handle to be attached at one end to the bag and the other to be completely detachable.

Additionally, it should be appreciated that while certain embodiments are depicted or described with certain types of straps (e.g., straps with grommets, straps with chain portions, etc.), those straps can be used interchangeably between the various embodiments. The straps of the various bags depicted and described may be mixed and matched. Further, the straps depicted in the various figures and described herein may be made of any suitable material or materials such as that described above for the straps 110.

It should be appreciated that the various bags depicted in the various figures and described herein have a similar structure and the description for the bag 100 may apply equally to those various bags. Further, the similar structure may not be explicitly labeled or referred to in each figure, however, one of ordinary skill in the art will appreciate that this structure is present from the Figures included herein.

Figure 5:
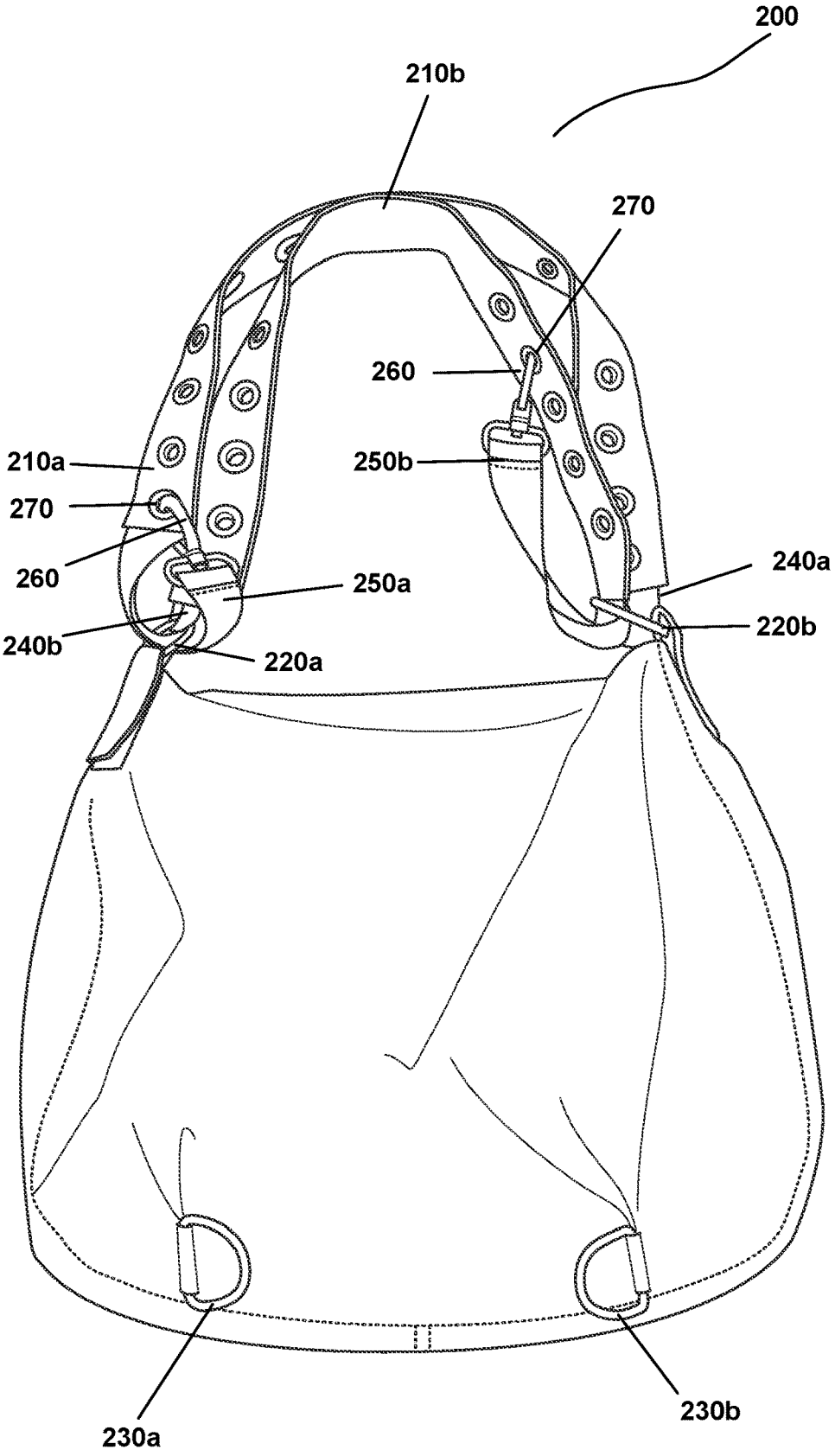
FIG. 5 depicts a bag according to an exemplary embodiment.
Figure 6:
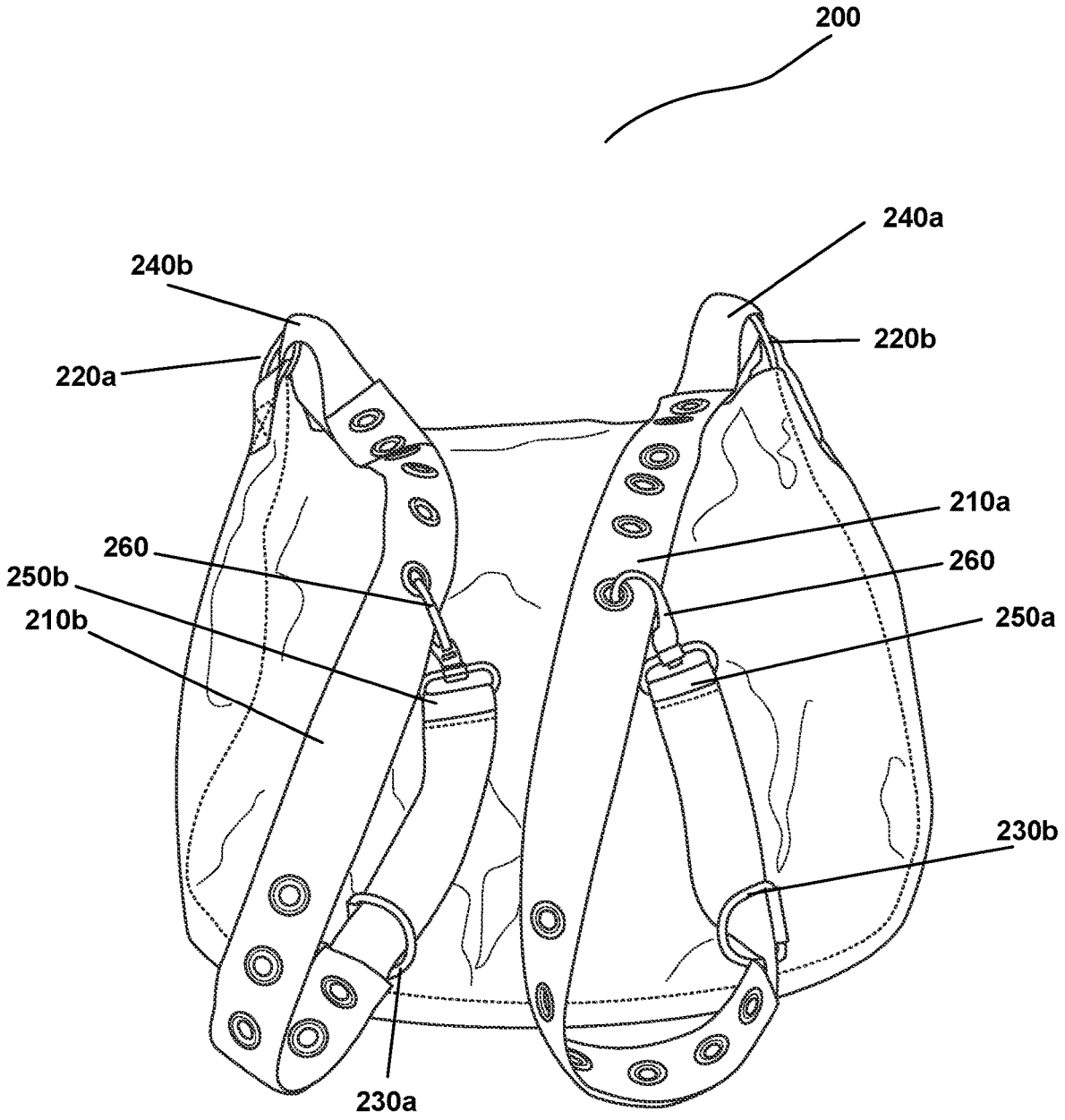
FIG. 6 depicts a second configuration of the bag of FIG. 4 according to an exemplary embodiment.

FIGS. 5 and 6 depict a bag 200 in a configuration with two handles or straps 210*a* and 210*b* (collectively, straps 210). Each strap has one end 240*a* and 240*b* that is permanently (i.e., non-removably) attached to the attachment point 220. The other end 250*a* and 250*b* has an attachment mechanism 260. As depicted in FIG. 5, the bag 200 may be configured as a purse or handbag with both straps 210 being used. In some embodiments, only one strap may be used. In FIG. 6, the bag 200 may be configured as a backpack by attaching the strap ends 250*a* and 250*b* to the attachment points 230*a* and 230*b*.

The bag 200 has two attachment points 220*a* and 220*b* (collectively, attachment points 220) at a top portion and two attachment points 230*a* and 230*b* (collectively, attachment points 230) proximal a bottom portion. Each of the attachment points 220 and 230 are permanently attached to the bag. The bottom attachment points may be located above the bottom portion on one side of the bag as depicted in FIGS. 5 and 6. Each of the attachment points 220 and 230 are large enough for the attachment mechanisms of the strap and the strap itself to thread through and rotate once threaded through. In various embodiments, all attachment points and all openings in the strap may be configured so that the strap free ends may be threaded through them and rotated once threaded through.

To convert the bag 200 from a handbag to a backpack, the unattached end of strap (250*a*, 250*b*) may be extended down the length of the bag and may be threaded through a loop (230*a*, 230*b*) at bag bottom and may be secured using the strap attachment mechanism 260. The length of the strap may be adjusted by securing the strap back on itself as shown in FIG. 6 using the attachment mechanism 260 to attach to one of the attachment points 270 along the body of the strap 210. As depicted, the straps 210 may then run the length of the bag enabling the bag 200 to be used in a backpack configuration.

Figure 7:
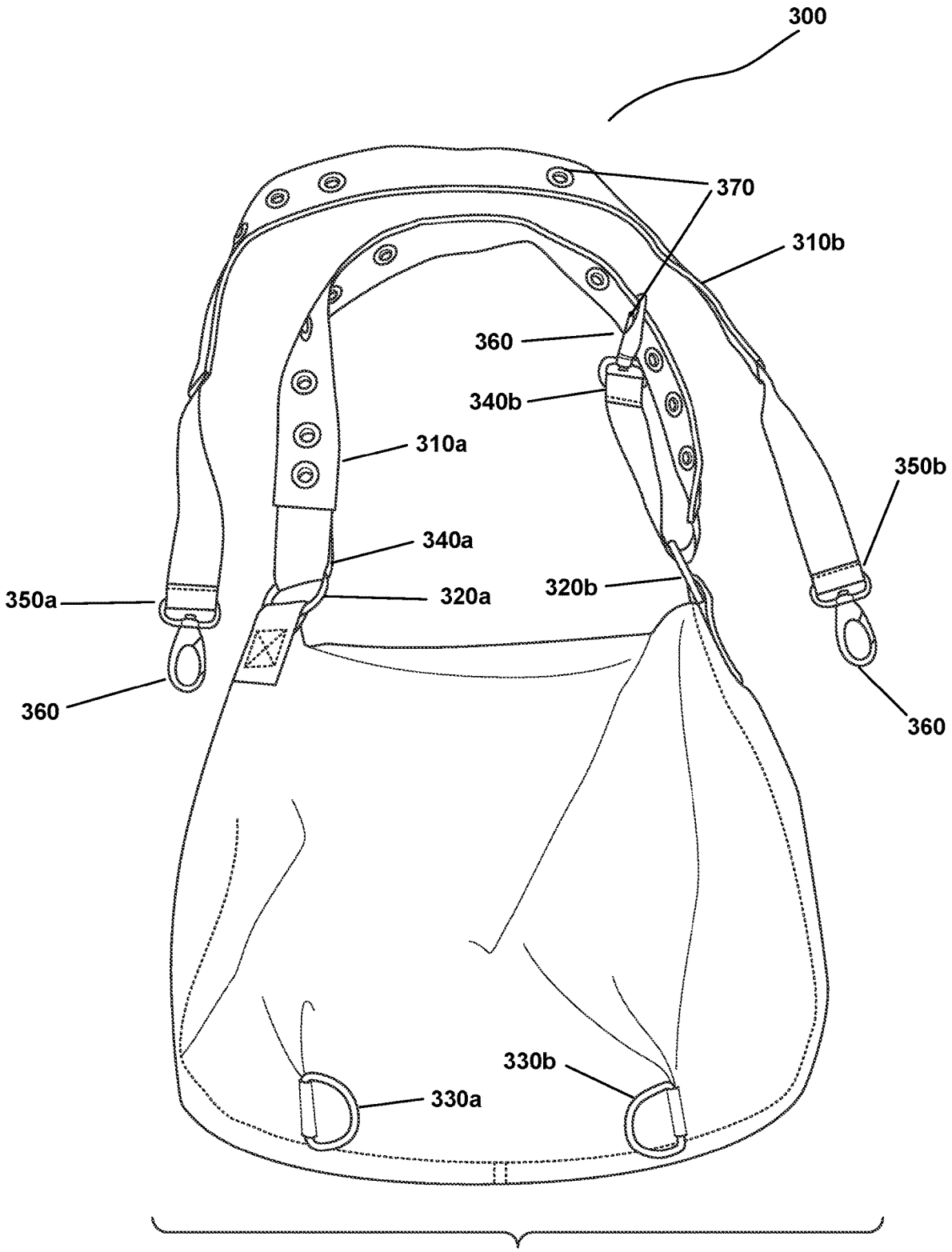
FIG. 7 depicts a bag according to an exemplary embodiment.
Figure 8:
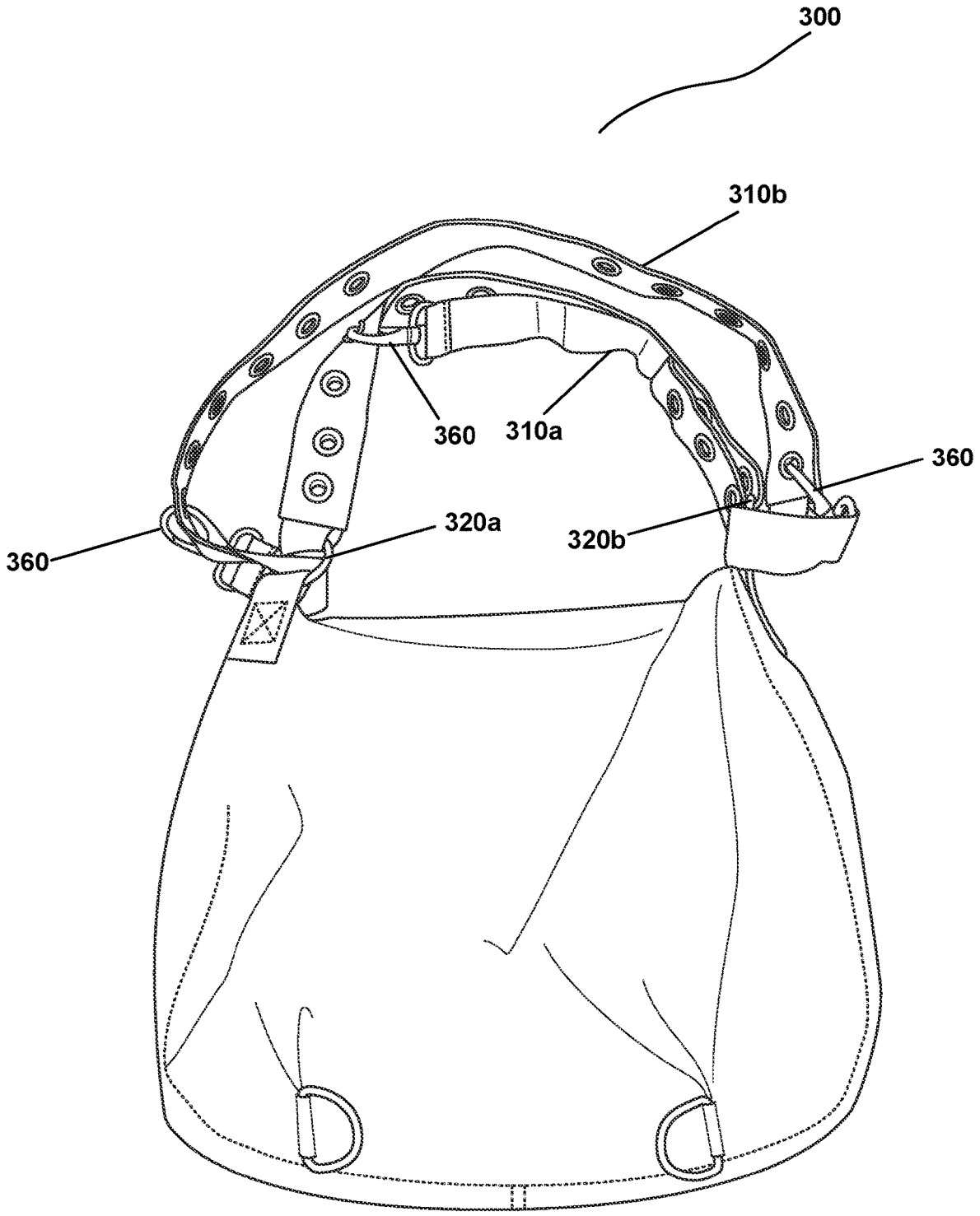
FIG. 8 depicts a second configuration of the bag of FIG. 6 according to an exemplary embodiment.
Figure 9:
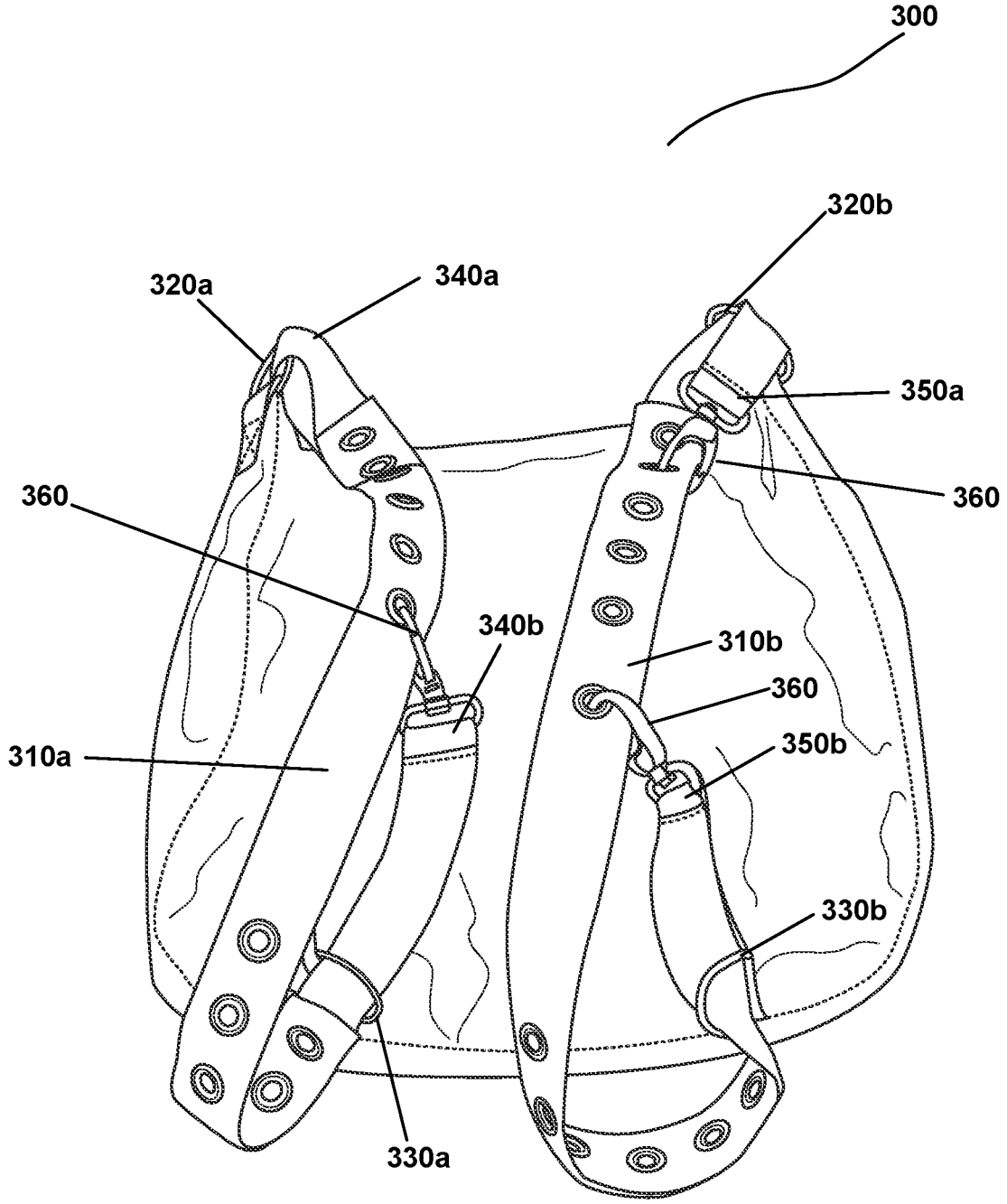
FIG. 9 depicts a third configuration of the bag of FIG. 6 according to an exemplary embodiment.

FIGS. 7-9 depict a bag 300 in a configuration with two handles or straps 310*a* and 310*b* (collectively, straps 310). In this embodiment, the strap 310*a* has one end 340*a* that is permanently (or non-removably) attached to the attachment point 320*a* and a free end 340*b* that has a mechanism 360 for removably attaching the strap end to the attachment points 320 and 330, as well as attached to the attachment point 370 in the strap body. The other strap 310*b*, has mechanism 360 on both ends so both ends can be removably attached to any of the attachment points 320 or 330, as well as attached to attachment points 370 in the strap body. FIGS. 7 and 8 depict the bag 300 in a purse or handbag configuration. In FIG. 7, only one of the straps (310*a*) is attached. In FIG. 8, both straps (310*a*, 310*b*) are attached, with the strap 310*b* have its ends threaded through each of the attachment points 320 and its attachment mechanism 360 attached back to itself to secure the strap. FIG. 9 depicts the bag 300 in a backpack configuration.

The bag 300 has two attachment points 320*a* and 320*b* (collectively, attachment points 320) at a top portion and two attachment points 330*a* and 330*b* (collectively, attachment points 330) located proximal a bottom portion of the bag. Each of the attachment points 320 and 330 are permanently attached to the bag. The bottom attachment points (330*a*, 330*b*) may be located above the bottom portion on one side of the bag as depicted in FIGS. 7-9. Each of the attachment points 320 and 330 are large enough for the attachment mechanisms of the strap and the strap itself to thread through and rotate once threaded through. In various embodiments, all attachment points and all openings in the strap may be configured so that the strap free ends may be threaded through them and rotated once threaded through.

To convert the bag 300 from a handbag to a backpack, the unattached end 340*b* of strap 310*a* may be may be extended down the length of the bag and may be threaded through the loop 330*a* at bag bottom, and this end may be secured using the strap attachment mechanism 360. The other strap 310*b*, may have its first end 350*a* attached to the loop 320*b* and have the other end 350*b* extend down the length of the bag and may be threaded through the loop 330*b* at the bag bottom. The length of the straps may be adjusted by securing the straps back on itself as shown in FIG. 9.

Figure 10:
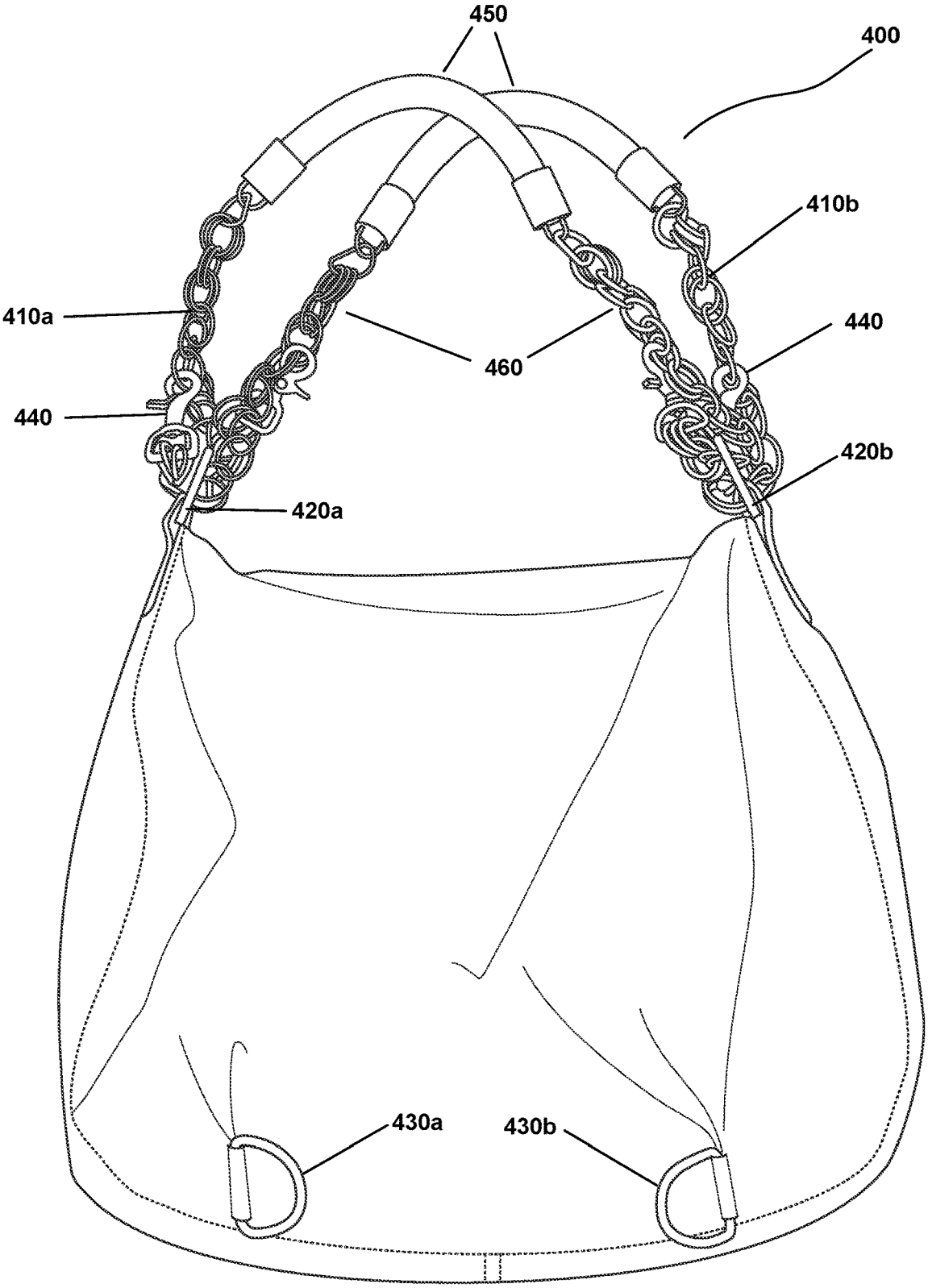
FIG. 10 depicts a bag according to an exemplary embodiment.
Figure 11:
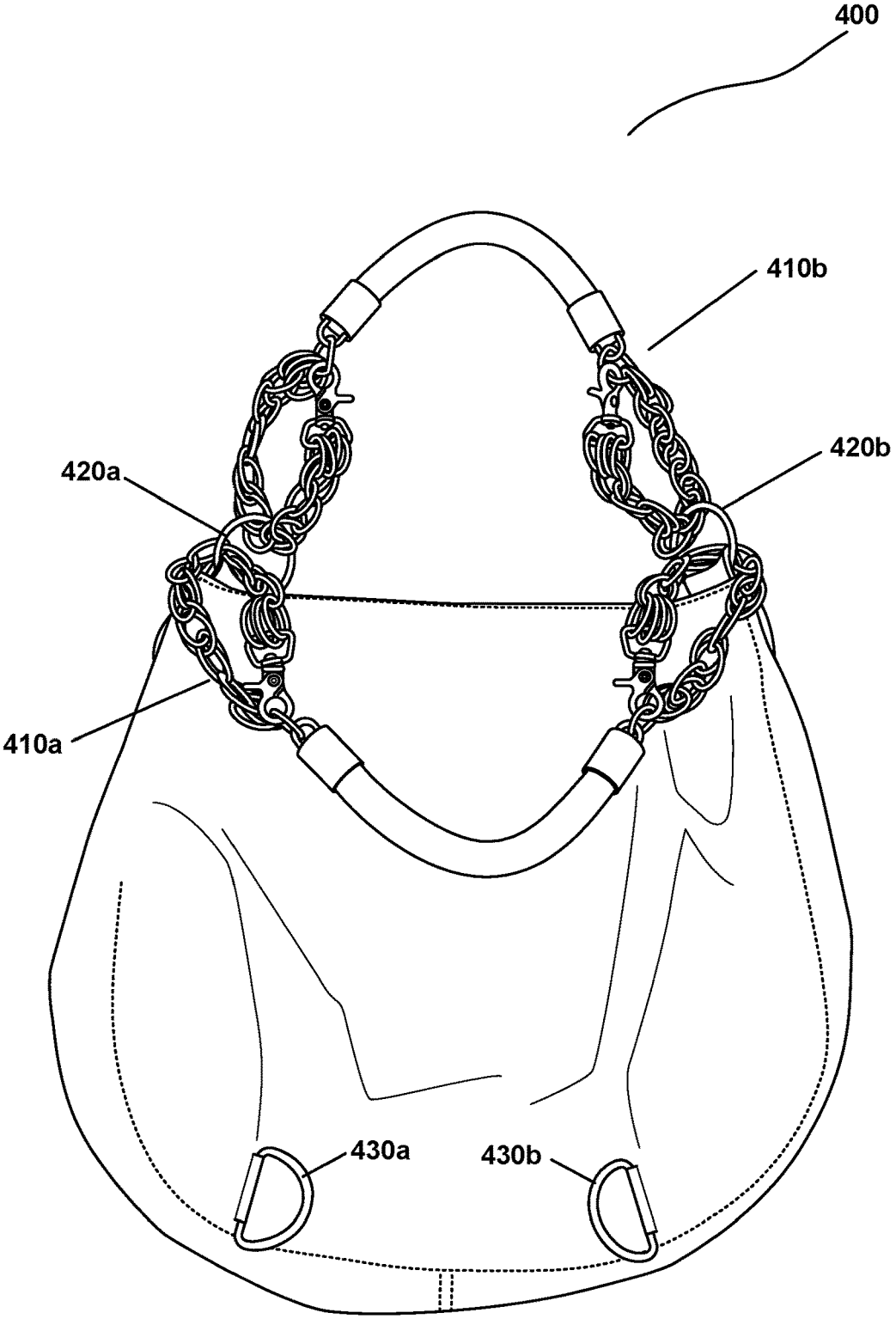
FIG. 11 depicts a second configuration of the bag of FIG. 10 according to an exemplary embodiment.
Figure 12:
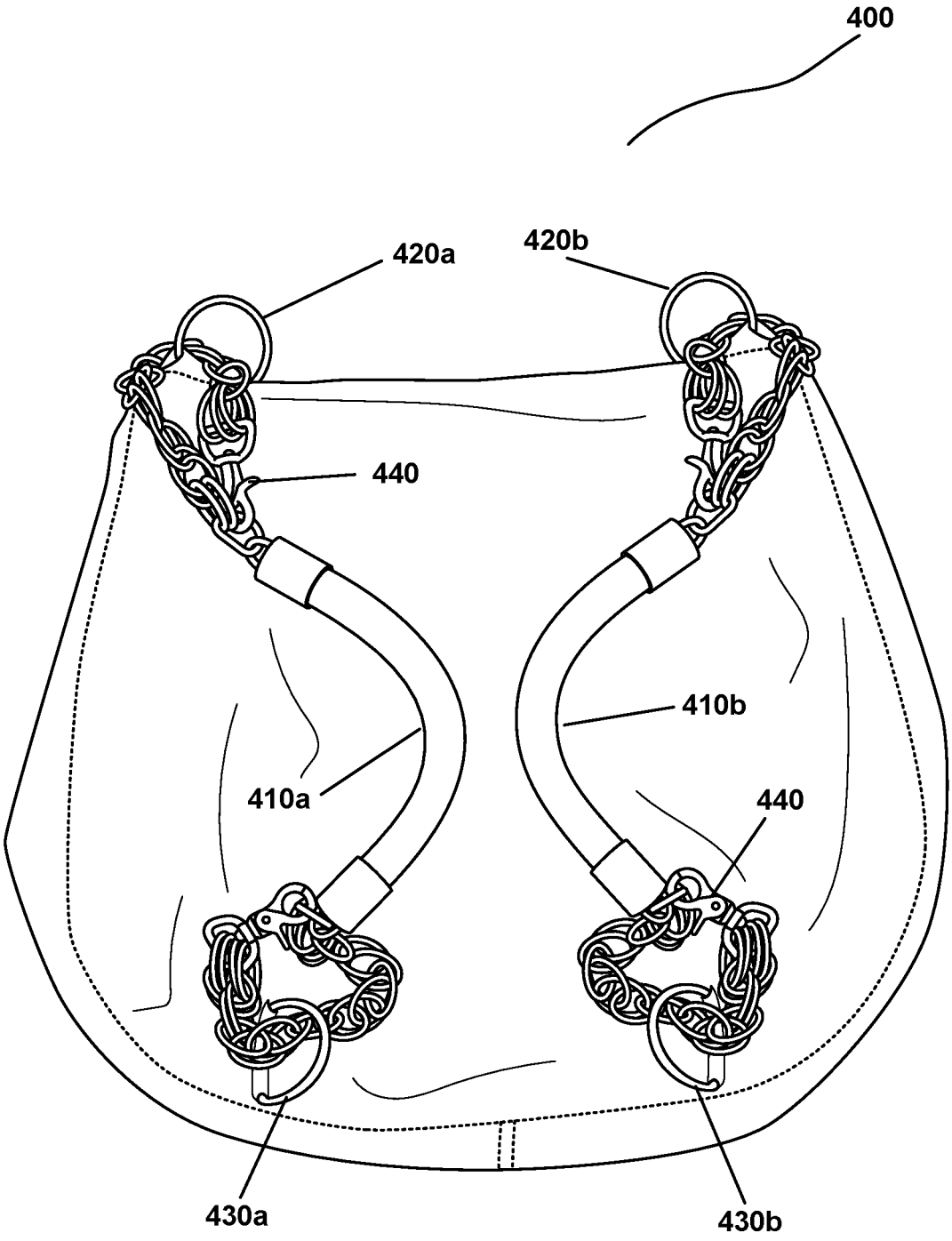
FIG. 12 depicts a third configuration of the bag of FIG. 10 according to an exemplary embodiment.

FIGS. 10-12 depict a bag 400. FIG. 10 depicts the bag 400 in a configuration with two handles or straps 410*a* and 410*b* (collectively, straps 410). The two handles or straps may be configured to be carried in the hand(s) of a user in a purse or handbag configuration as depicted in FIG. 10. FIG. 11 depicts the bag 400 with the two straps 410 attached and separated to show the detail of the attachment. From FIG. 11, it can be appreciated that both straps may be attached yet only one may be used to carry the bag. FIG. 12 depicts the bag 400 in a backpack configuration.

The bag 400 has two attachment points 420*a* and 420*b* (collectively, attachment points 420) at a top portion and two attachment points 430*a* and 430*b* (collectively, attachment points 430) proximal a bottom portion. Each of the attachment points 420 and 430 are permanently attached to the bag. The bottom attachment points may be located above the bottom portion on one side of the bag as depicted. In FIGS. 10 and 11, a portion of the strap 410 comprising chain links is threaded through the attachment points 420 and connected back unto itself. In FIG. 12, the straps 410 are connected to one each of attachment point 420 and attachment point 430. Each of the attachment points 420 and 430 are large enough for the attachment mechanisms of the strap and the strap itself to thread through and rotate once threaded through. In various embodiments, all attachment points and all openings in the strap may be configured so that the strap free ends may be threaded through them and rotated once threaded through.

The attachment points 420 and 430 are depicted as loops. However, other suitable shapes and configurations can be used such as D-rings, rectangular rings, oblong rings, circular rings, square rings, or other shapes that can serve as an attachment point. In some embodiments, the attachment points can be integral to the bag 400.

The two straps 410 each have a mechanism 440 at each end that allows for attachment and detachment to the attachment points 420 and/or 430. The mechanism 440 can be any appropriate mechanism such as a clip, snap-hook, etc. Each strap 410 has a solid center section 450 attached to a chain portion 460 that terminated in the mechanism 440.

Other styles of straps can be used to allow for straps 410 to be permanently attached at one end to the bag (i.e., the strap 410 has one free end), or for one handle to be attached at one end to the bag and the other to be completely detachable.

To convert the bag 400 from a handbag to a backpack, the first end of straps may be threaded through loops 420 at bag top (in same direction), and secured using the strap attachment mechanism 440. The second end of strap may be extended down the length of the bag, the second end may be threaded through the loops 430 at bag bottom, and the second end may be secured using the strap attachment mechanism 440. The length of the strap may be adjusted by securing the strap back on itself as shown in FIG. 12.

Figure 13:
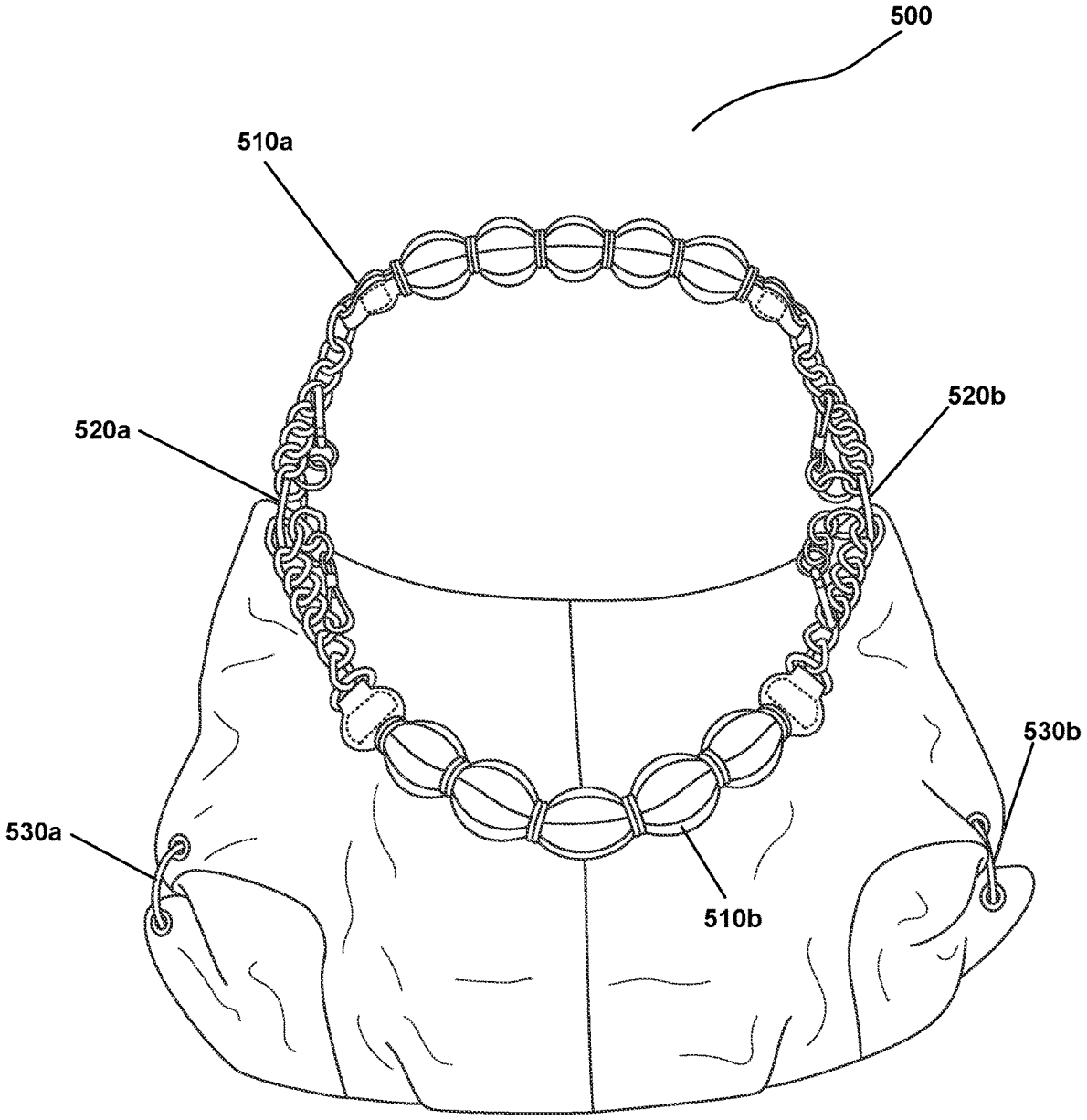
FIG. 13 depicts a bag according to an exemplary embodiment.
Figure 14:
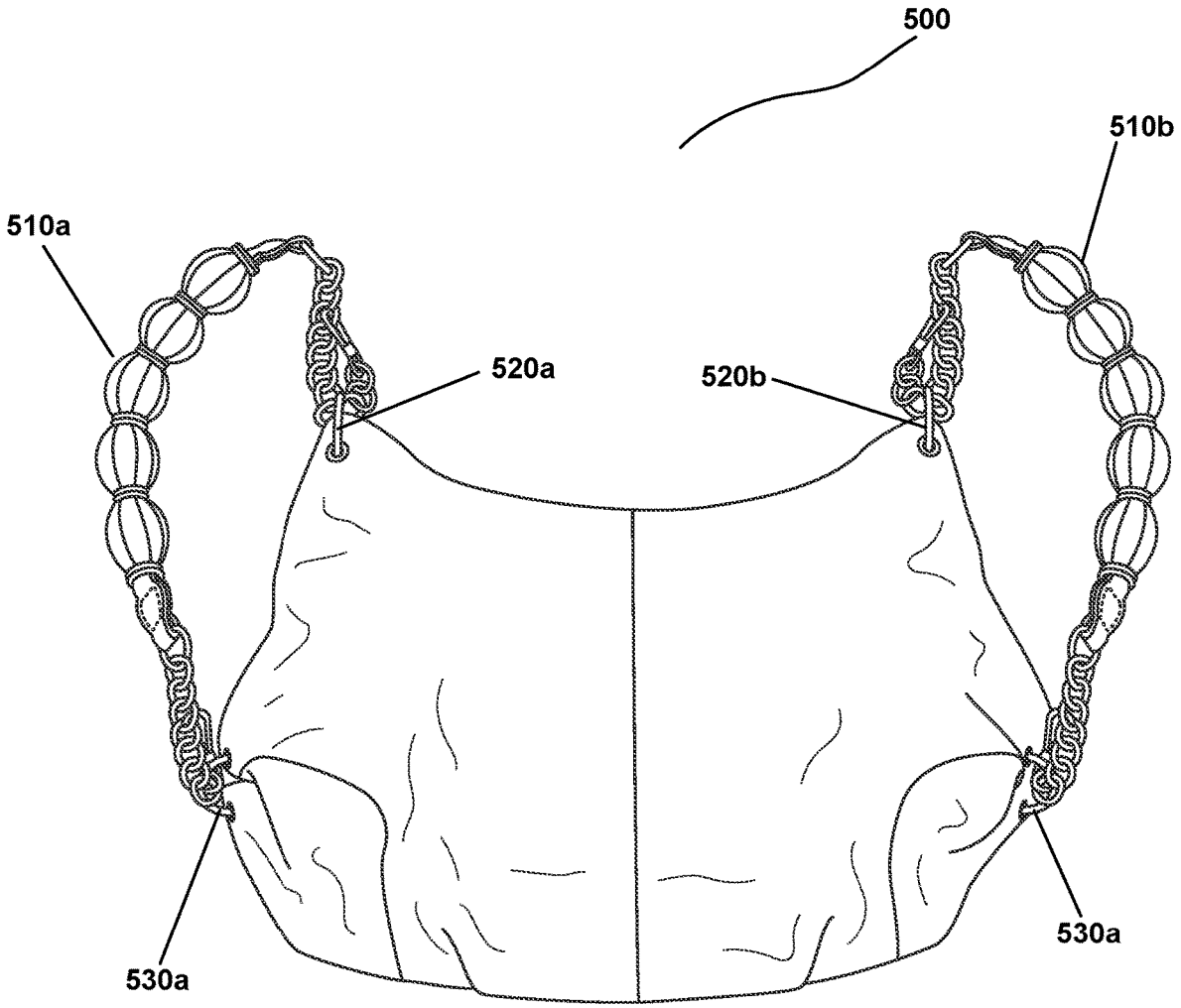
FIG. 14 depicts a second configuration of the bag of FIG. 13 according to an exemplary embodiment.

FIGS. 13 and 14 depict a bag 500. FIG. 13 depicts a bag 500 in a purse or handbag configuration. The bag 500 has two handles or straps 510*a* and 510*b* (collectively, straps 510), both detachable at both ends. The straps 510 may be configured to allow a user to hold the straps in their hand(s). The straps 510 may be long enough to use the bag as a shoulder bag, a crossbody bag, and a backpack. The straps 510 may be adjustable to be short enough to carry the bag in a hand.

The bag 500 has two attachment loops 520*a* and 520*b* (collectively, attachment loops 520), one permanently attached at each end of bag top. Each attachment loop 520 is large enough for the attachment mechanisms 540 on the strap to thread through, as well as the strap body itself to thread through. The length of each strap 510 may be configured by the amount of the strap that is threaded through the attachment loop.

The bag 500 has two attachment loops 530*a* and 530*b* (collectively, attachment loops 530), one permanently attached to each side of the bag, near the bottom portion of the bag. Attachment loops 530 can be used to shape the bottom sides of the bag 500. The straps 510 can be attached to one each of loops 520 and 530 to use the bag 500 in a backpack configuration as depicted in FIG. 14. In various embodiments, all attachment points and all openings in the strap may be configured so that the strap free ends may be threaded through them and rotated once threaded through.

Figure 15:
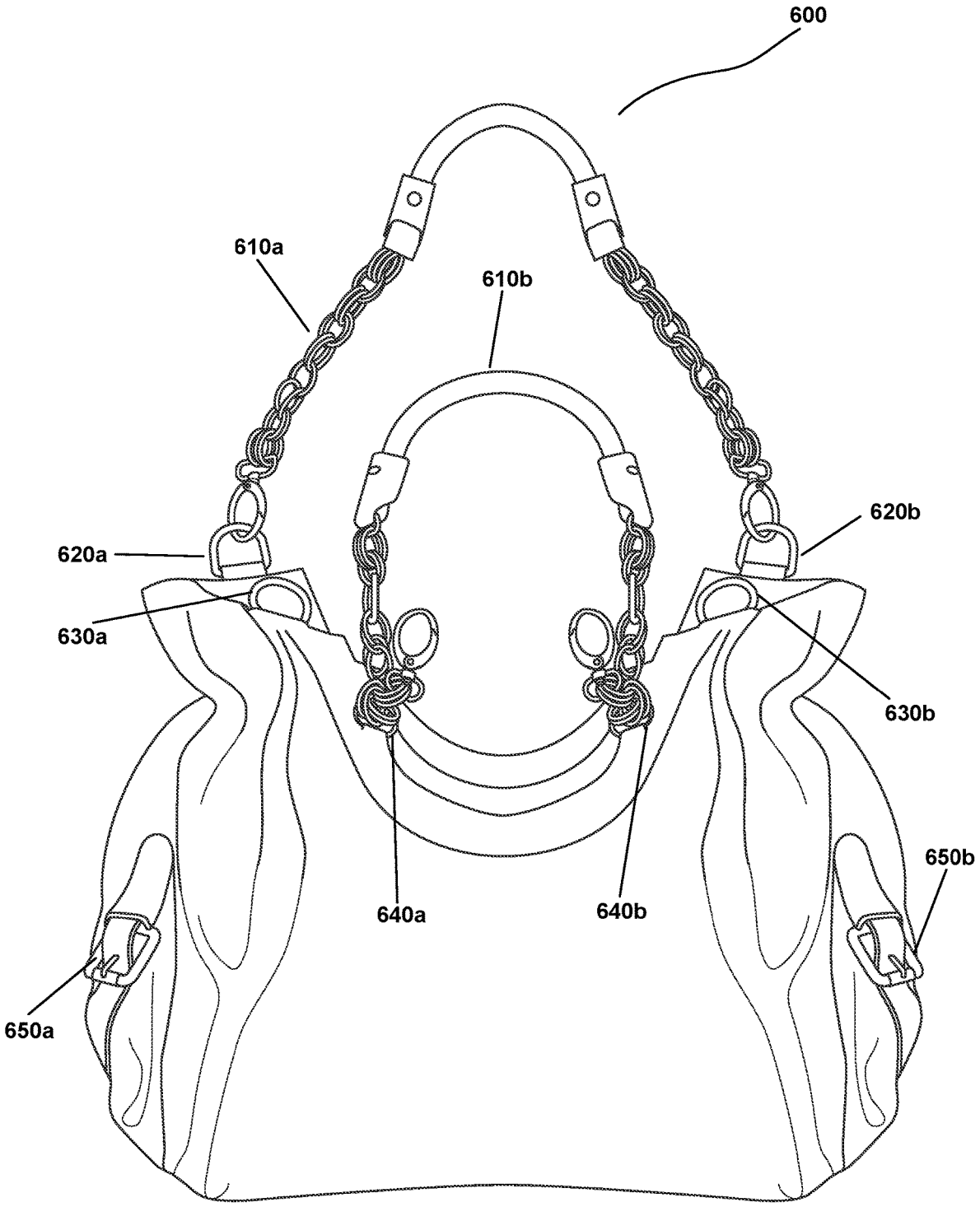
FIG. 15 depicts a bag according to an exemplary embodiment.
Figure 16:
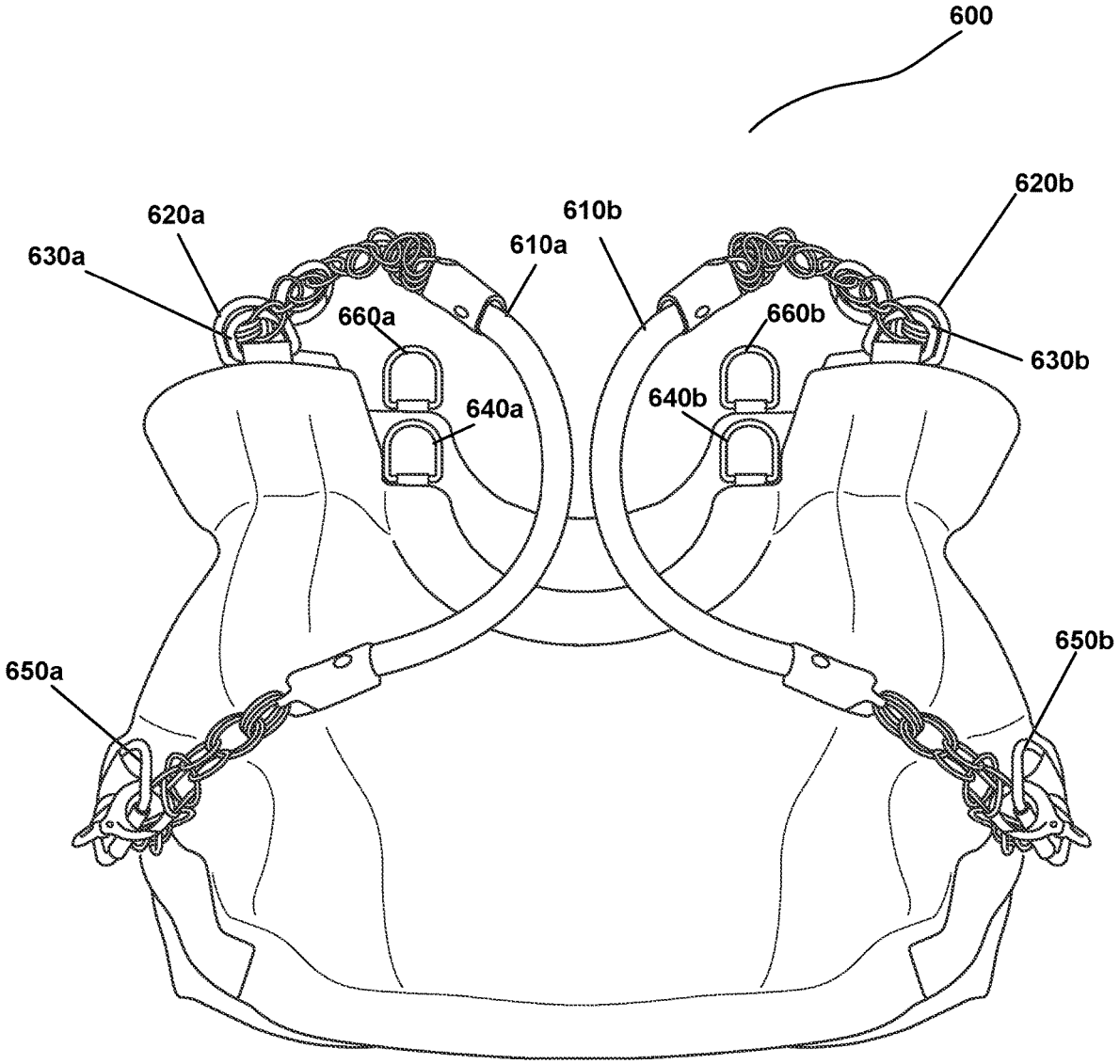
FIG. 16 depicts a second configuration of the bag of FIG. 15 according to an exemplary embodiment.
Figure 17:
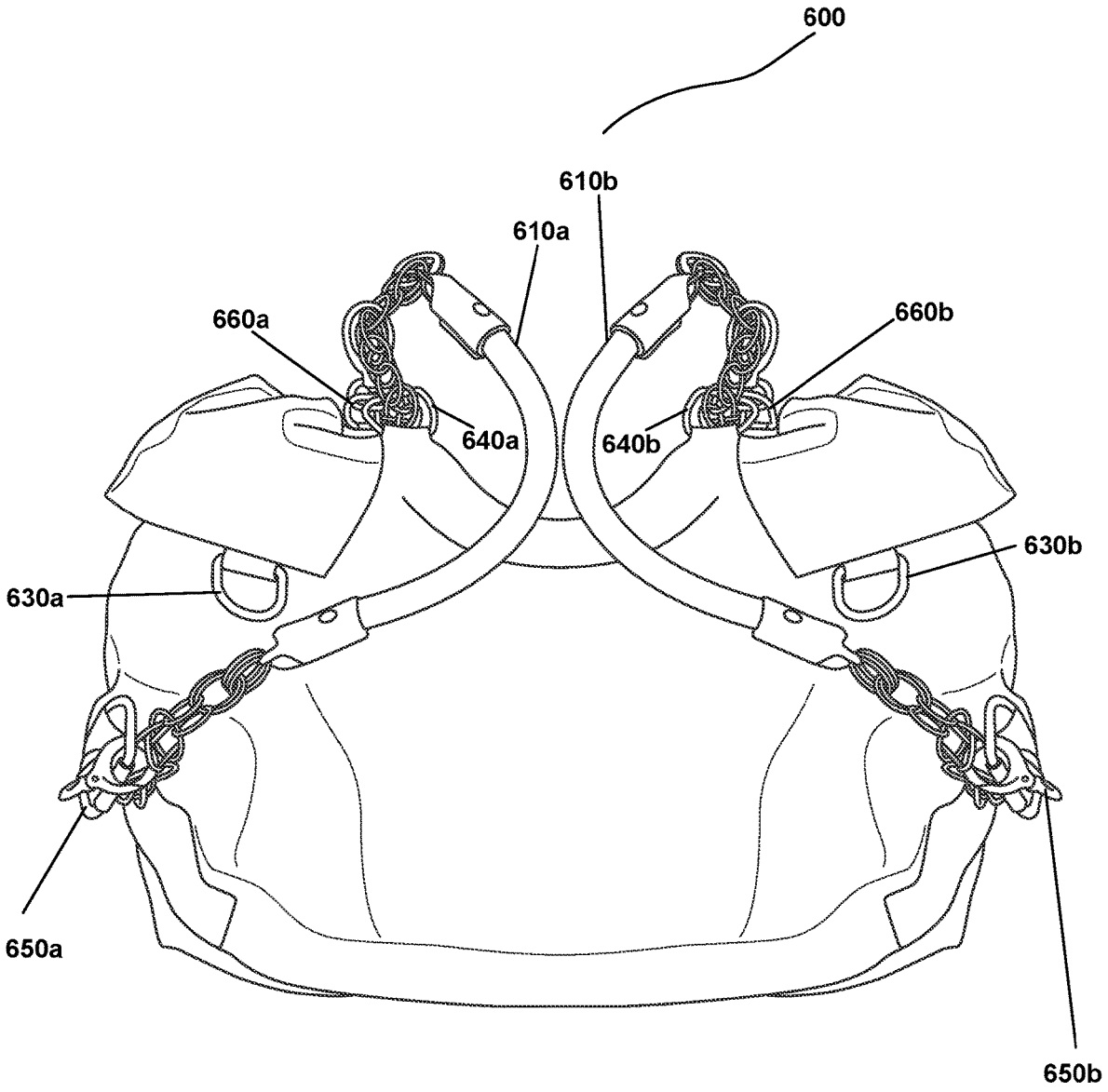
FIG. 17 depicts a third configuration of the bag of FIG. 15 according to an exemplary embodiment.

FIGS. 15-17 depict a bag 600. The bag 600 has multiple attachment points in multiple positions. FIG. 15 depicts the bag 600 with different attachment positions of the straps for use of the bag in a purse or handbag configuration, with each strap handle showing attachment or threading through to different attachment points at different levels of the bag top. FIG. 16 depicts the bag 600 in a backpack configuration. FIG. 17 depicts the bag 600 in an alternate backpack configuration.

The length of the chain on straps 610*a* and 610*b* (collectively, strap 610) allow the bag to be worn as a shoulder bag, a crossbody bag, and a backpack in addition to being carried over the arm or in the hand(s) in a purse/handbag configuration. The bag 600 may have four attachment points at the top portion 620*a* and 620*b* (collectively, attachment points 620) attachment points 630*a* and 630*b* (collectively, attachment points 630). Two additional sets of attachment points 640*a* and 640*b* (collectively, attachment points 640) and 660*a* and 660*b* (collectively, attachment points 660) may be located proximate the top portion of the bag and located inwards of attachment points 620 and 630. Each strap 610*a* and 610*b* may be attached to any of these attachment points. FIG. 15 depicts strap handle 610*a* attached to attachment points 620*a* and 620*b* at the top of the bag, and strap handle 610*b* threaded through attachment points 640*a* and 640*b* proximate the top portion of the bag. In various embodiments, the handles of the bag 600 may work best when the handles are attached or threaded through and rotated to either both sets of attachment points 620 and 630 or both sets of attachment points 640 and 660. However, it should be appreciated that it is possible to use only attachment points 620 or 630 or only attachment points 640 or 660.

The bag 600 may further have attachment points 650*a* and 650*b* (collectively, attachment points 650) located on side portion of the bag. As shown in FIG. 15, the attachment points 650 may also serve as an adjustment mechanism to adjust the size and shape of the bottom of the bag. For example, as shown in FIG. 15, the attachment points 650 may be in a buckle configuration. In various embodiments, the attachment points 650 may be a ring or other structure similar to that of the attachment points 620 and 630.

As depicted in FIGS. 16 and 17, the bag 600 may be configured as a backpack by attaching the ends of the straps to either one or two of the attachment points at the top portion and one each of the attachment points at the bottom portion. At the top portion, the straps may be attached to, threaded through, and rotated through both of the attachment points 620, 630 on each side or may be attached to, threaded through, and optionally rotated through, only one of these points (i.e., 620 or 630). Alternately, at the top portion, the straps may be attached to both of the attachment points 640, 660 on each side or may be attached to only one of these points (i.e., 640 or 660). At the bottom portion, the straps may be attached to, threaded through, and optionally rotated through, the buckle portion of point 650. Alternatively, the strap may be attached to the tongue portion of the attachment point 650. FIG. 17 depicts an alternate backpack configuration in which the strap at the top portion is attached to points 640 and 660. In various embodiments, the handles of the bag 600 type may work best when the handles are attached/threaded through/rotated to either both sets of attachment points 620 and 630 or both sets of attachment points 640 and 660. However, it is possible to use only attachment points 620 or 630 or only 640 or 660.]

Figure 18A:
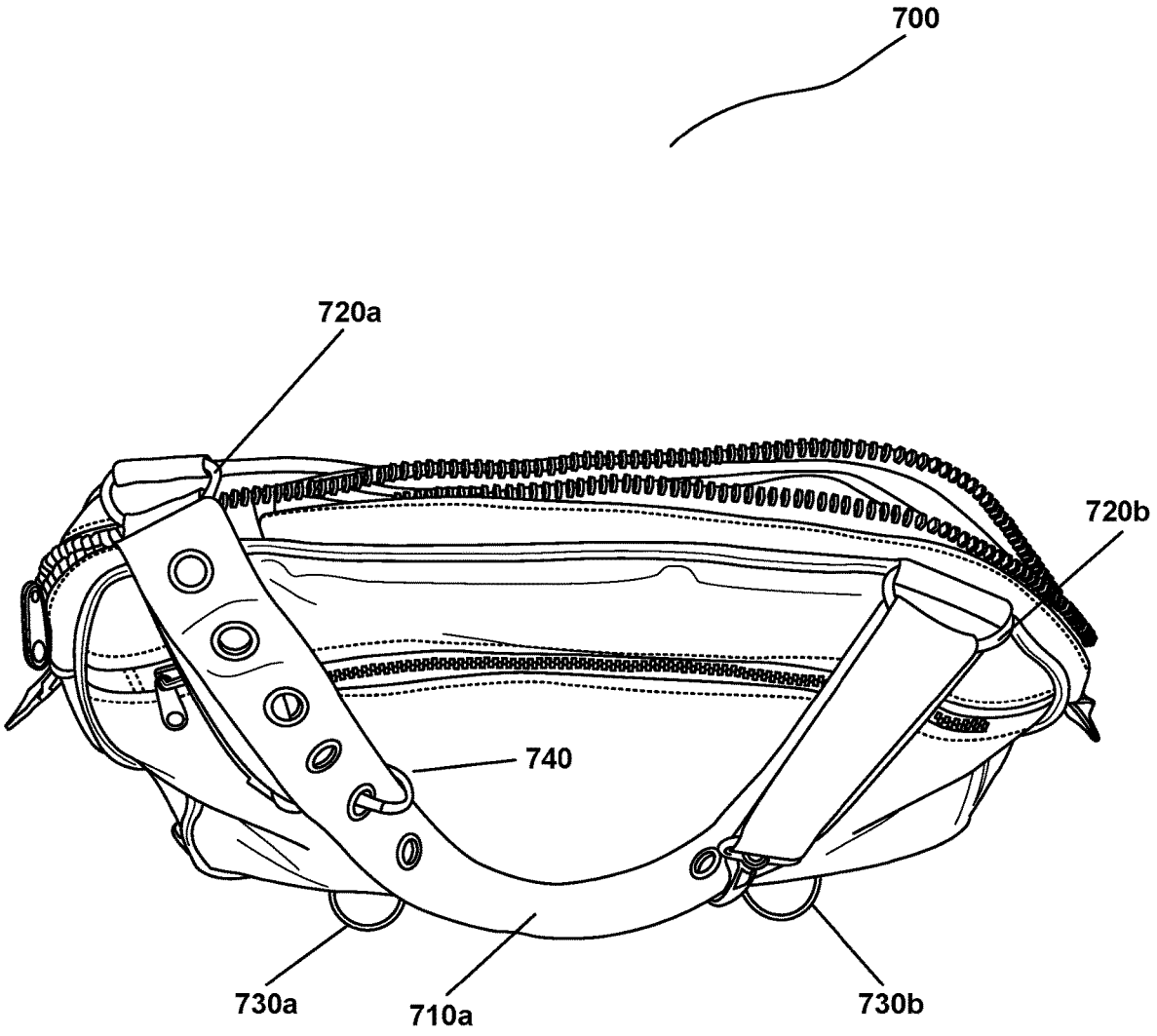
FIG. 18A depicts a bag according to an exemplary embodiment.
Figure 18B:
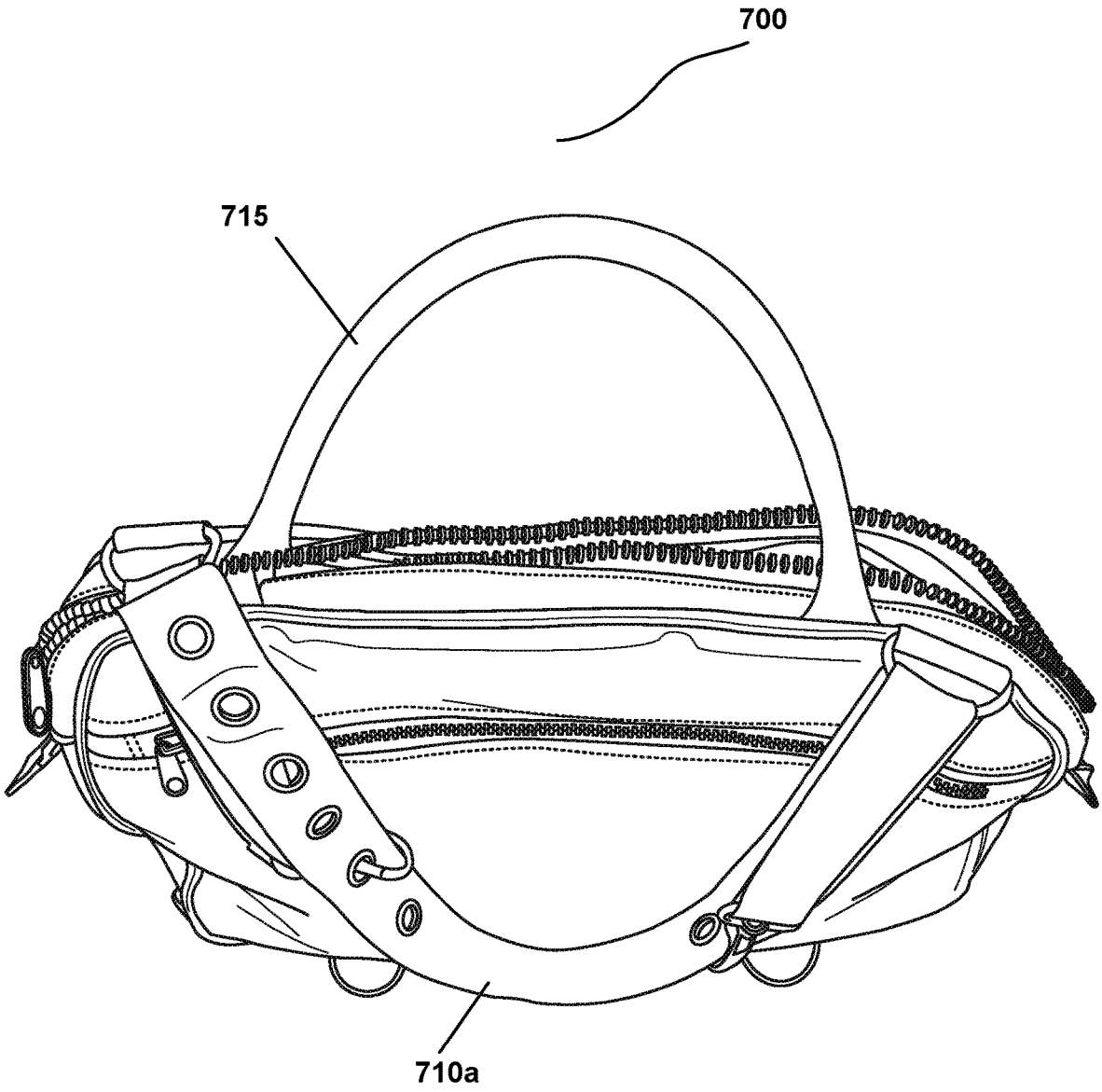
FIGS. 18B and 18C depict alternate strap configurations of the bag of FIG. 18A according to an exemplary embodiment.
Figure 18C:
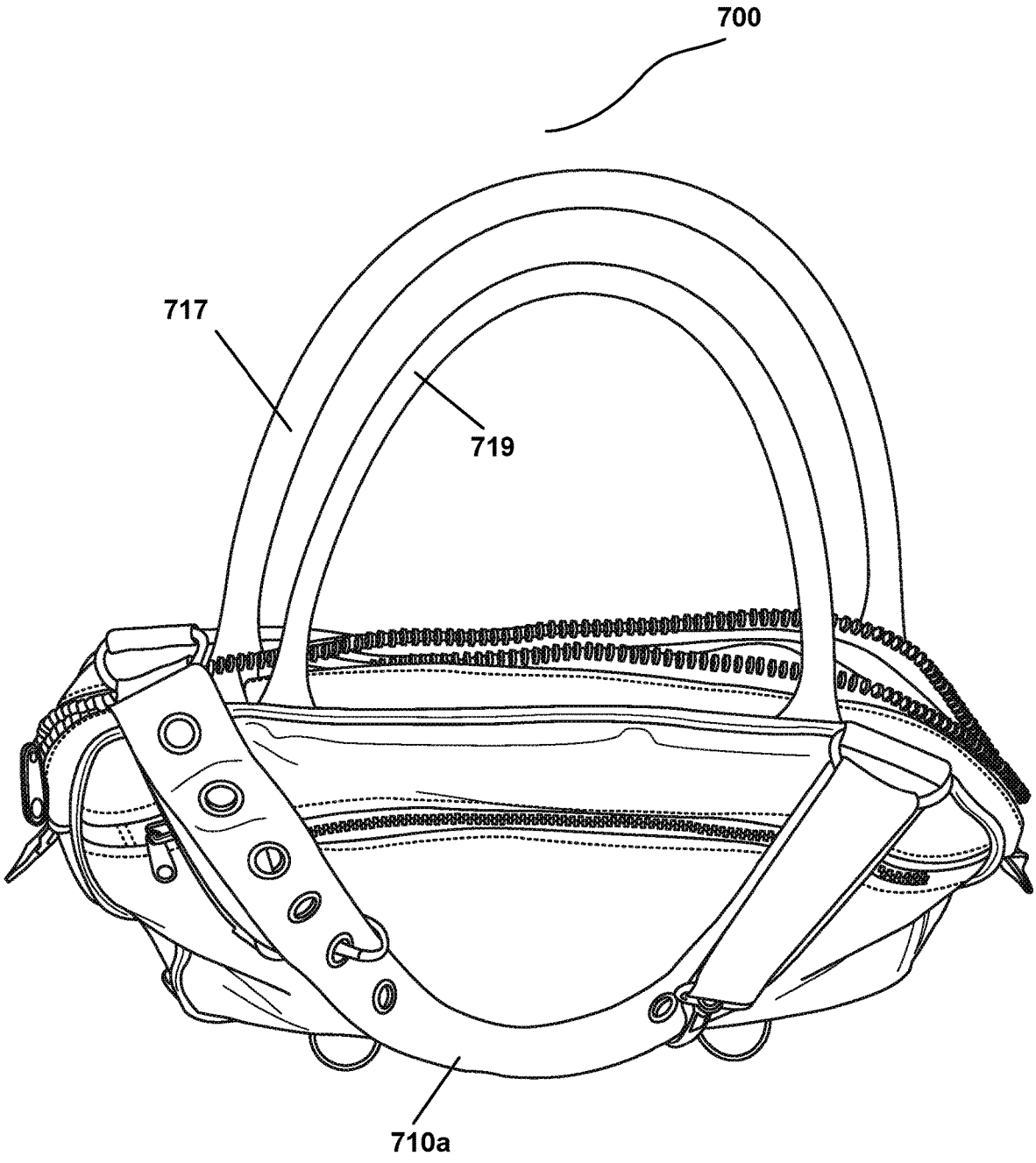
Figure 19A:
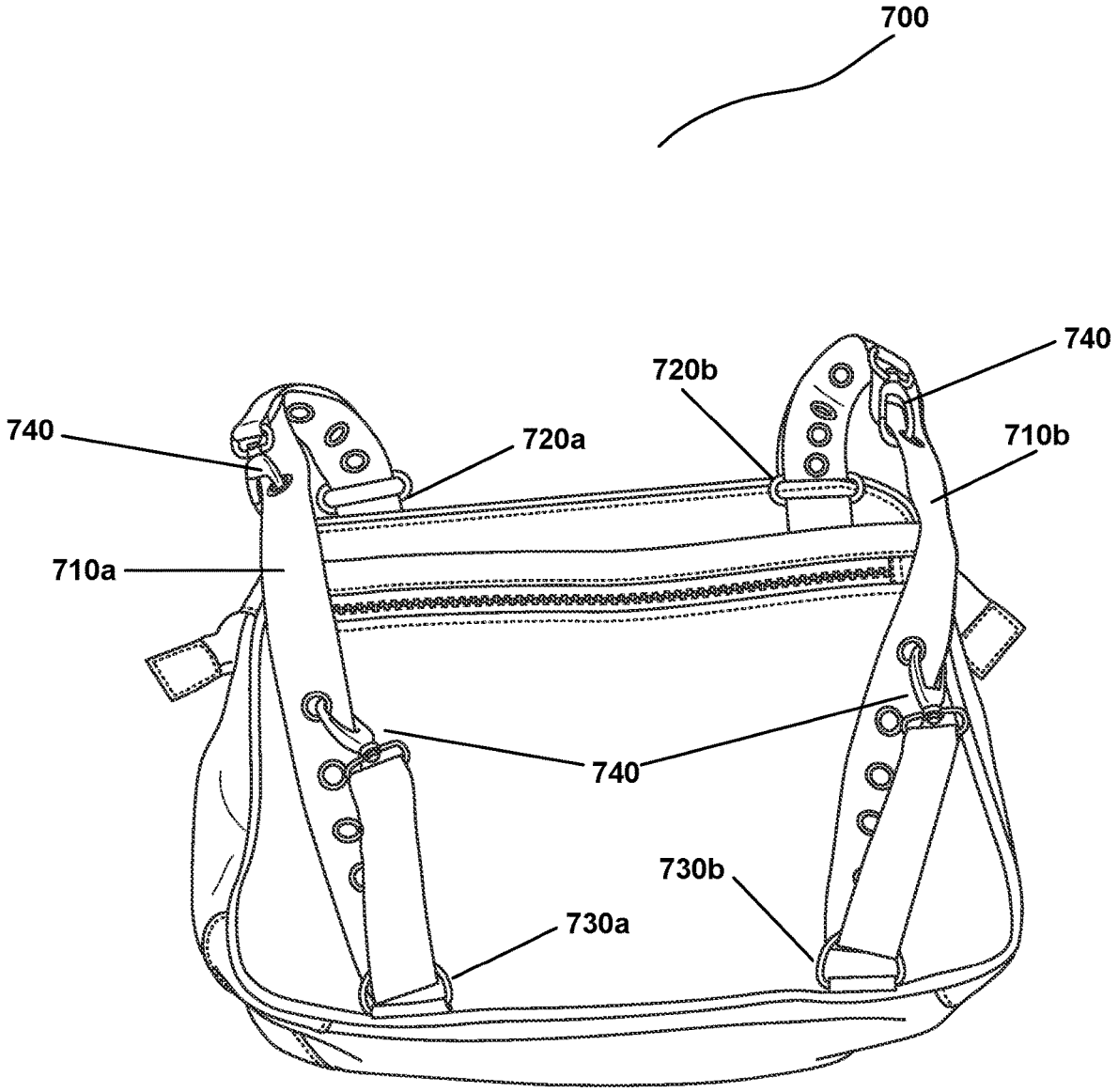
FIG. 19A depicts a second configuration of the bag of FIG. 18A according to an exemplary embodiment.
Figure 19B:
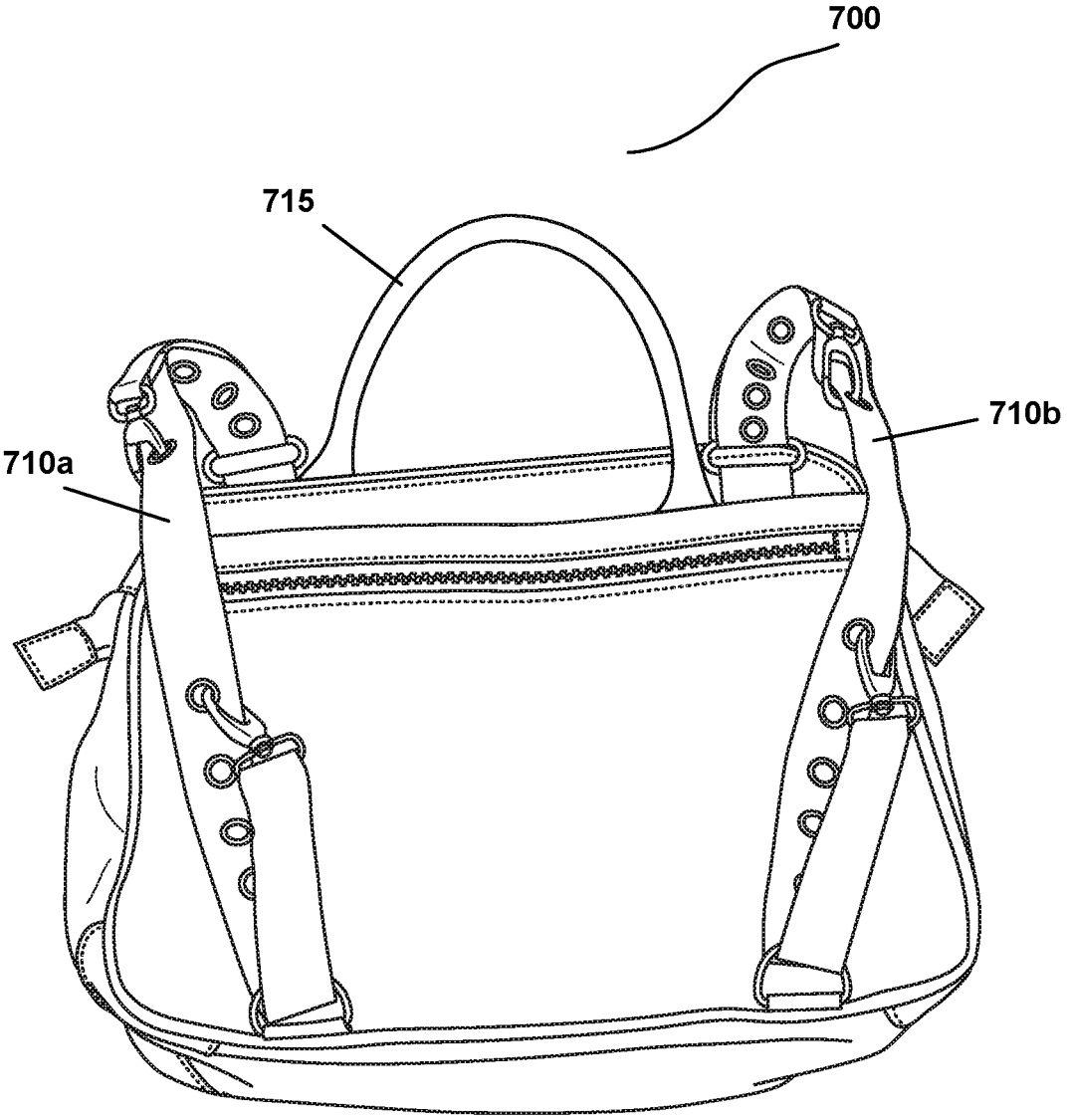
FIGS. 19B and 19C depict alternate strap configurations of the bags of FIGS. 18B and 18C according to an exemplary embodiment.
Figure 19C:
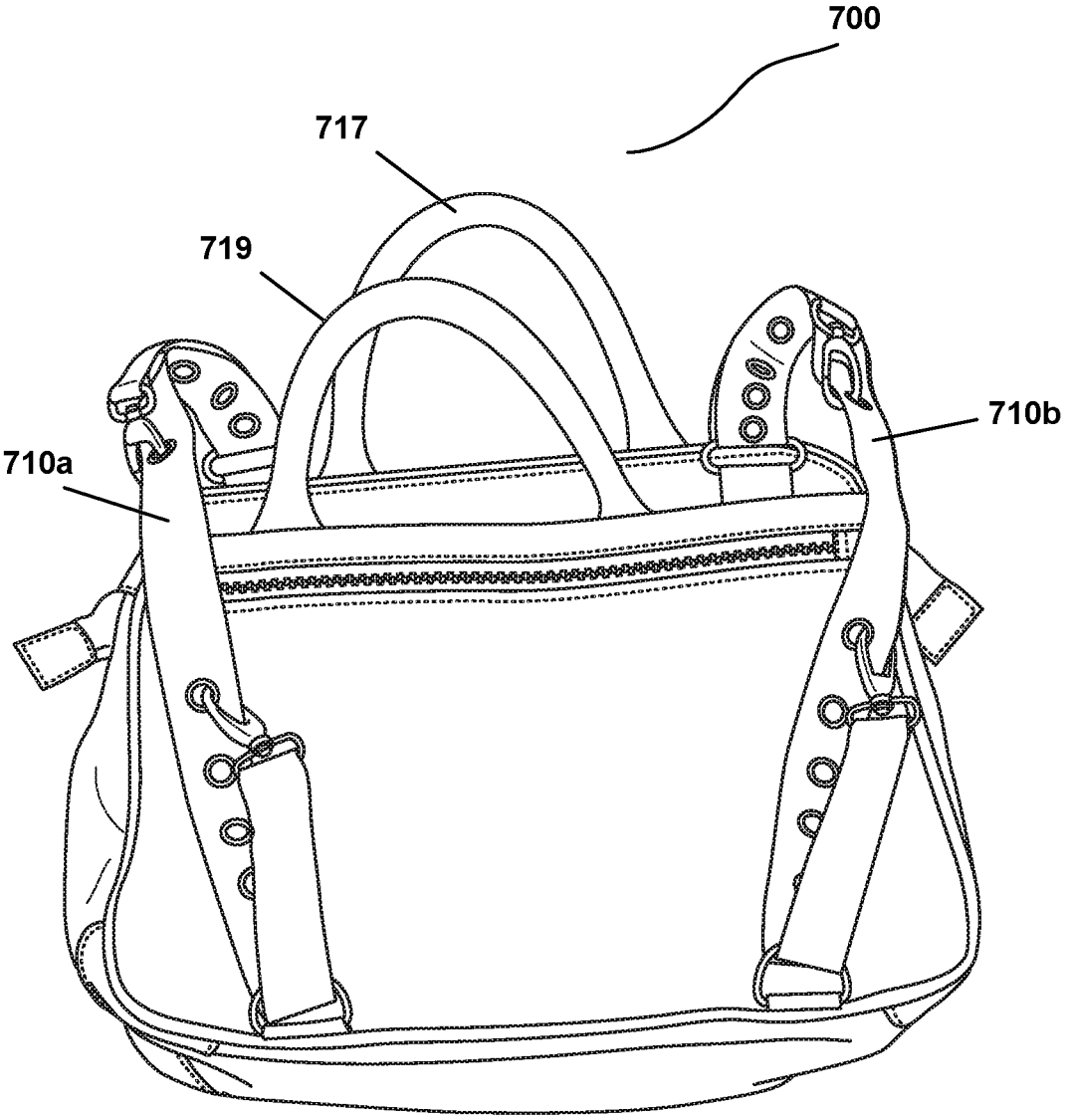

FIGS. 18 and 19 depict a bag 700. FIGS. 18A, 18B, and 18C show bag 700 assembled as a bag (e.g., a purse or handbag or crossbody bag). FIGS. 19A, 19B, and 19C show bag 700 assembled as a backpack.

The bag 700 of FIGS. 18 and 19 has two attachment loops 720*a* and 720*b* (collectively, attachment loops 720) each permanently attached at the end of the sides at the bag top, diagonally opposite each other on opposite sides of the bag.

The bag 700 as depicted in FIG. 18A has two straps 710*a* and 710*b* (collectively, straps 710), both detachable at both ends. The straps 710 may serve as handles.

The bag 700 has two attachment loops 730*a* and 730*b* (collectively, attachment loops 730), both permanently attached on the same side of bag bottom. Each of the attachment loops 720 and 730 are large enough for the attachment mechanisms 740 and the strap 710 to thread through.

FIG. 18A depicts one strap handle 710*a* attached through each loop 720 at the bag top. The end of strap 710*a* may be threaded through the loop 720 and attached back on itself as depicted in FIG. 18A. Alternatively, one of both ends of strap 710 can also be attached directly to one loop 720 using the mechanism 740. The second strap 710*b* can be stored in the bag 700 when not in use. In some embodiments, the flexibility of this strap type allows for both straps 710 to be permanently attached at one end, or for one handle to be attached at one end and the other to be completely detachable FIG. 18B depicts the bag 700 with a strap 715 that is permanently attached to the body of the bag at both ends. This strap may be used with the straps 710 to carry the bag 700. In various embodiments, the strap 715 may be used in lieu of the straps 710 to carry the bag 700. FIG. 18C depicts the bag 700 with straps 717 and 719 that are permanently attached to the body of the bag at both ends. These straps may be used with the straps 710 to carry the bag 700. In various embodiments, the straps 717 and 719 may be used in lieu of the straps 710 to carry the bag 700.

To convert the bag 700 from a handbag to a backpack, the first end of straps 710 may be threaded through loops 720 at bag top (in same direction), and secured using the strap attachment mechanism 740. The second end of each strap 710 may be extended down the length of the bag, where the second end may be attached to, threaded through, and rotated through the loop 730 at the bag bottom, and the second end may be secured using the strap attachment mechanism 740. The length of the strap may be adjusted by securing the strap back on itself as shown in FIG. 19A. In various embodiments, the straps 710 may be left configured in the manner depicted in FIG. 19A and the bag 700 may be carried using the attached straps depicted in FIGS. 19B and 19C.

Figure 20A:
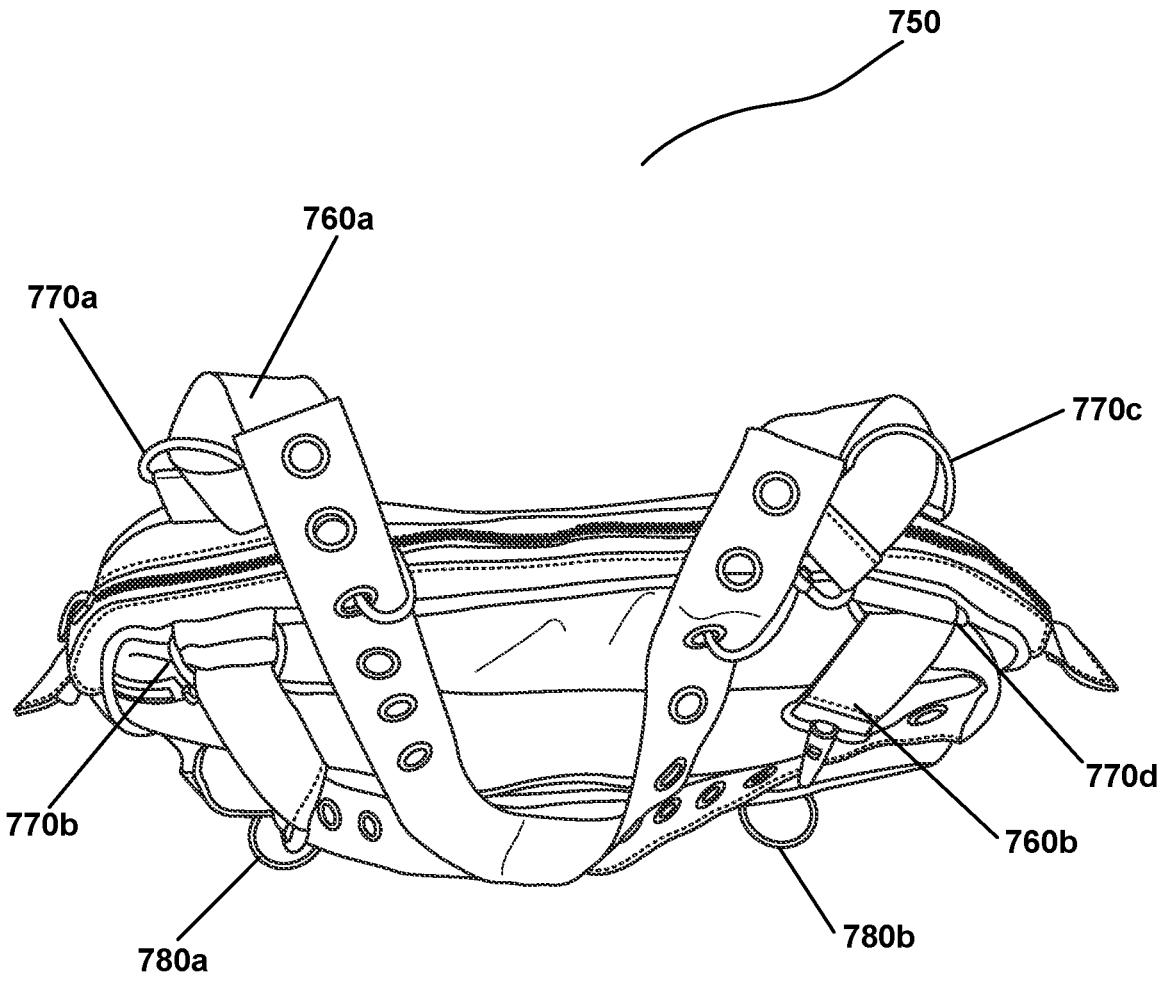
FIG. 20A depicts a bag according to an exemplary embodiment.
Figure 20B:
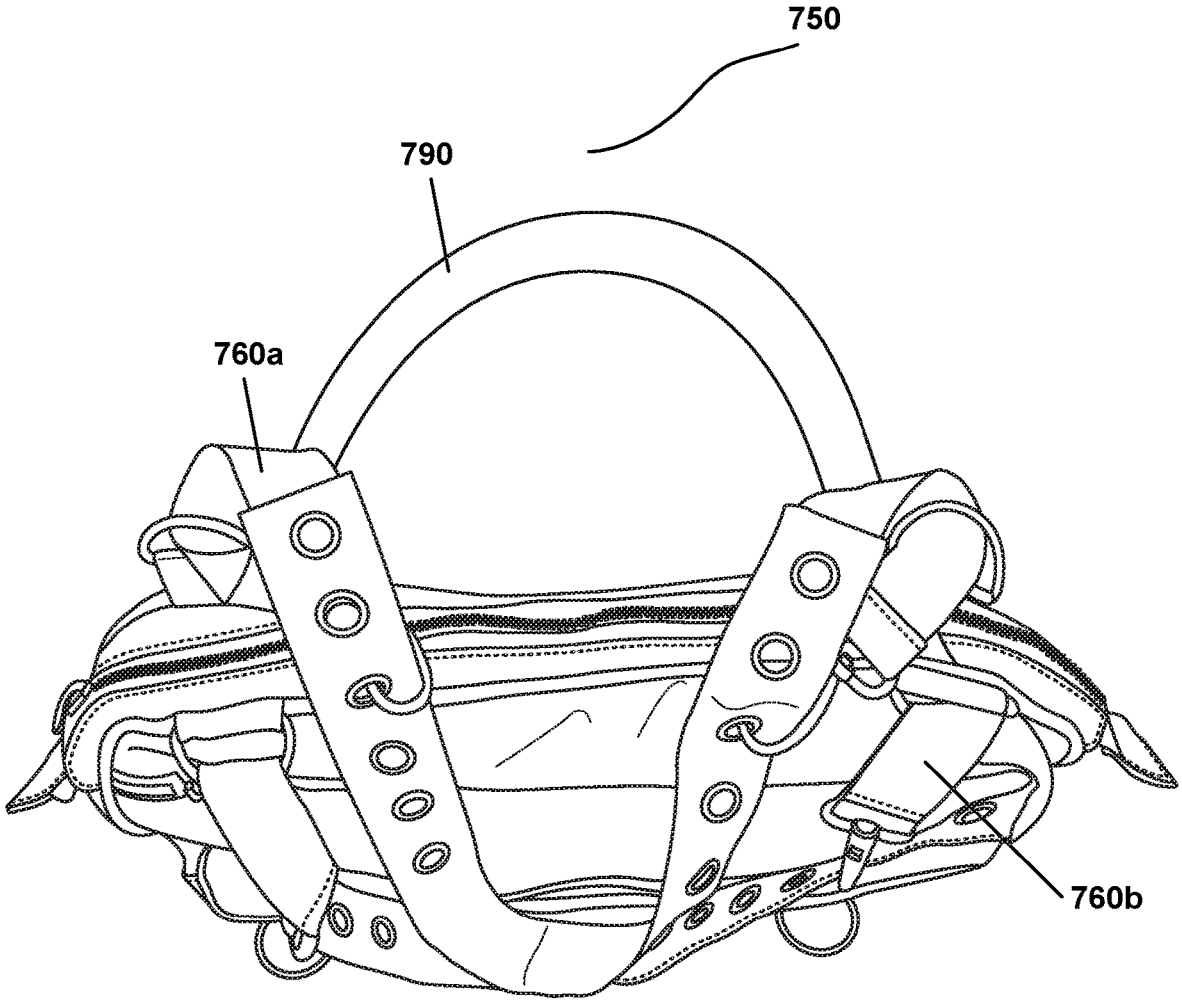
FIGS. 20B and 20C depict alternate strap configurations of the bag of FIG. 20A according to an exemplary embodiment.
Figure 20C:
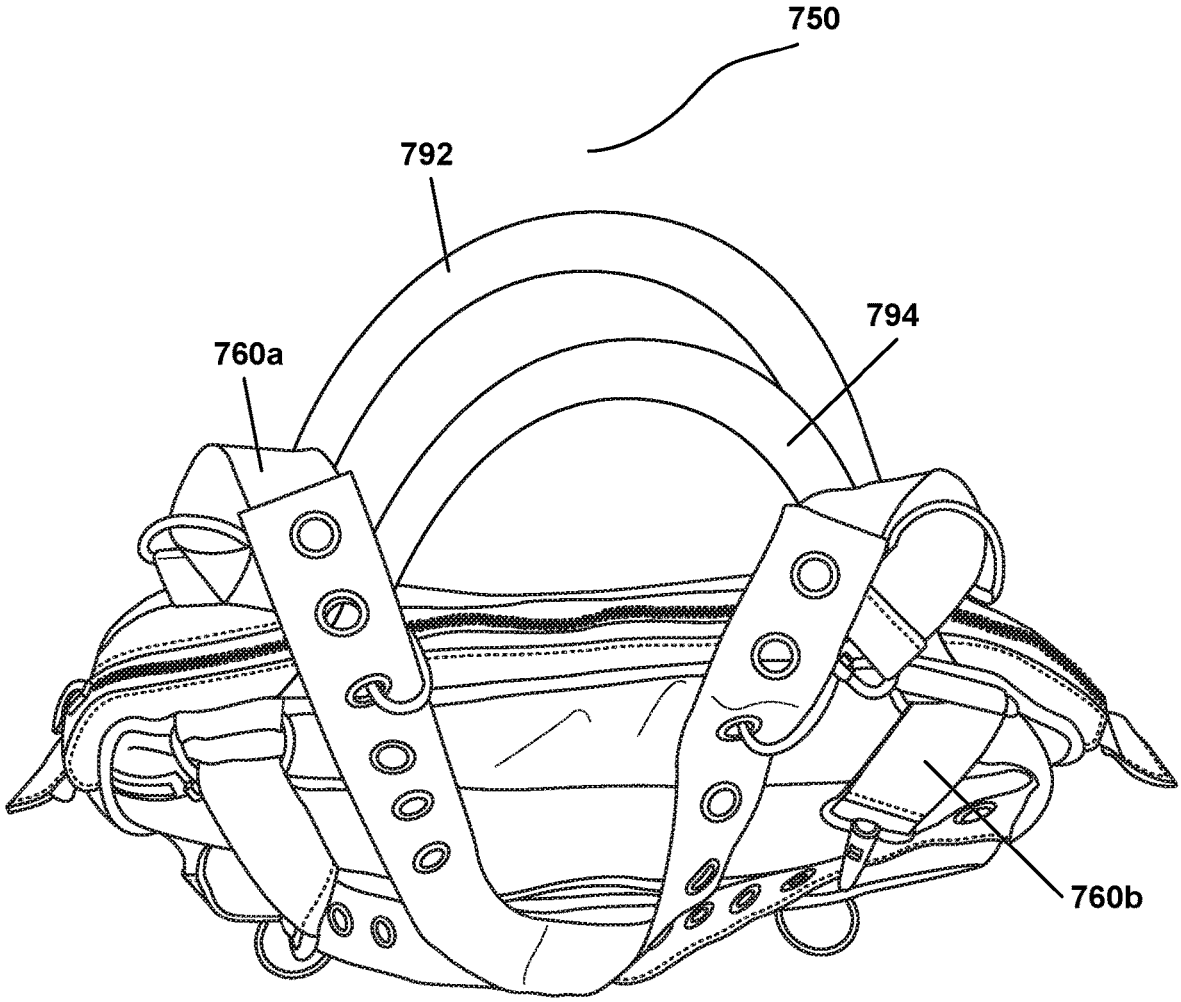

FIGS. 20 and 21 depict a bag 750. FIG. 20A depicts a bag 750 with two straps 760*a* and 760*b* (collectively, straps 760), both detachable at both ends, attached to loops 770*a*, 770*b*, 770*c*, and 770*d* (collectively, loops 770) at the top of the bag. There are four attachment loops 770 permanently attached at both ends of the sides at the top, opposite each other. There are two attachment loops 780*a* and 780*b* (collectively, loops 780), both permanently attached on the same side of the bag bottom. In addition, bag 750 can be worn as a bag by attaching one strap 760*a* handle in the same manner as in FIG. 18A, and storing the second strap 760*b* in the bag when not in use. FIG. 20B depicts the bag 750 with a strap 790 that is permanently attached to the body of the bag at both ends. This strap may be used with the straps 760 to carry the bag 750. In various embodiments, the strap 790 may be used in lieu of the straps 760 to carry the bag 750. FIG. 20C depicts the bag 750 with straps 792 and 794 that are permanently attached to the body of the bag at both ends. These straps may be used with the straps 760 to carry the bag 750. In various embodiments, the straps 792 and 794 may be used in lieu of the straps 760 to carry the bag 700.

Figure 21A:
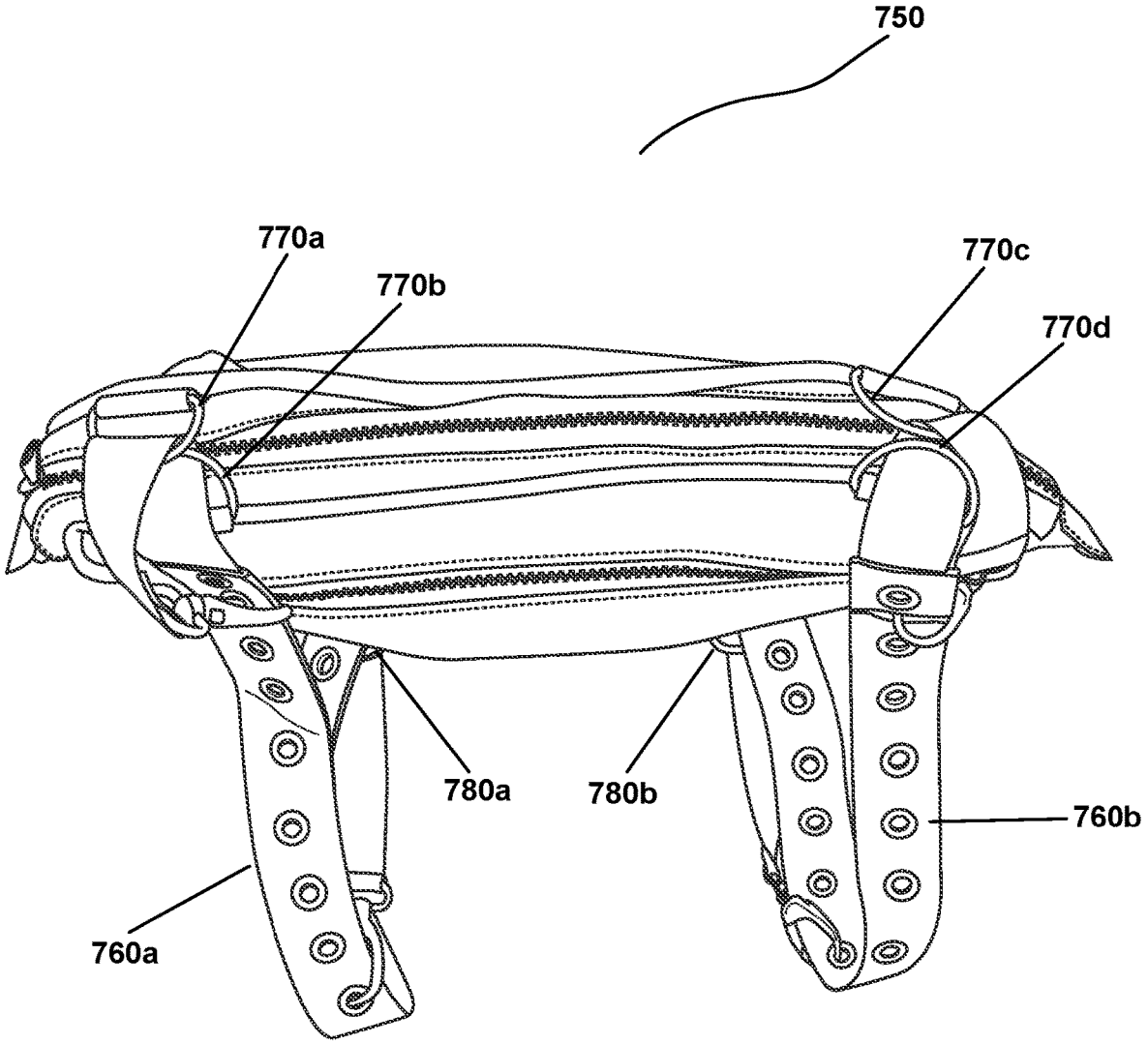
FIG. 21A depicts a second configuration of the bag of FIG. 20A according to an exemplary embodiment.
Figure 21B:
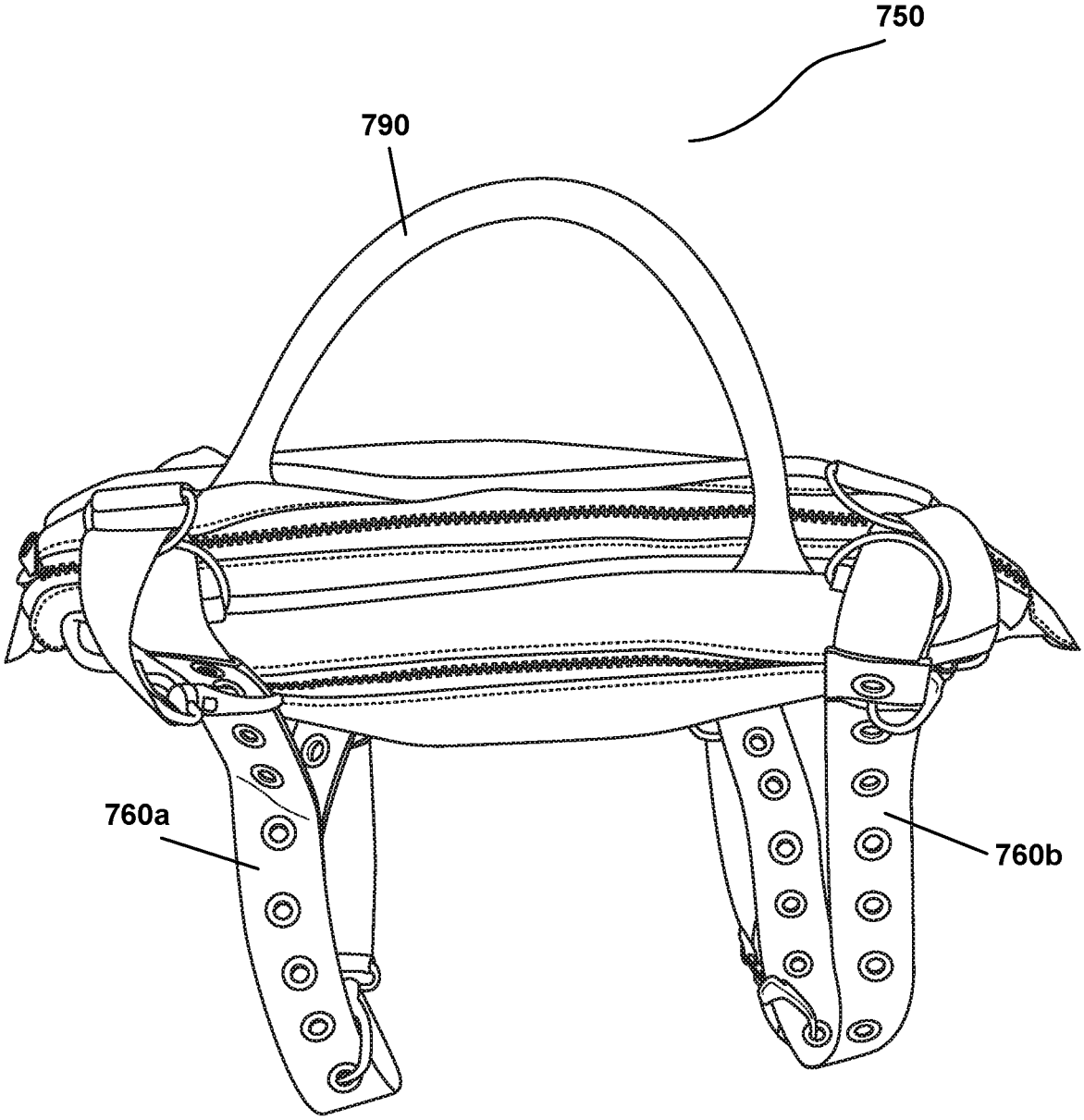
FIGS. 21B and 21C depict alternate strap configurations of the bag of FIG. 21A according to an exemplary embodiment.
Figure 21C:
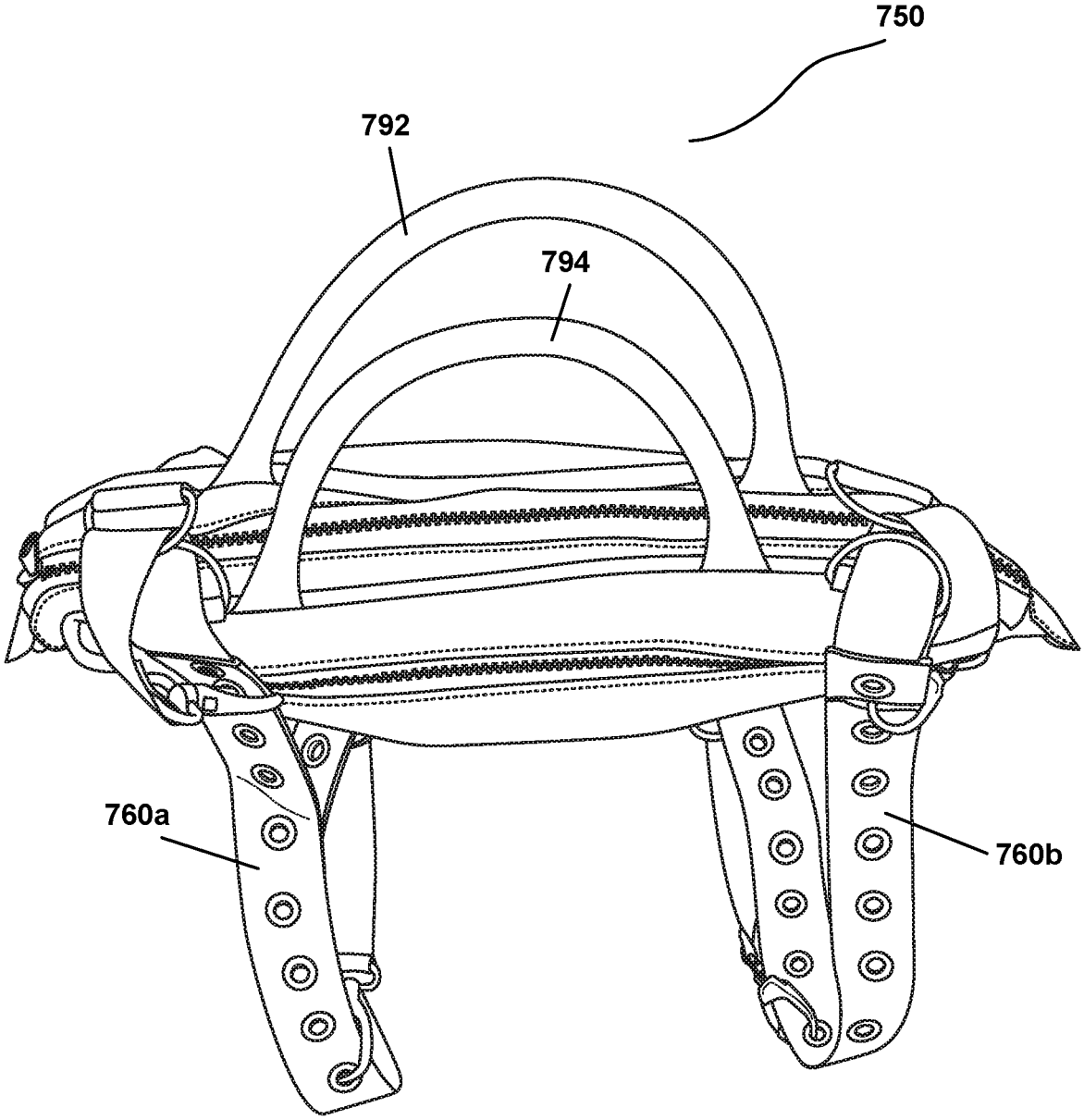

FIG. 21A depicts the bag 750 assembled as a backpack with two strap handles 760 attached to four loops 770 at the top and loops 780 at the bottom portion of the bag. Attachment loops 770 and 780 are large enough for the attachment mechanisms, as well as the body of strap 760, to thread through as well as the body of strap 760 and large enough to allow for strap rotation once threaded through. In various embodiments, all attachment points and all openings in the strap may be configured so that the strap free ends may be threaded through them and rotated once threaded through.

To convert the bag 750 from a handbag to a backpack, the first end of straps may be threaded through loops 770 at bag top (in same direction), and secured using the strap attachment mechanism. As shown in FIG. 21A, the strap may be threaded through both sets of loops on each side. Alternatively, the strap may be threaded through one set on each side (e.g., 770*b* and 770*d*, or 770*a* and 770*c*, or 770*a* and 770*d*, or 770*b* and 770*c*). The second end of the strap may be extended down the length of the bag, where the second end may be attached to, threaded through, and rotated through the loops 780 at the bag bottom, and the second end may be secured using the strap attachment mechanism. The length of the strap may be adjusted by securing the strap back on itself as shown in FIG. 21A. In various embodiments, the straps 760 may be left configured in the manner depicted in FIG. 21A and the bag 750 may be carried using the attached straps depicted in FIGS. 21B and 21C.

In some embodiments, the flexibility of this handle type allows for handles to be permanently attached at one end, or for one handle to be attached at one end and the other to be completely detachable.

Figure 22:
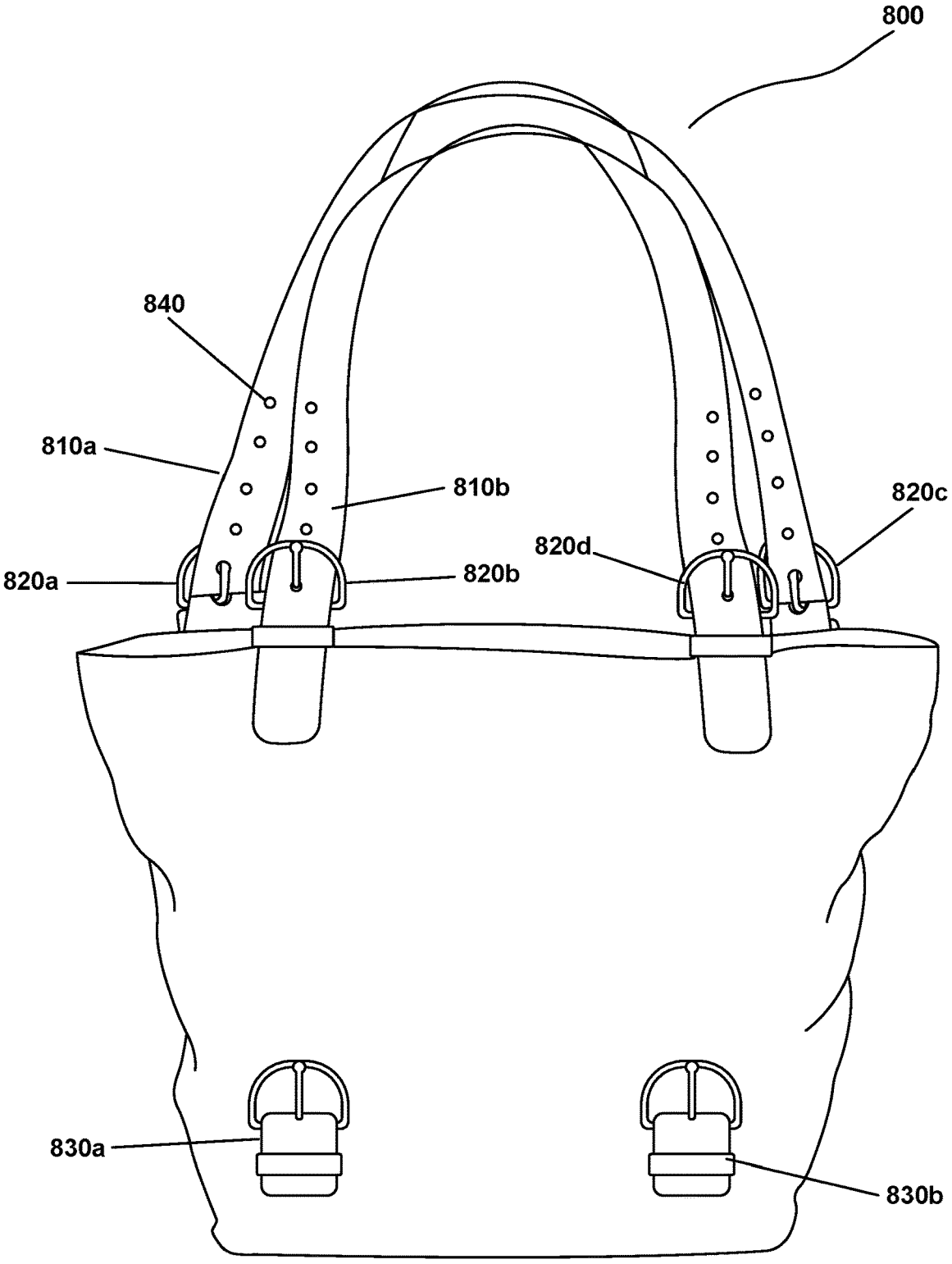
FIG. 22 depicts a bag according to an exemplary embodiment.
Figure 23:
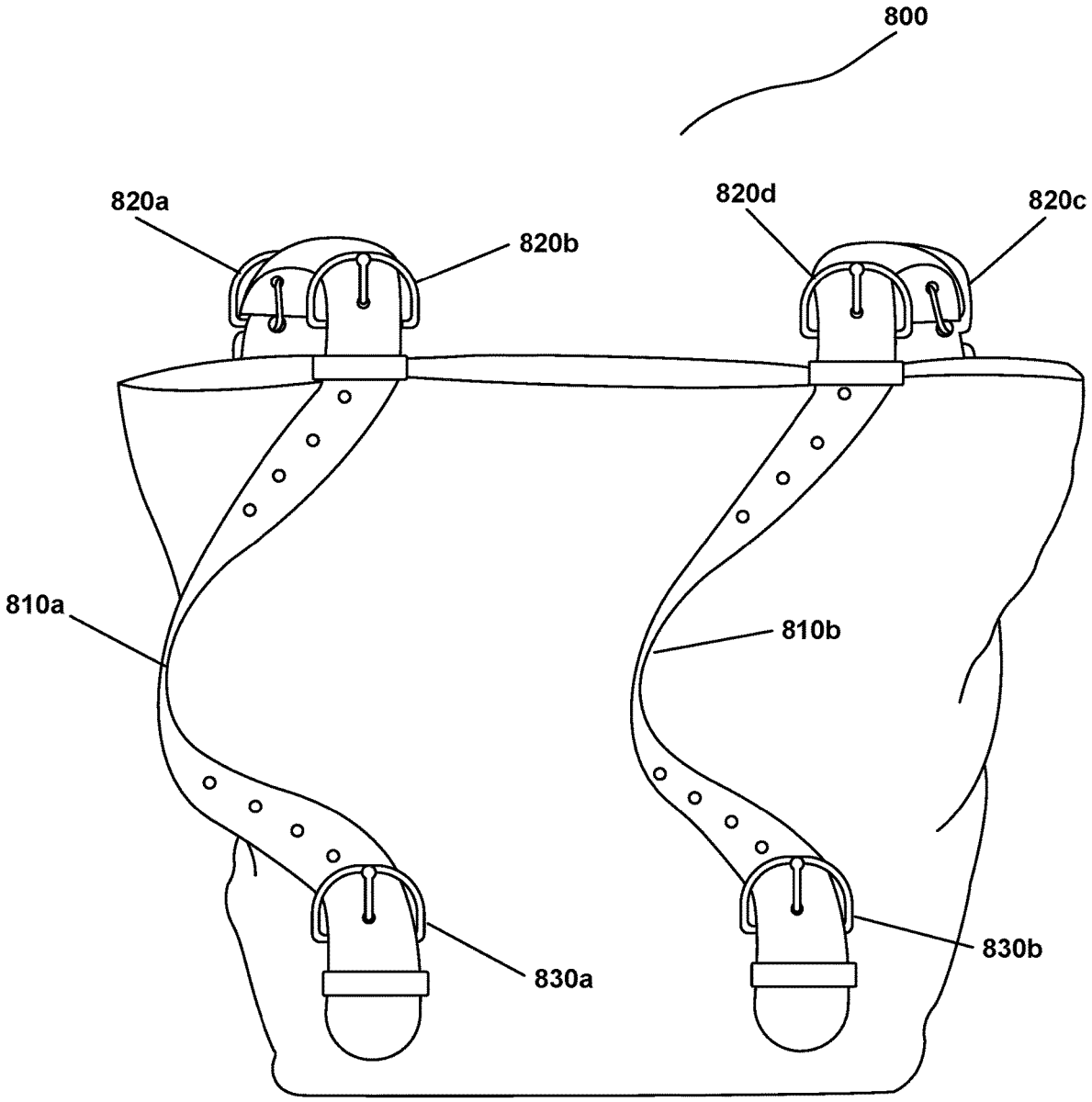
FIG. 23 depicts a second configuration of the bag of FIG. 22 according to an exemplary embodiment.

FIGS. 22 and 23 depict a bag 800. FIG. 22 depicts a bag 800 in a purse or handbag or shoulder bag configuration. FIG. 23 depicts the bag 800 in a backpack configuration.

FIGS. 22 and 23 depict a bag 800 with two straps 810*a* and 810*b* (collectively, straps 810). The bag 800 may have buckles 820*a*, 820*b*, 820*c*, and 820*d* (collectively, buckles 820) that serve as attachment points at the top portion of the bag. There may be four buckles 820 at the top portion of the bag. There may be two buckles 830*a* and 830*b* (collectively, buckles 830) at a lower portion of the bag. The straps 810 may each have holes 840 configured to mate with the buckles 820 and 830. In various embodiments, buckles 830 may be positioned towards, or at sides of bag bottom, and may be configured to shape the bag bottom. In various embodiments, the lower portion of the bag may include more than two buckles to allow for different position of attachment, or to allow for an additional buckle placed above the first buckle, both closed with a small strap that is then opened and repositioned so that the long top strap can be attached to make a backpack. In the figures, holes 840 are depicted as being located linearly along a central axis of the straps 810. In various embodiments, the holder 840 may be located in a zig-zag pattern along the central axis.

To wear the bag 800 as a backpack, each of the straps 810 are extended across the top of the bag and attached to the buckles 820 at the top of the alternate side of the bag. Each strap is then extended down a side of the bag and attached to the buckles 830 at the bag bottom. The strap length may be altered by moving the buckling point for the strap.

Figure 24:
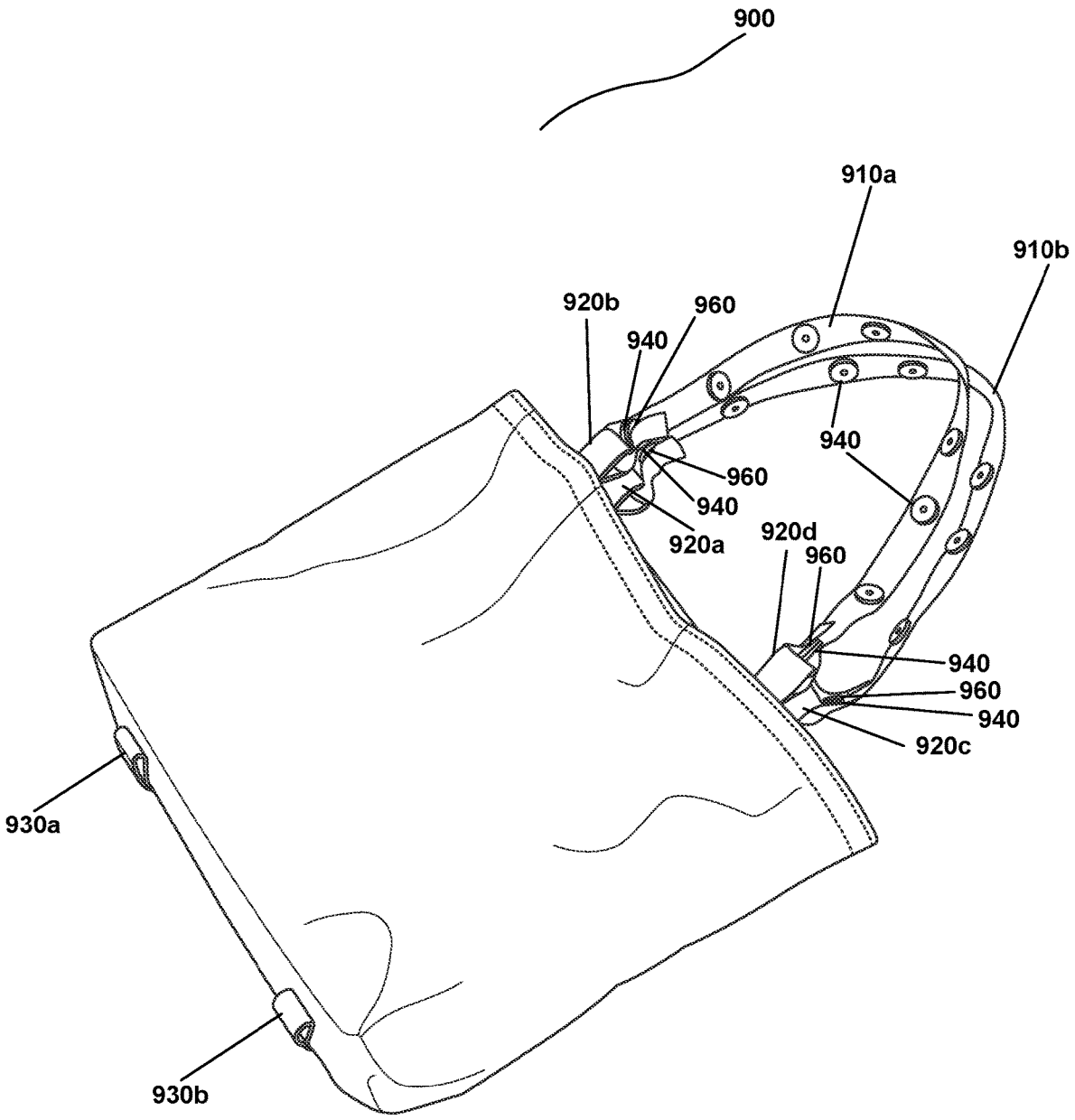
FIG. 24 depicts a bag according to an exemplary embodiment.
Figure 25:
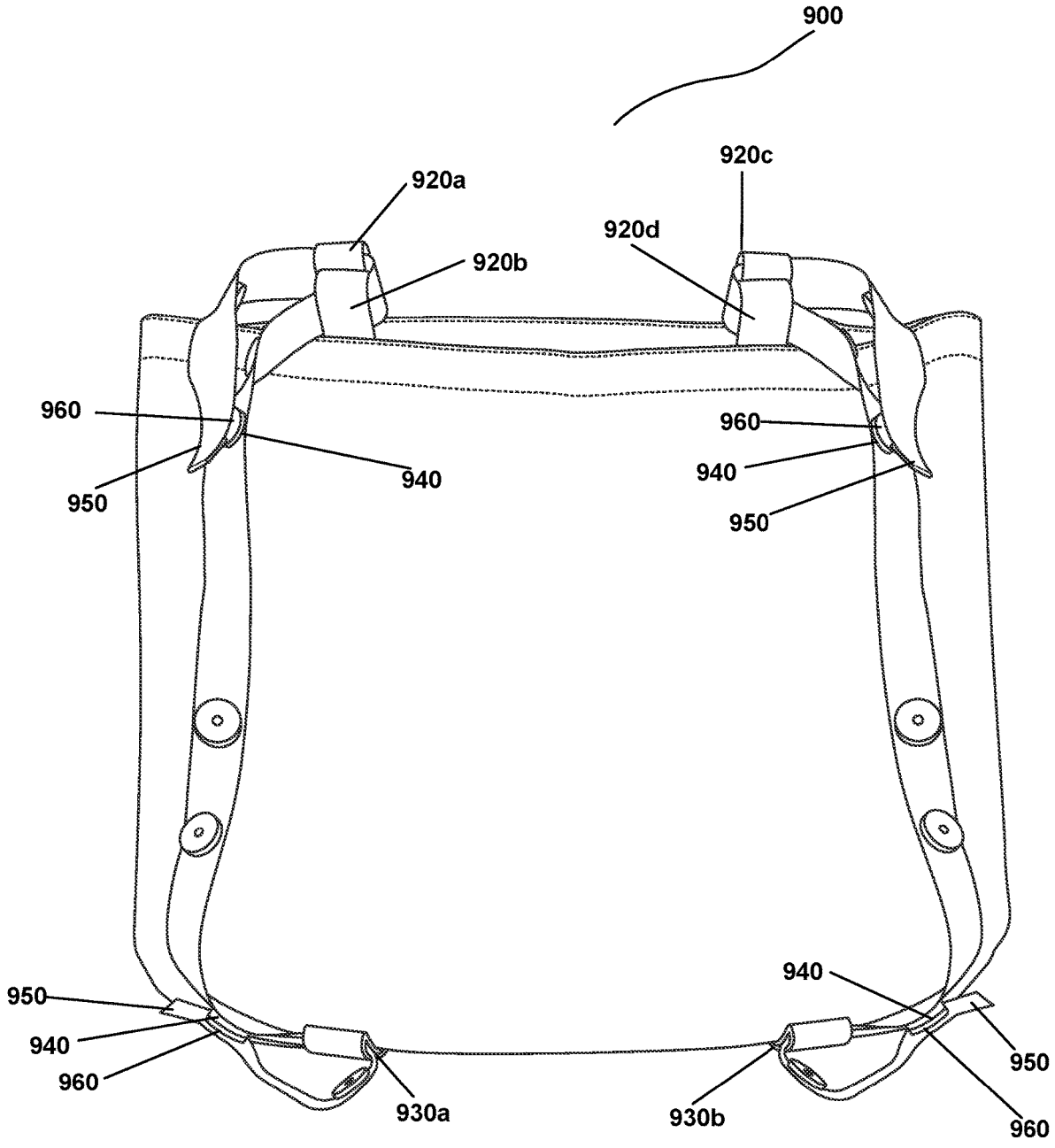
FIG. 25 depicts a second configuration of the bag of FIG. 24 according to an exemplary embodiment.

FIGS. 24 and 25 depict a bag 900 with two straps 910*a* and 910*b* (collectively, straps 910). The bag 900 may have four loops 920*a*, 920*b*, 920*c*, and 920*d* (collectively, loops 920) attached to an upper lip of the open top portion of the bag. The bag 900 may have two loops 930*a* and 930*b* (collectively, loops 930) at a bottom portion. Attachment loops are large enough for the strap handles with snaps to thread through and to rotate once threaded through. The bag 900 may have a closed top.

The two straps 910 may be detachable at both ends and may have snaps 940 along its length. The snaps may be secured along length of both straps to provide adjustable length of each strap. The free end of each strap 950 may have a snap 960 that is configured to mate with any of the snaps 940.

The bag 900 can be carried in the hand, worn as a shoulder bag, a crossbody bag, and a backpack. FIG. 24 depicts the bag 900 in a tote configuration. FIG. 25 depicts the bag 900 in a backpack configuration.

To convert the bag 900 from a tote to a backpack, the first end of straps may be threaded through and rotated through loops at bag top (in same direction), snap first end 950 using snap mate 960 to snap 940 on handle to secure handle. As depicted in FIG. 25, the strap 910 may be threaded through each of the two loops on the same side of the bag (e.g., loops 920*a* and 920*b*; loops 920*c* and 920*d*). The second end of the strap may be extended down the side of the bag, the second end may be threaded through the loop at the bag bottom (930), and the snap mate 960 on the second end may be snapped to desired snap on the handle. The length of the strap may be adjustable by snapping the snap mate at the end of each strap handle to a snap along the handle that will be on the other side from the snap mate after it is threaded through, and optionally rotated, through each loop. In various embodiments, the snaps may be replaced with magnets.

FIGS. 26-29 depict a bag 1000 with two straps 1010*a* and 1010*b* (collectively, straps 1010). The bag 1000 may have four loops 1020*a*, 1020*b*, 1020*c*, and 1020*d* (collectively, loops 1020) attached to an upper lip of the open top portion of the bag. The bag 1000 may have two loops 1030*a* and 1030*b* (collectively, loops 1030) at a bottom portion. The attachment loops may be large enough for the strap handles with snaps to thread through and to rotate once threaded through. Two snap mates 1060*a* and 1060*b* can be permanently attached to the inner side of the two loops 1020*b* and 1020*d* attached to an upper lip of the top portion of the bag on the same bag side as the two lower loops 1030. The bag 1000 may have a closed top.

The two straps 1010 may be detachable at one end 1040*a*, 1040*d*, each having snap mates 1060*c* and 1060*d*, and permanently attached at the second end 1040*b*, 1040*c* to one of the tops loops at the top of the bag (e.g., loops 1020*b*, 1020*c*), and may have snaps 1050 along its length. The snaps can be secured along length of both straps using snap mates 1060*c* and 1060*d*, and provide adjustable length. In various embodiments, the straps 1010 may be detachable at both ends. In various embodiments, other attachment mechanisms may be used in place of the snaps. For example, magnets, "knobs and keyholes," or buttons and buttonholes may be used as attachment mechanisms in place, or in addition to the snaps. Different attachment mechanisms, and combinations of mechanisms, allow for flexibility of attachment.

Figure 26:
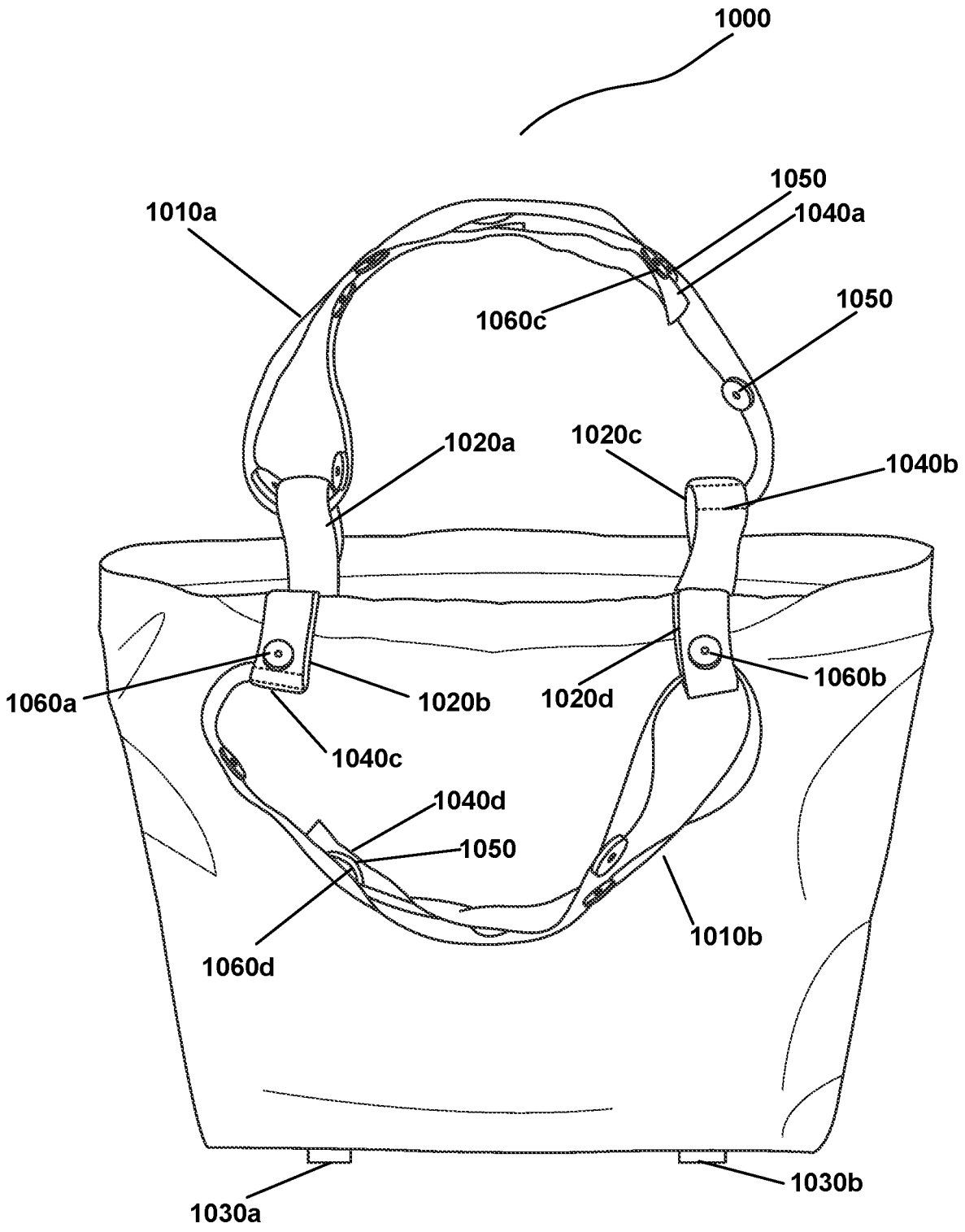
FIG. 26 depicts a bag according to an exemplary embodiment.
Figure 27:
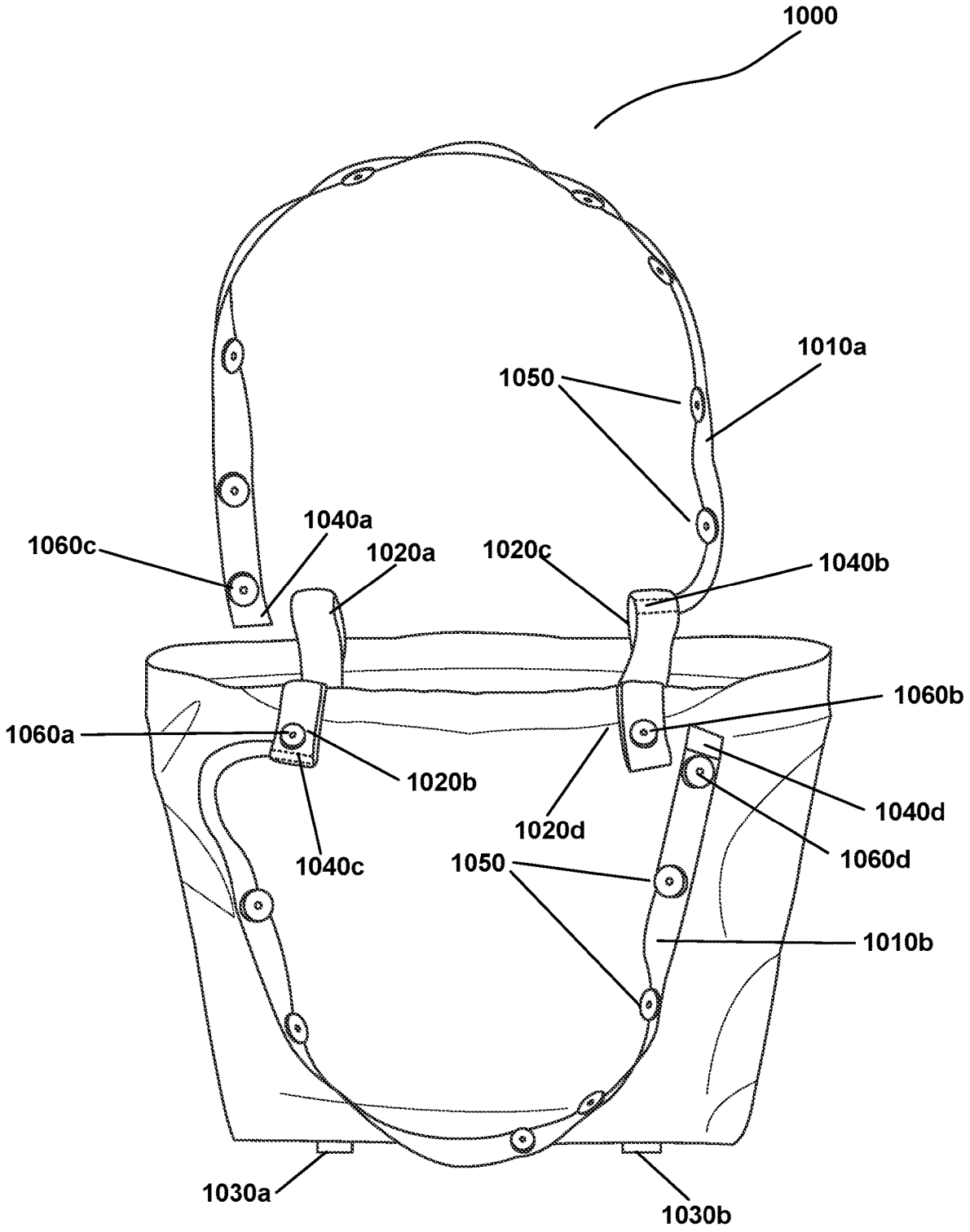
FIG. 27 depicts a second view of the bag of FIG. 26 according to an exemplary embodiment.
Figure 28:
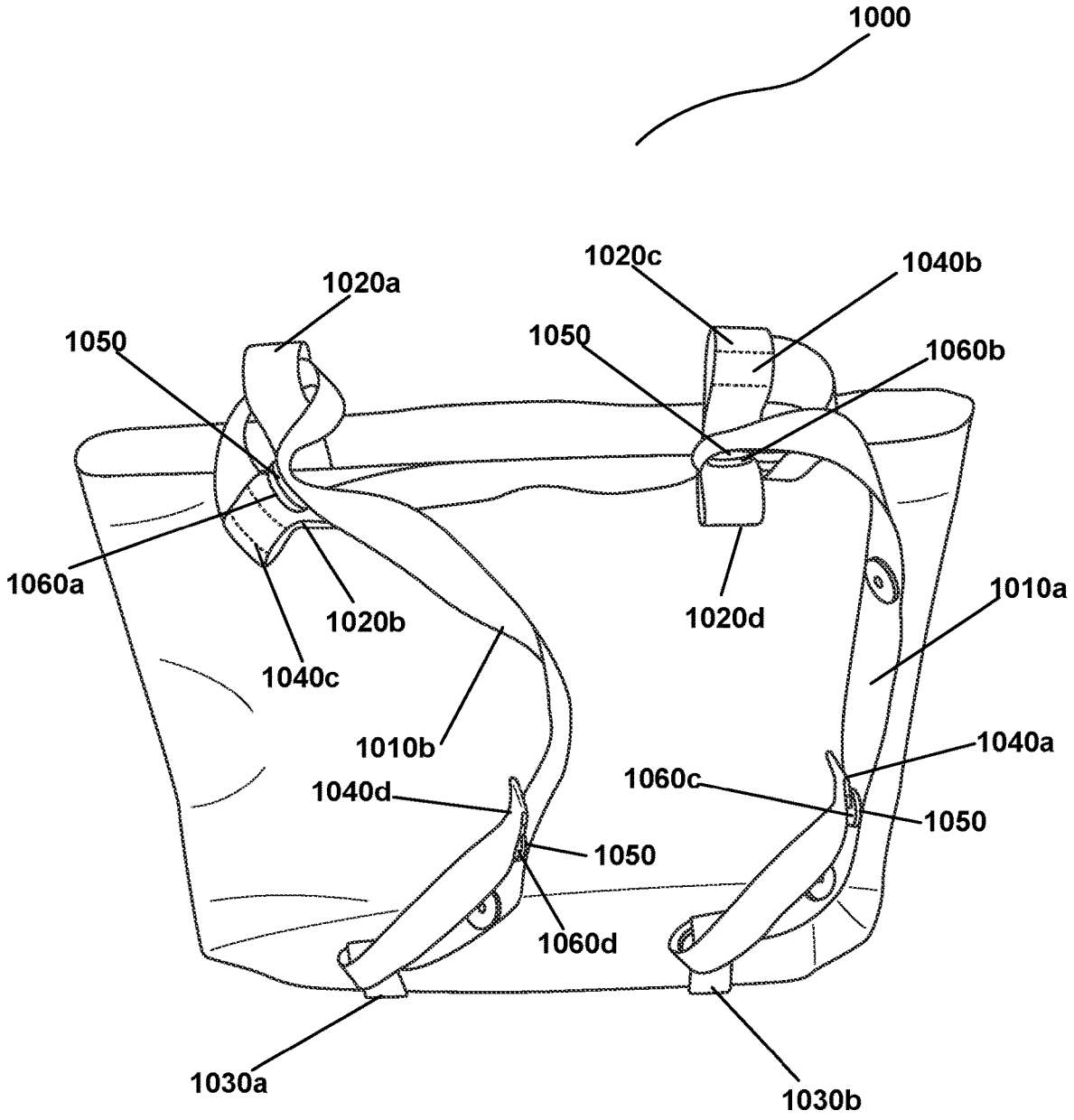
FIG. 28 depicts a second configuration of the bag of FIG. 26 according to an exemplary embodiment.
Figure 29:
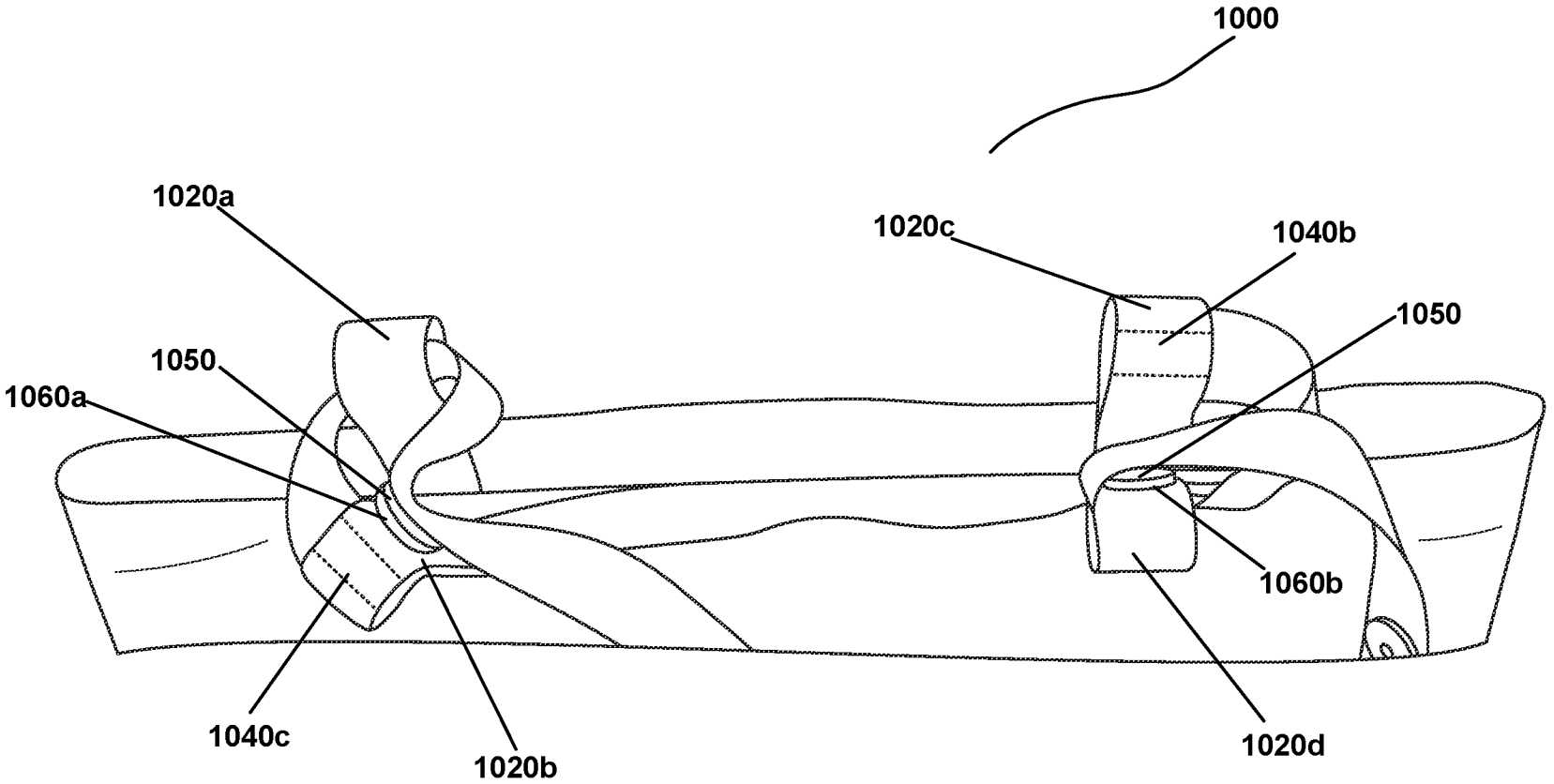
FIG. 29 depicts second view of the bag of FIG. 28 in a second configuration according to an exemplary embodiment.

The bag 1000 can be carried in the hand, worn as a shoulder bag, a crossbody bag, and a backpack. FIG. 26 depict the bag 1000 in a tote configuration. FIG. 27 depicts the bag 1000 with the detachable end of each strap separated from the bag to show its detail. FIG. 28 depicts the bag 1000 in a backpack configuration. FIG. 29 depicts a top view of bag 1000 in the backpack configuration.

To convert the bag 1000 from a tote to a backpack, the detachable end (1040*d*) of first strap (1010*b*) may be threaded through and rotated through the loop (1020*a*) at bag top at opposite side of the bag, extended back and snapped to a snap mate (1060*a*) on inside of the loop (1020*b*) to secure handle. The detachable end (1040*d*) of first strap (1010*b*) may be extended down the side of the bag, the detachable end may be threaded through the loop (1030*a*) at the bag bottom, and snap mate (1060*d*) secured to detachable end (1040*d*) may be snapped to snap (1050) on handle (1010*b*). The detachable end (1040*a*) of the second strap (1010*a*) may be threaded across the bag top, threaded through and rotated through loop (1020*d*) at bag top at opposite side of the bag, and may be snapped to snap mate (1060*b*) on inside of loop (1020*d*) to secure handle. The detachable end (1040*a*) of second strap handle (1010*a*) may be extended down the side of the bag, the detachable end of second strap handle—may be threaded through and rotated through loop (1030*b*) at the bag bottom, and snap mate (1060*c*) secured to detachable end (1040*a*) may be snapped to snap (1050) on handle (1010*a*).

The length of strap handle 1010 may be adjustable by snapping snap mate (1060*c*, 1060*d*) to snap (1050) of choice permanently attached along the strap handle. In various embodiments, the snaps 1050 and 1060 may be replaced with magnets.

In various embodiments, such as those of FIGS. 24 and 25 (although, as appreciated, the other various embodiments described above may be modified in this manner), the straps could be modified such that the straps are attached by knots instead of the various attachment mechanisms. That is, the strap free end could be tied in a knot which secures the strap end. For example, the strap free end could have loose strips or fringes which may be tied around the attachment mechanism or the strap free end may be threaded through the attachment point and tied around or to the body of the strap. The strap may be shortened in this manner. To support this, the body of the strap may have loops or other attachment points to which the free end may be tied. In some embodiments, one or more of the strap free ends may be knotted in a non-removable manner, securing that end of the strap.

In the various embodiments that have multiple straps, it should be appreciated that only one of the straps may be needed to carry the bag. The other, unused straps may be draped over the side of the bag or otherwise positioned by the user. Additionally, as described above, the various embodiments described above may be modified to have additional straps and/or additional attachment points to support these additional straps. For example, in the various embodiments that have two straps, one or more additional straps may be added. The existing attachment points may support these additional straps. That is, the attachment points may be configured to allow attachment and threading and rotation of multiple straps in each attachment point. The ends of these additional straps may be non-removably attached as described above. In some embodiments, these additional straps may be decorative in nature as the bag may be used with only one or two straps. The additional straps may then be positioned by the user, such as being draped over the side of the bag (when used in a handbag configuration). However, it should be appreciated that the additional straps may be used to carry the bag. For example, if two additional straps are added, the bag can then be used with double handles or straps (in either the handbag or backpack configuration).

In various embodiments, there may be a covering that slides up and down each chain handle. The covering may be referred to as a sleeve. This covering may be non-removable. The covering may be made of any suitable material, such as, for example, leather, fabric, plastic, etc. In other embodiments, the covering may be removed and may be attached over the strap, such as the upper portion or the lower portion on one end or both ends. The covering may have a suitable closure and securing mechanism such as, for example, snaps or velcro. In various embodiments, the covering may be padded.

Figure 30:
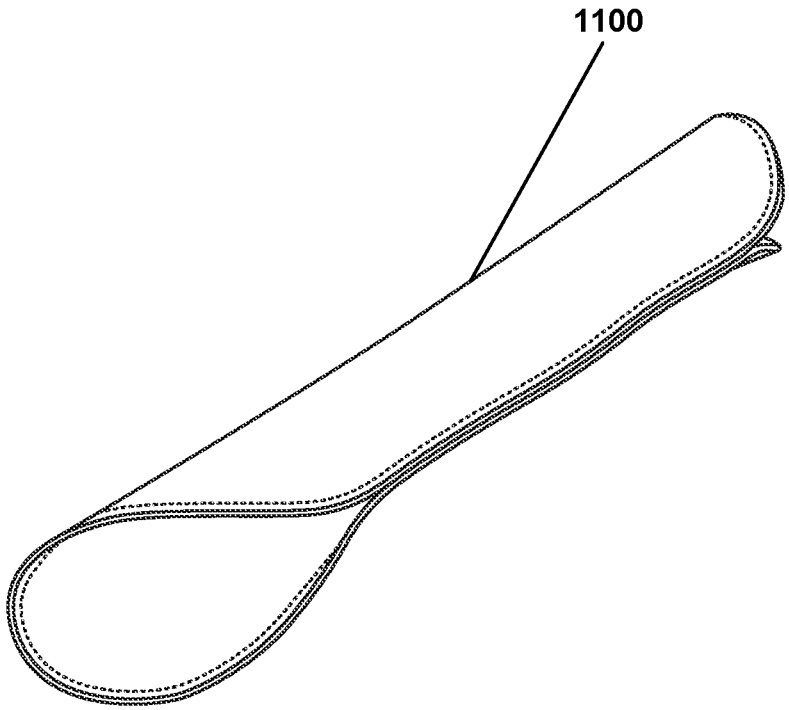
FIG. 30 depicts a sleeve for a bag strap according to an exemplary embodiment.
Figure 31:
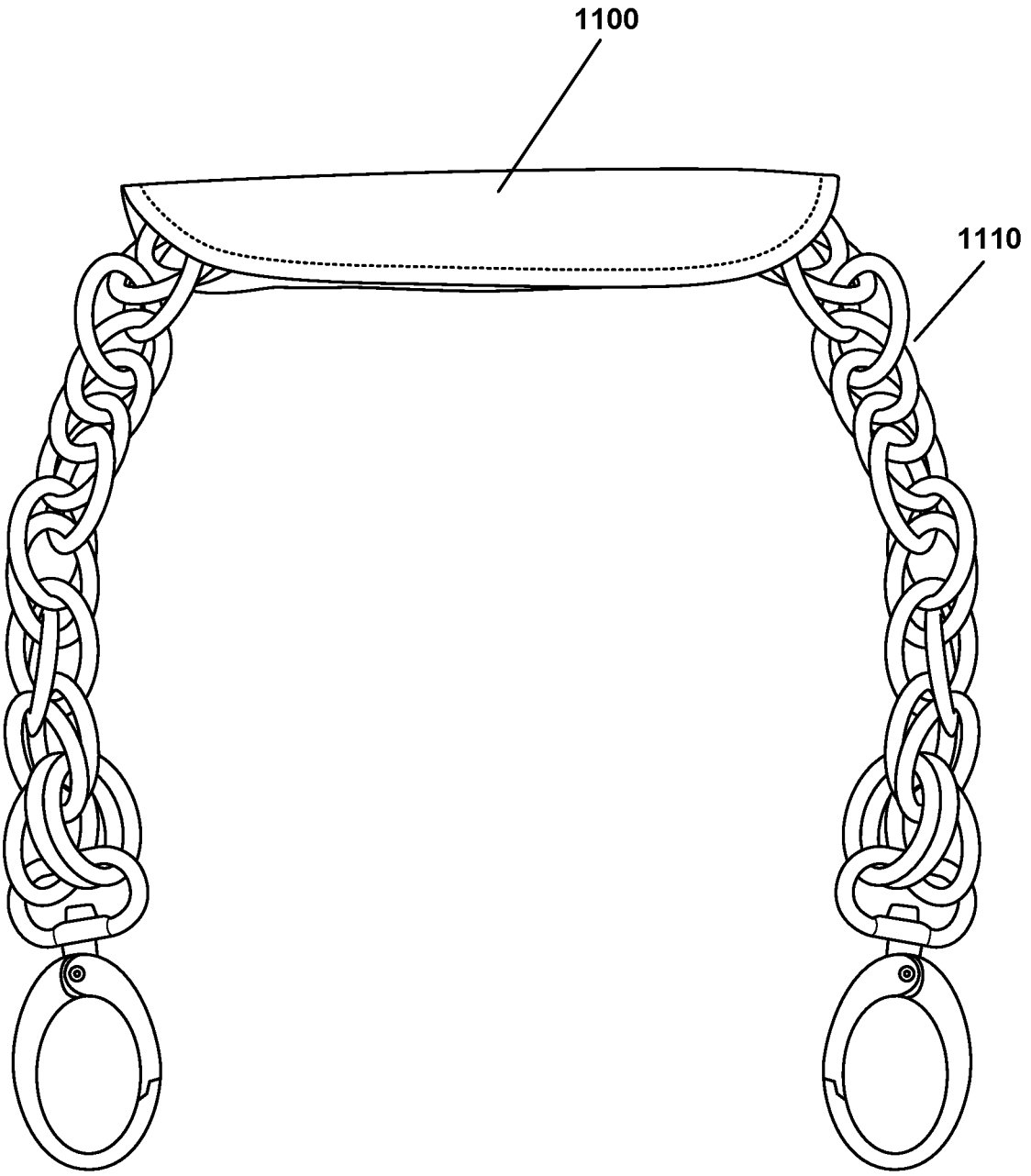
FIG. 31 depicts the sleeve of FIG. 30 on a bag strap according to an exemplary embodiment.
Figure 32:
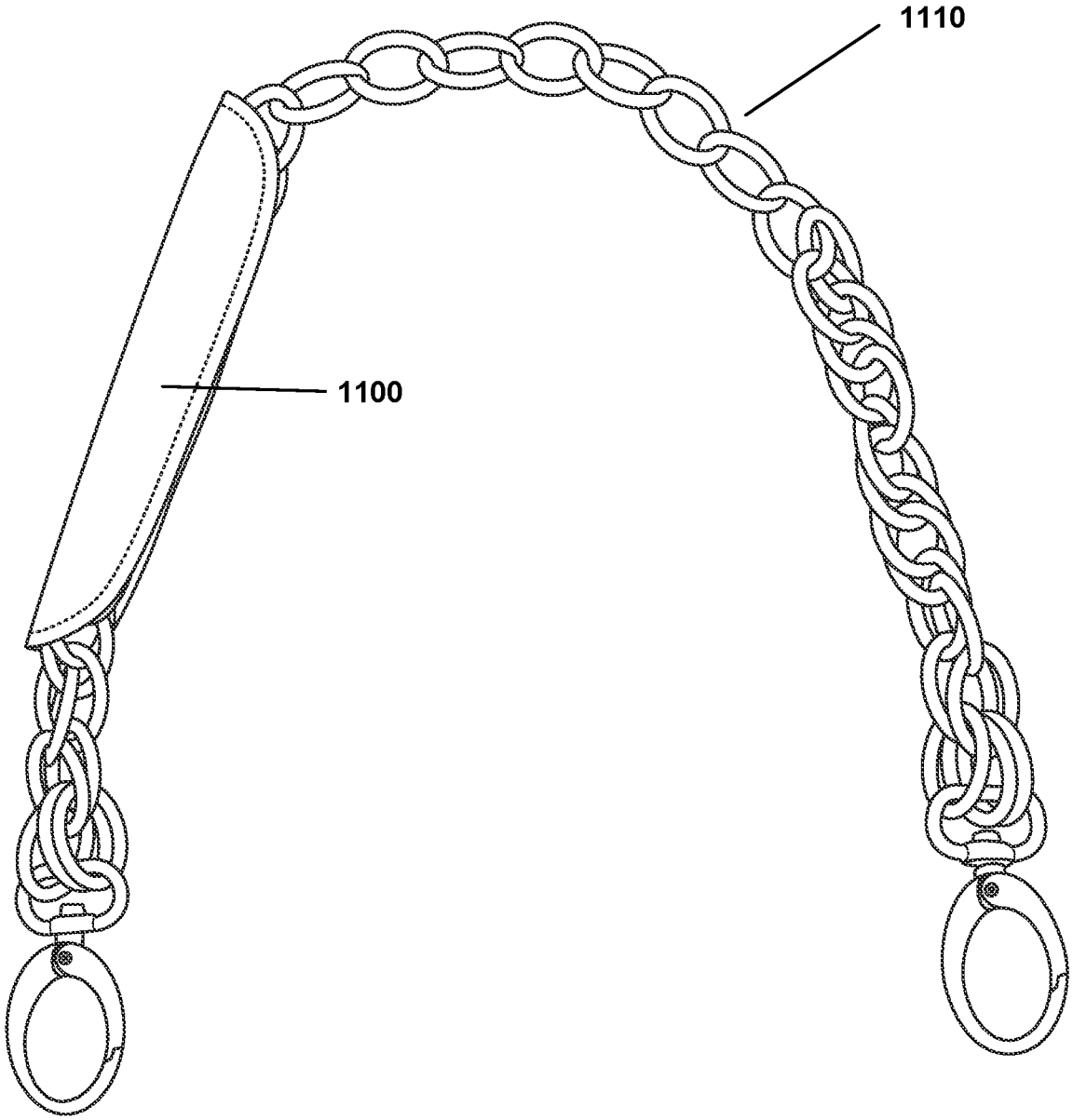
FIG. 32 depicts the sleeve of FIG. 30 on a bag strap according to an exemplary embodiment.

FIG. 30 depicts an exemplary covering 1100 made of leather. FIGS. 31 and 32 depict this covering 1100 on a chain strap 1110, such as that shown in the figures described above. This covering may be non-removable. In various embodiments, the covering 1100 may be padded.

Figure 33:
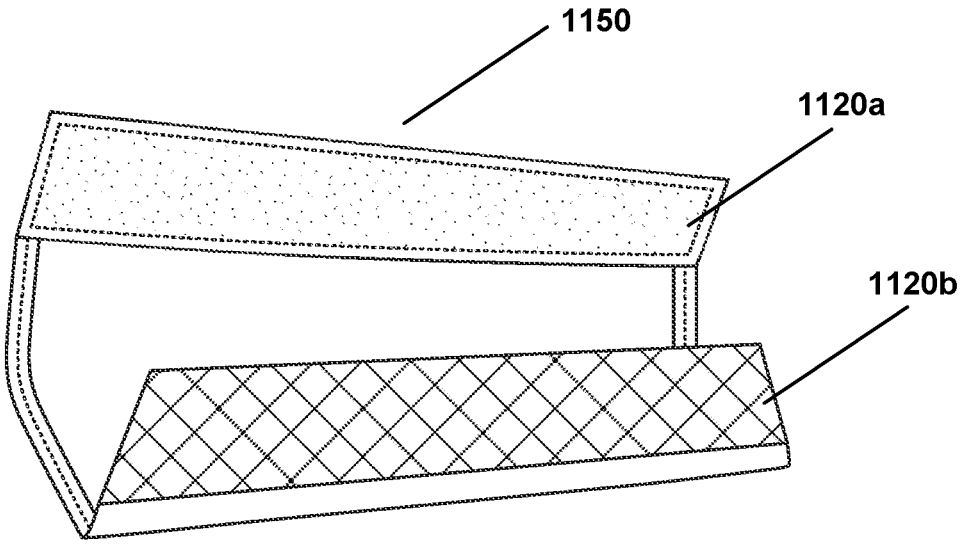
FIG. 33 depicts a sleeve for a bag strap according to an exemplary embodiment.
Figure 34:
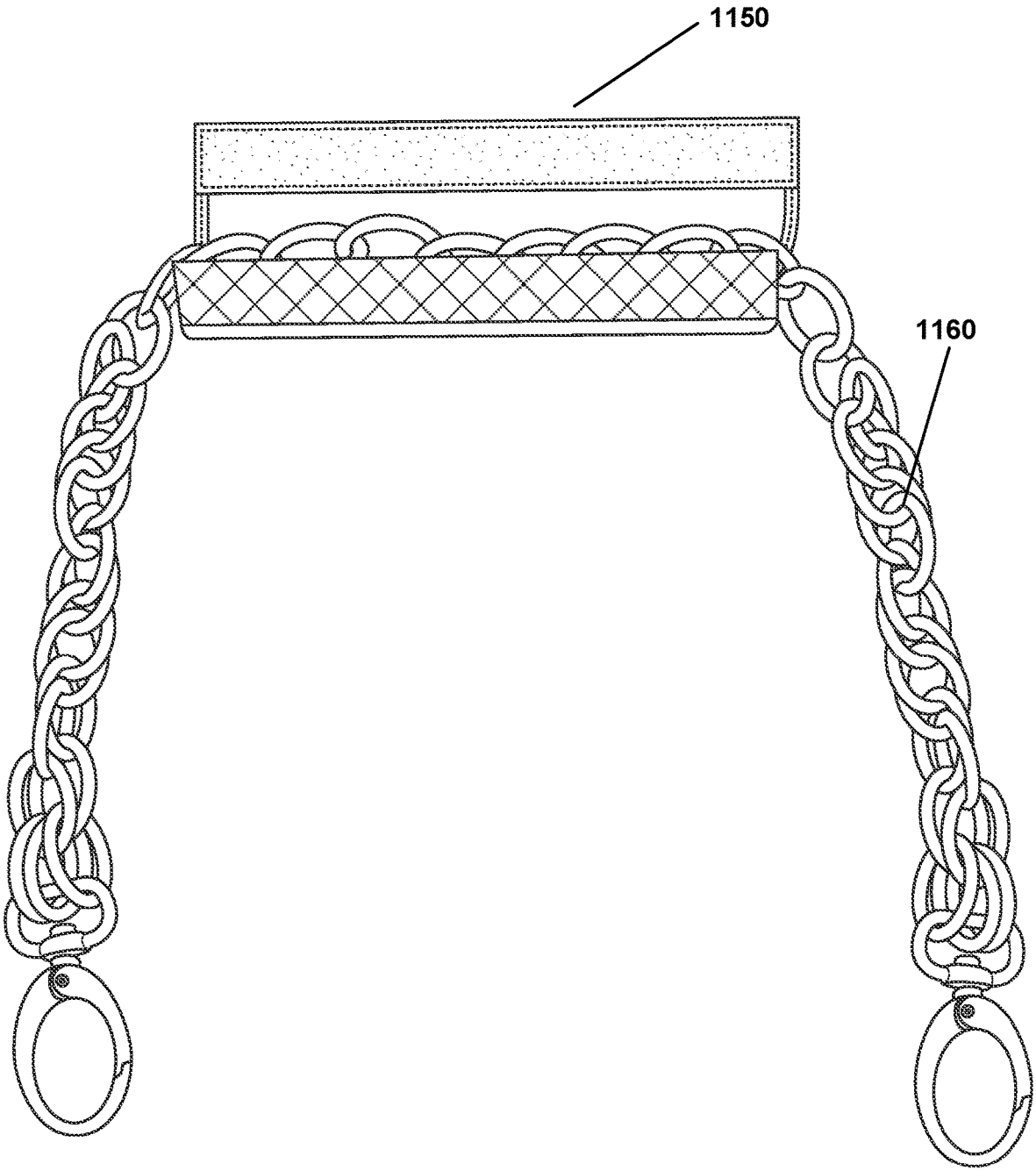
FIG. 34 depicts the sleeve of FIG. 33 on a bag strap according to an exemplary embodiment.
Figure 35:
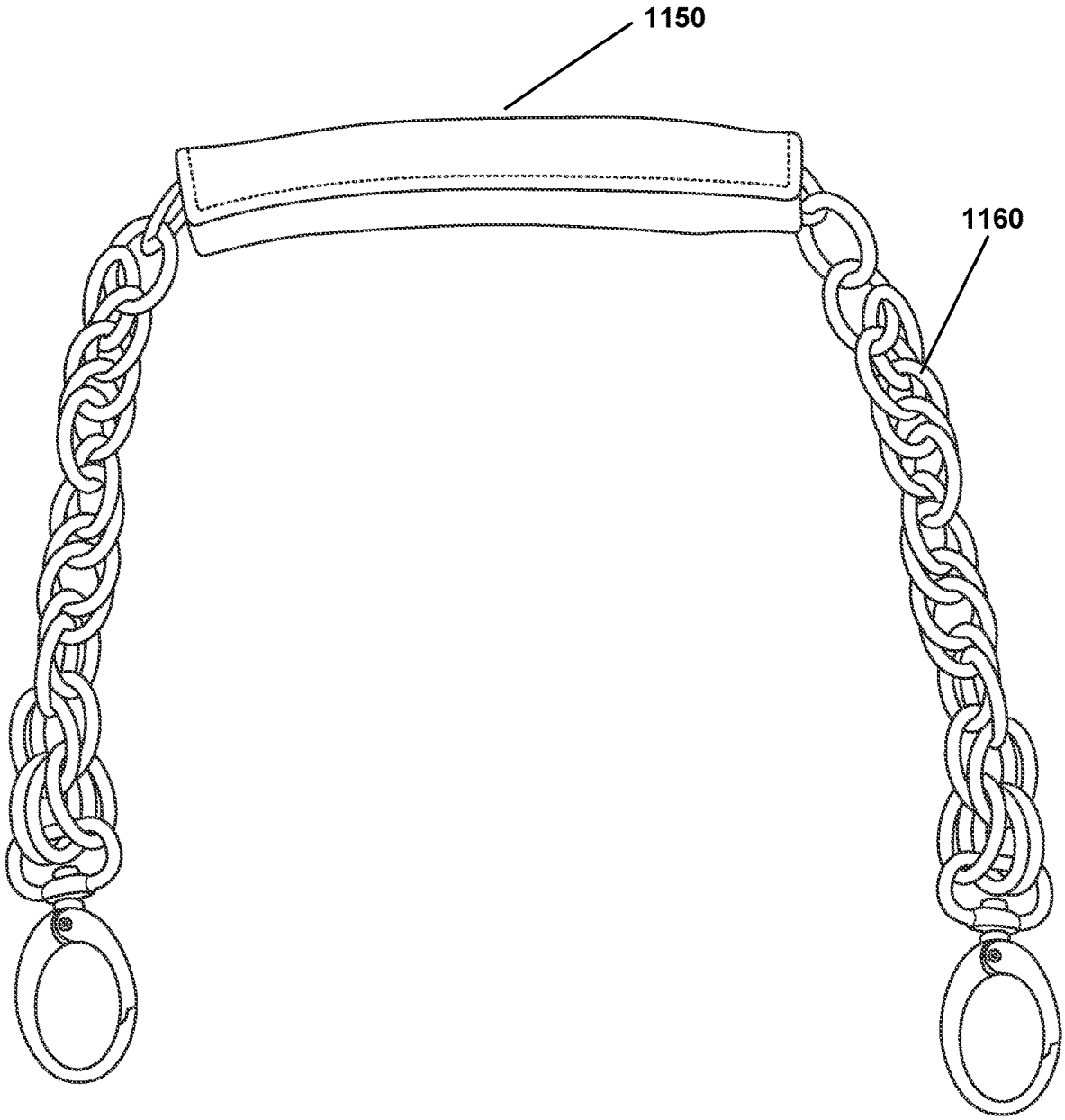
FIG. 35 depicts the sleeve of FIG. 33 on a bag strap according to an exemplary embodiment.

FIG. 33 depicts an exemplary removable covering 1150 made of fabric. The covering 1150 has a velcro closure 1120*a* and 1120*b* (collectively, closure 1120). FIGS. 34 and 35 depict the removable covering 1150 on a chain strap 1160 in both the open and closed position, respectively. In various embodiments, the removable covering 1150 may be padded.

Figure 36:
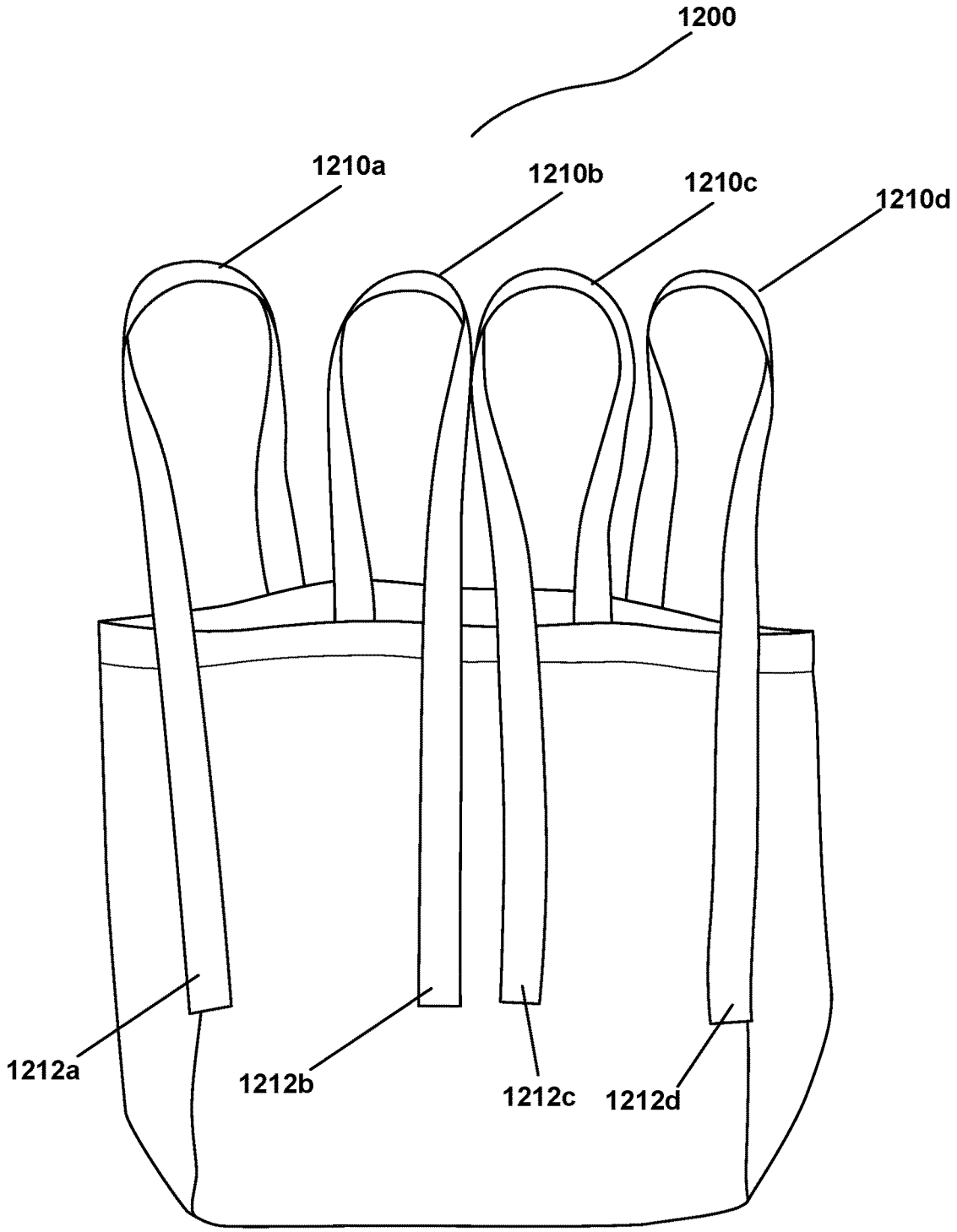
FIG. 36 depicts a bag according to an exemplary embodiment.
Figure 37:
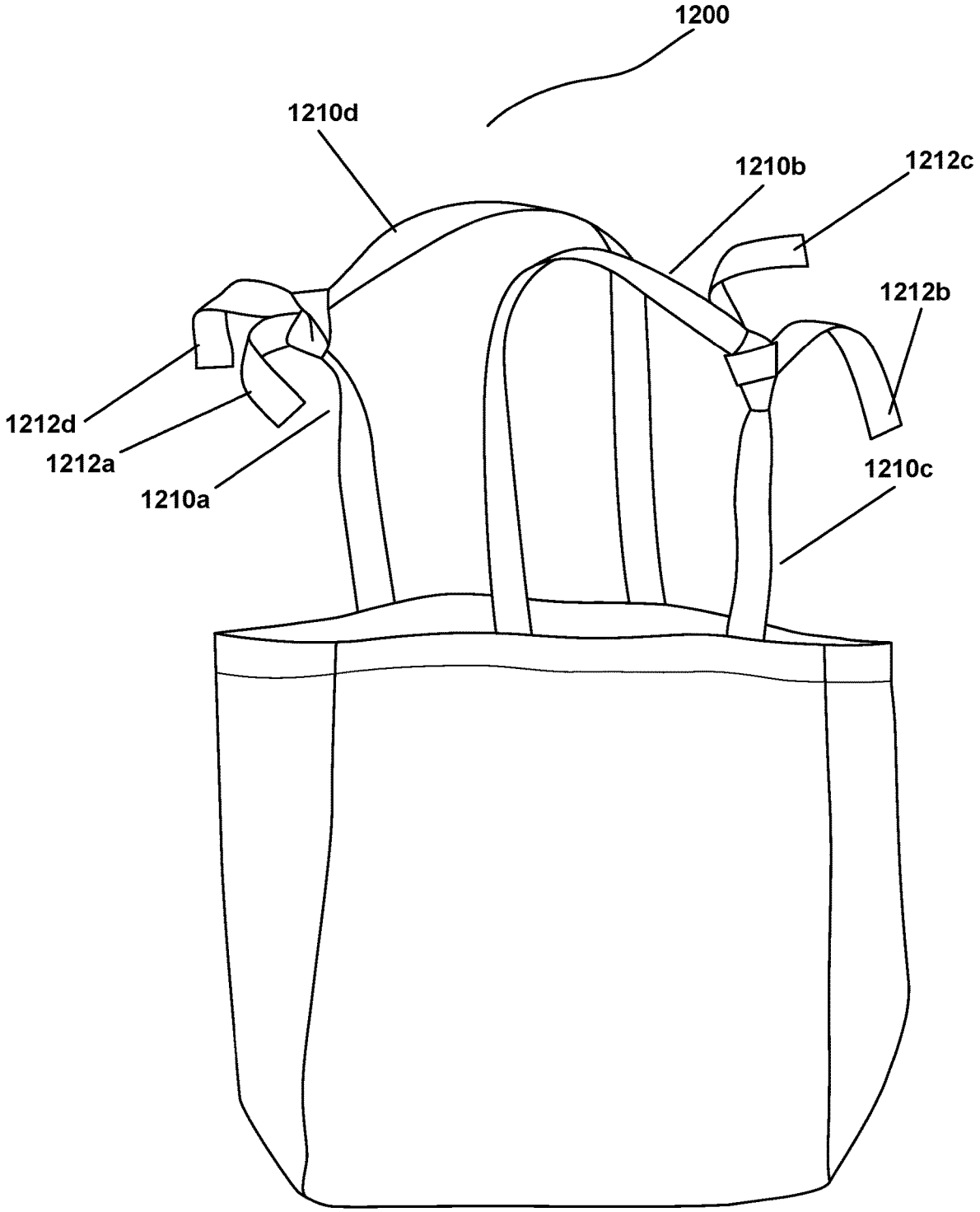
FIG. 37 depicts a first configuration of the bag of FIG. 36 according to an exemplary embodiment.
Figure 38:
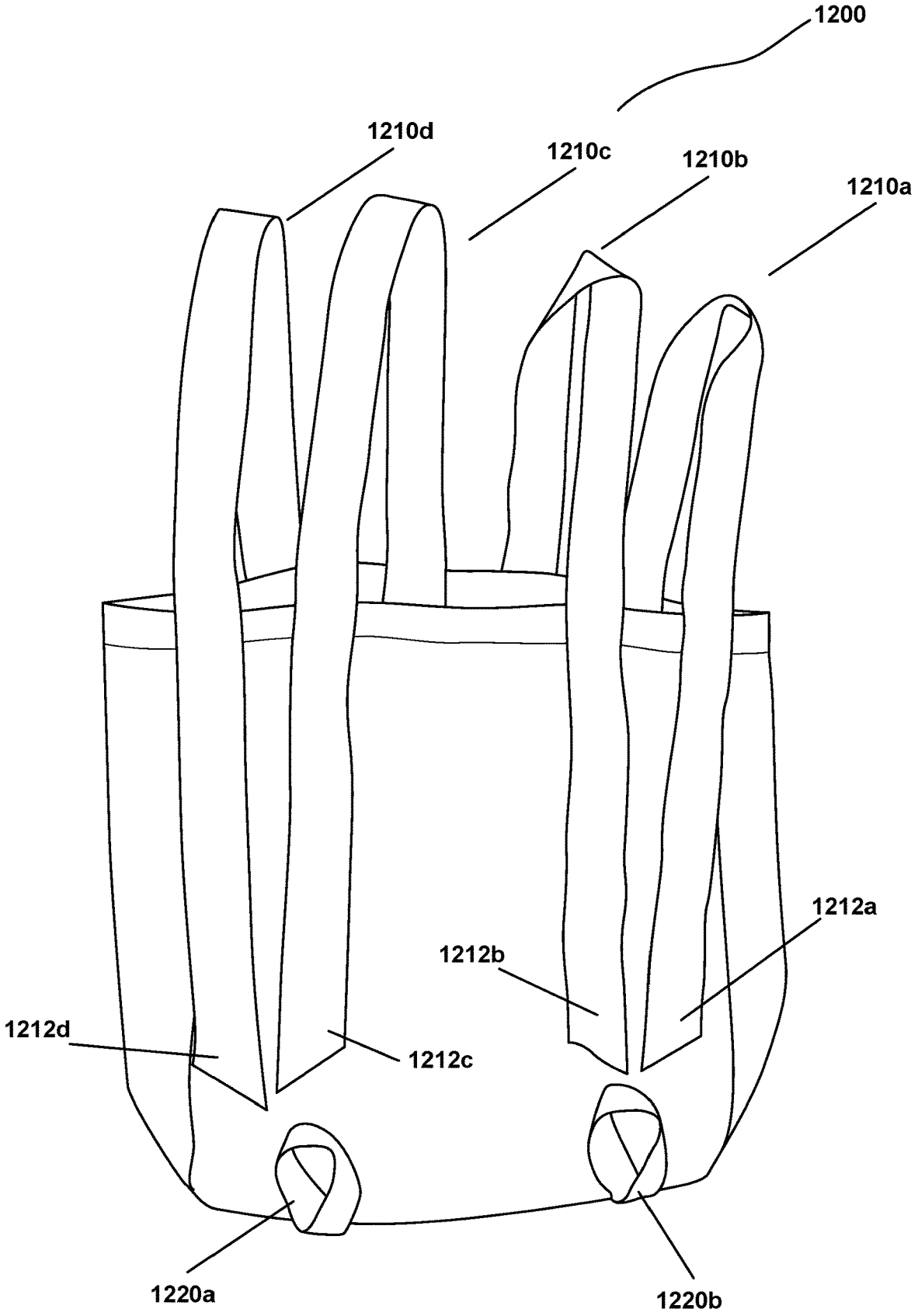
FIG. 38 depicts an unassembled view of a second configuration of the bag of FIG. 36 according to an exemplary embodiment.
Figure 39:
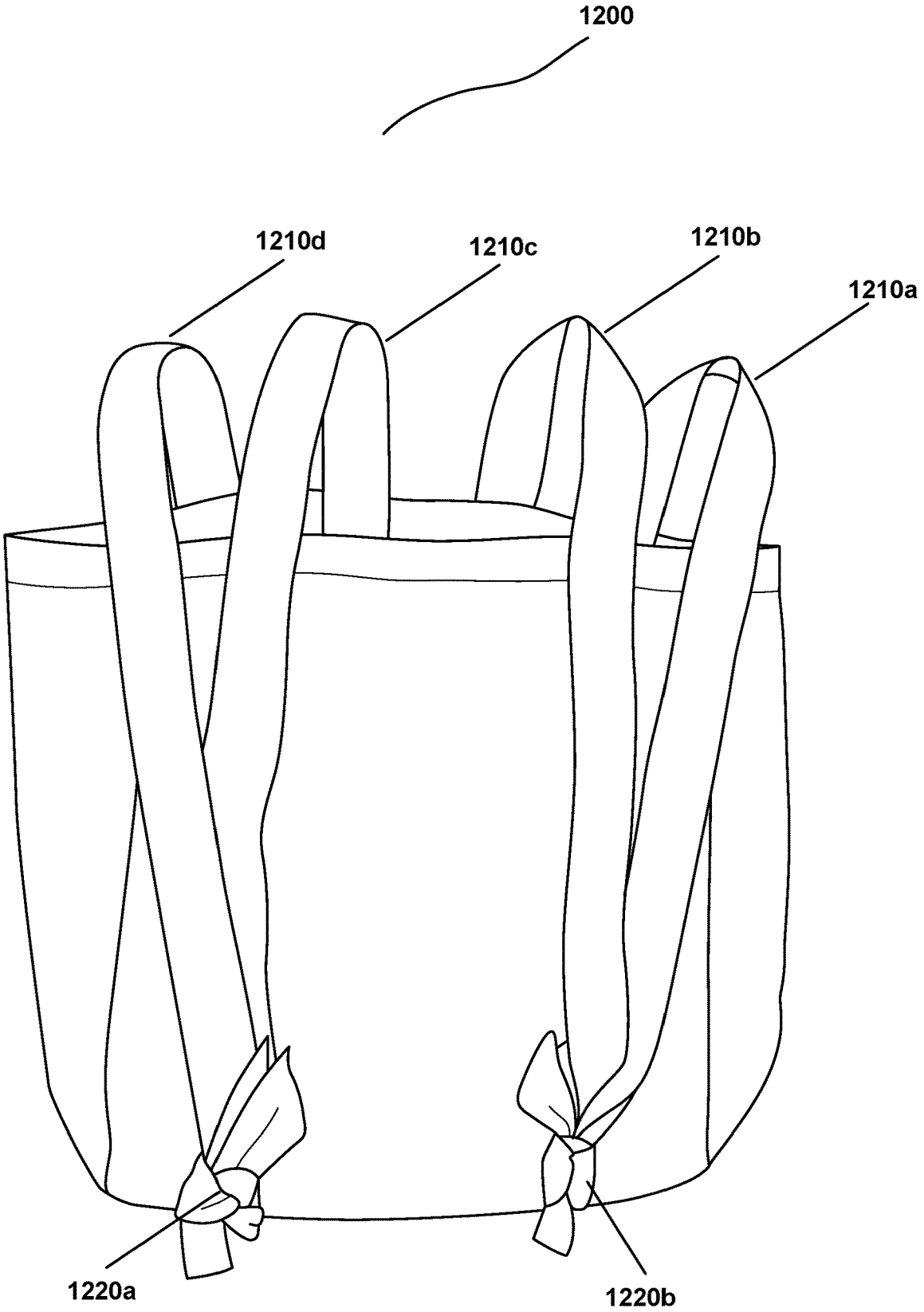
FIG. 39 depicts an assembled view of the second configuration of the bag of FIG. 36 according to an exemplary embodiment.

FIGS. 36-39 depict a bag 1200 with four straps 1210*a*, 1210*b*, 1210*c*, and 1210*d* (collectively, straps 1210). FIGS. 36 and 37 depict a front view of the bag 1200 and FIGS. 38 and 39 depict a back view of the bag 1200. It should be appreciated that the terms front and back are used for spatial reference purposes only. Each strap 1210 may have one end that is permanently attached to the bag (e.g., two at a front portion and two at a back portion as depicted in FIG. 36) and one end that is free (e.g., 1212*a*, 1212*b*, 1212*c*, and 1212*d*, collectively free ends 1212). As depicted in FIG. 37, the straps 1210 (specifically, the free ends 1212) may be tied together to form handles for the bag 1200. The straps 1210 may be tied together with a knot by a user. Any suitable knot type may be used. In this manner, the length of the straps may be adjusted (e.g., the placement of the knot in mating the straps may be used to adjust the strap length). The type of knot used may be based on user preference. As depicted in FIG. 37, the free ends 1212*a* and 1212*d* are tied together and the free ends 1212*b* and 1212*c* are tied together. Other combinations are possible.

FIGS. 38 and 39 depict that bag 1200 showing the straps 1200 and loops 1220 (1220*a* and 1220*b*) located at a bottom portion of the bag on its back side. FIG. 38 shows straps 1200 unattached to loops 1220. The attachment loops may be large enough for the strap free ends to thread through and to rotate once threaded through as well as allow for the straps to be tied to the loops. In various embodiments, the strap free ends may be tied to each other, once threaded through the loop, instead of the loops. In this manner, the bag 1220 may be converted to a backpack configuration as shown in FIG. 39. It should be appreciated that FIGS. 38 and 39, while depicting the same bag 1200, depict a slightly different strap style to illustrate another possible configuration.

Figure 40:
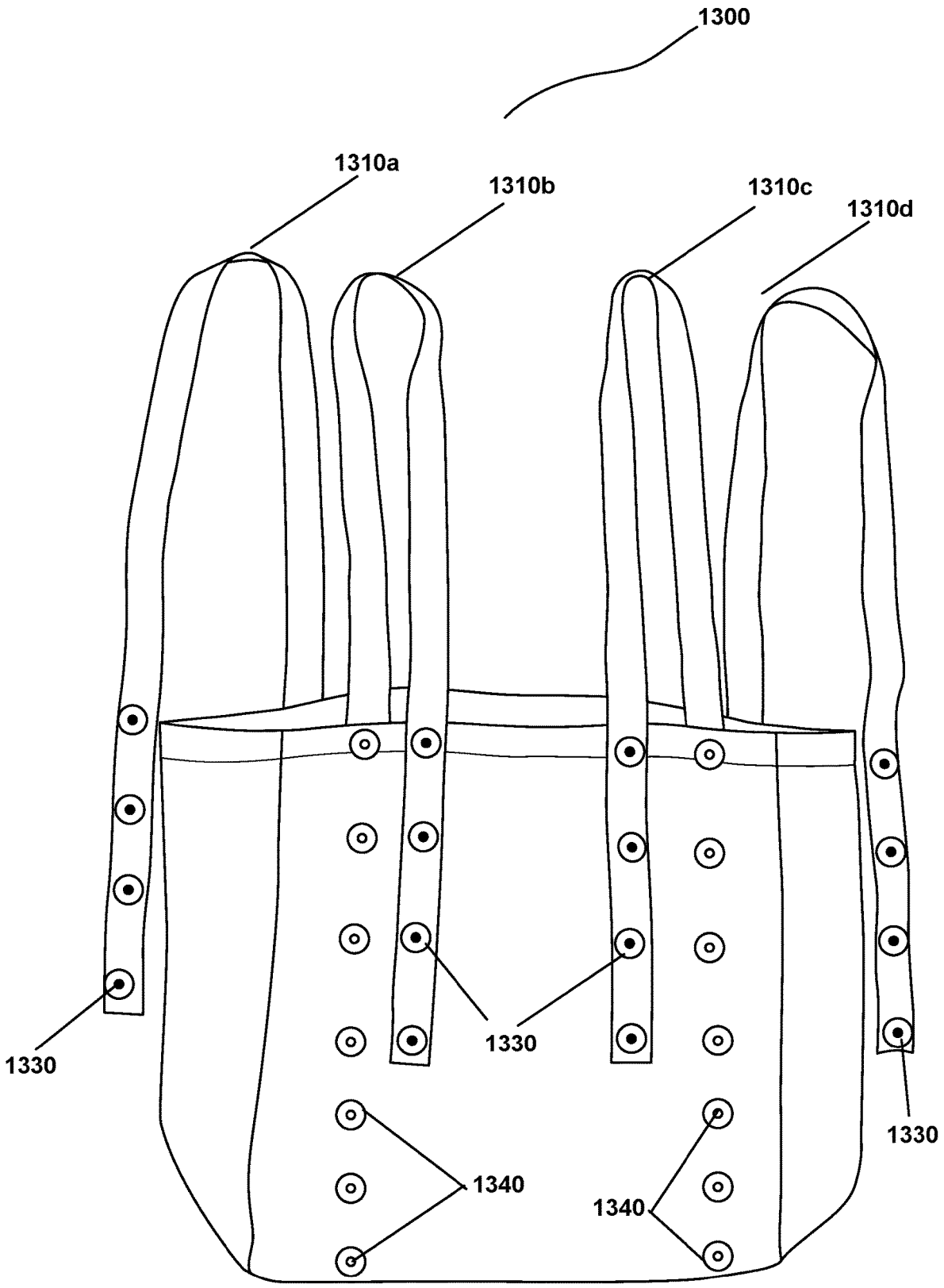
FIG. 40 depicts a front of a bag according to an exemplary embodiment.
Figure 41:
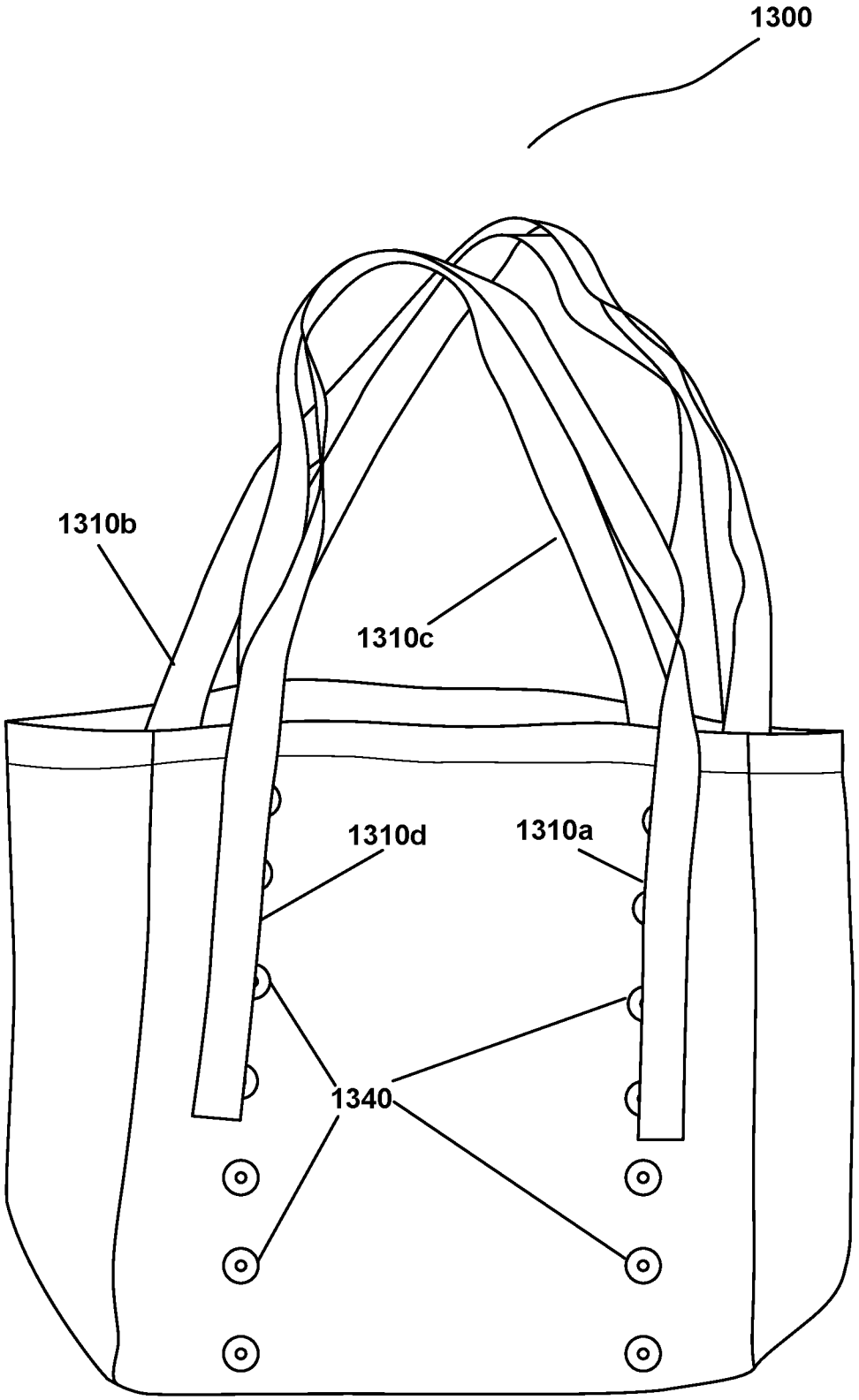
FIG. 41 depicts a first configuration of the bag of FIG. 40 according to an exemplary embodiment.
Figure 42:
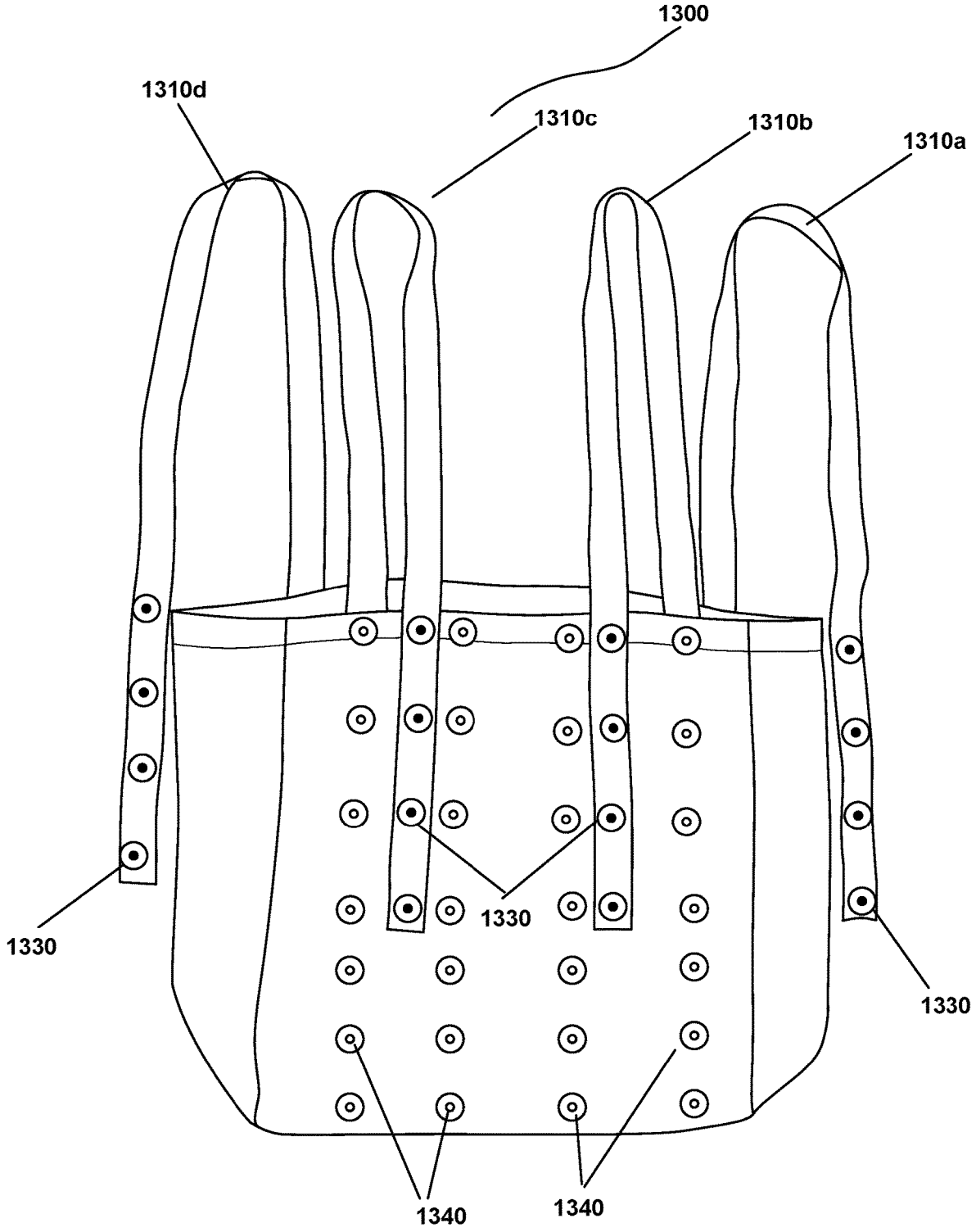
FIG. 42 depicts a back of the bag of FIG. 40 according to an exemplary embodiment.

FIGS. 40-41 depict a bag 1300 with four straps 1310*a*, 1310*b*, 1310*c*, 1310*d* (collectively, straps 1310). Each strap 1310 may have one end that is permanently attached to the bag (e.g., two at a front portion and two at a back portion as depicted in FIG. 40) and one end that is free. Each strap 1310 may have a series of snaps 1330 located along its length, starting at the free end and moving up the strap. The bag 1300 may have two series of snap mates 1340 located on its front (as shown in FIG. 40) and have corresponding sets plus two additional sets located on its back as shown in FIG. 42. The snaps 1330 and 1340 may be configured to mate to each other. As depicted in FIG. 41, the snaps may be snapped to snap mates on the bag front and back to form handle. The straps 1310 may be arranged in any suitable or desired configuration to form handles. FIG. 41 depicts one such configuration as an exemplary, non-limiting embodiment. The length of the straps may be shortened or lengthened depending on which snaps are used. It should be appreciated that the snap type depicted is an exemplary embodiment and other suitable snap configurations may be used. Other attachment mechanisms can be used such as magnets, "knobs and keyholes," and buttons with buttonholes.

Figure 43:
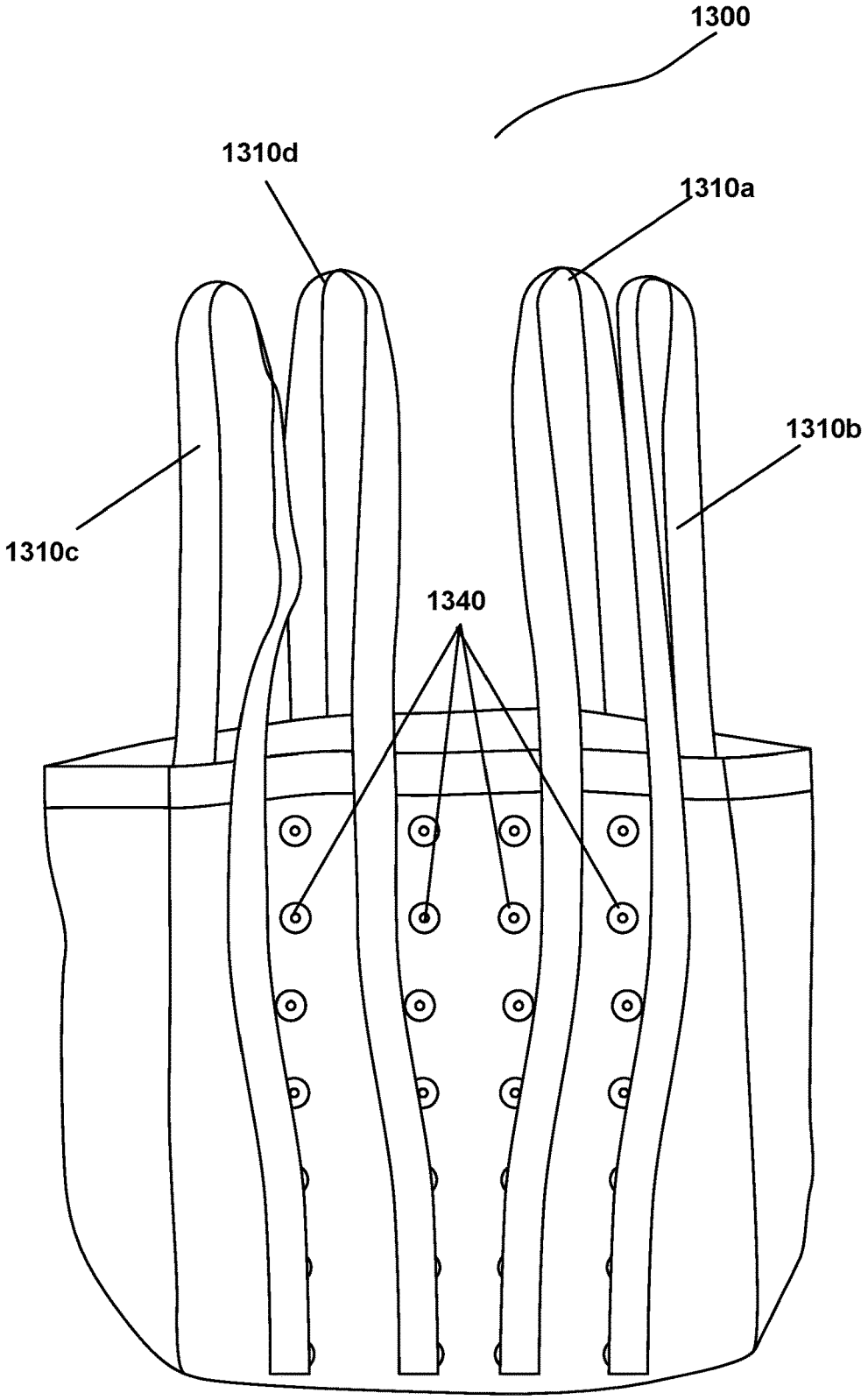
FIG. 43 depicts a second configuration of the bag of FIG. 40 according to an exemplary embodiment.

FIGS. 42 and 43 depict the back side of bag 1300 showing two additional series of snap mates 1340. As depicted in FIG. 43, the snaps on straps 1310*a*, 1310*b*, 1310*c*, and 1310*d* may be snapped to selective snap mates on the back side of the bag to form a backpack strap configuration. The length of the straps may be shortened or lengthened depending on which snaps are used. It should be appreciated that the snap type depicted is an exemplary embodiment and other suitable snap configurations may be used. Other attachment mechanisms can be used such as magnets, "knobs and keyholes," and buttons with buttonholes.

Figure 44:
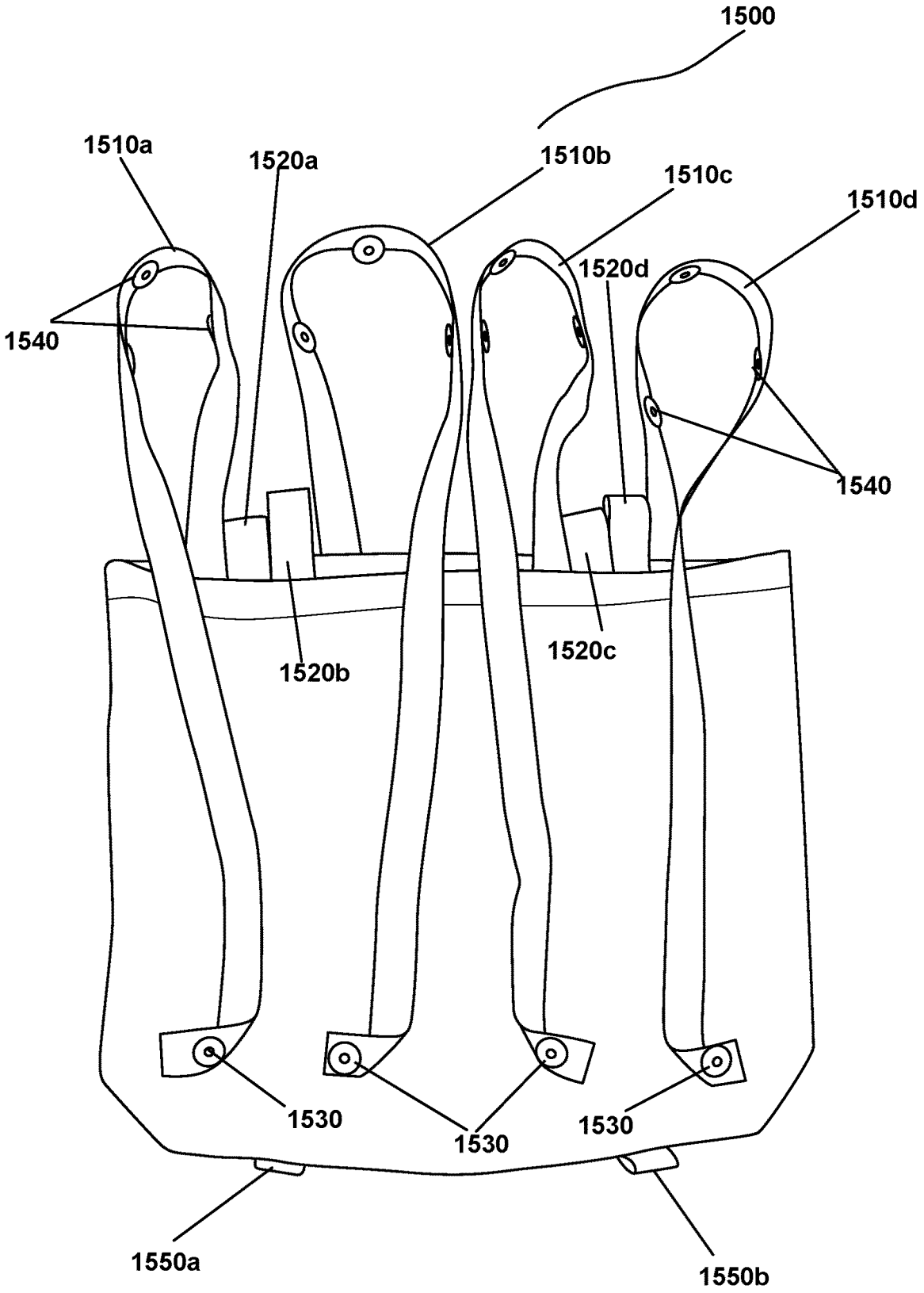
FIG. 44 depicts a bag according to an exemplary embodiment.
Figure 45:
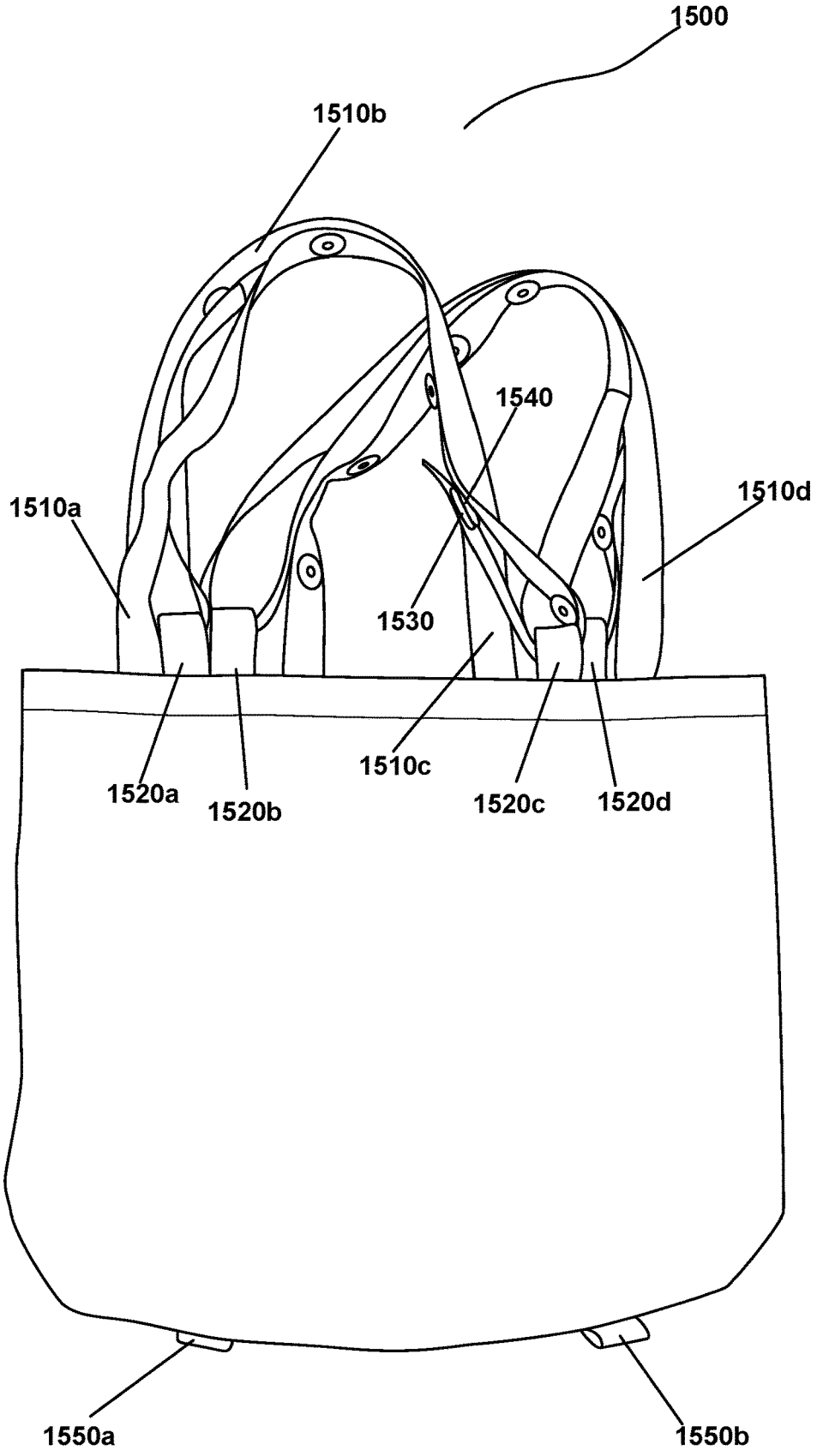
FIG. 45 depicts a first configuration of the bag of FIG. 44 according to an exemplary embodiment.
Figure 46:
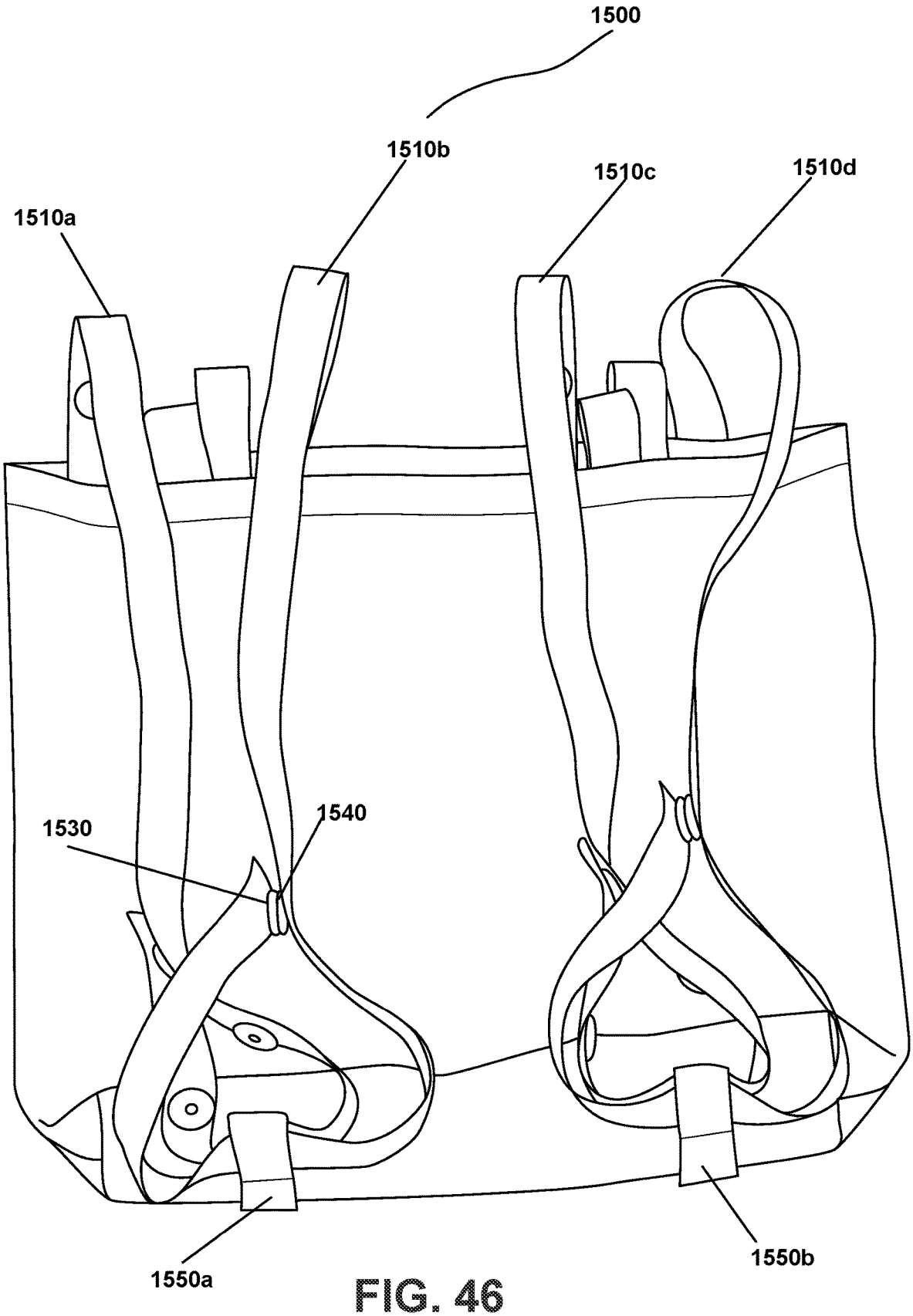
FIG. 46 depicts a second configuration of the bag of FIG. 44 according to an exemplary embodiment.

FIGS. 44-46 depict a bag 1500 with four straps 1510*a*, 1510*b*, 1510*c*, and 1510*d* (collectively, straps 1510). Each strap 1510 may have one end that is permanently attached to the bag (e.g., two at a front portion and two at a back portion as depicted in FIG. 44) and one end that is free. Each strap 1510 may have a snap 1530 located at its free end and a series of snap mates 1540 located along its length, spaced out from the free end. The bag 1500 may have a set of four loops 1520 (1520*a*, 1520*b*, 1520*c*, 1520*d*) located along its upper portion. The bag 1500 may have a set of two loops 1550 (1550*a*, 1550*b*) located at its bottom portion.

The bag 1500 may be configured as a handbag as depicted in FIG. 45 by threading the free end of straps 1510 through the loops 1520 and then using the snap configuration to form loops with the straps which serve as handles. The bag 1500 may be configured as a backpack as depicted in FIG. 46 by threading the free ends of straps 1510 through the loops 1550. The straps are each extended down the bag and threaded through the loops 1550 and the snap configuration is used to form backpack straps. In either configuration, the snaps may be used to lengthen or shorten the straps. It should be appreciated that the snap type depicted is an exemplary embodiment and other suitable snap configurations may be used. Other attachment mechanisms can be used such as magnets, "knobs and keyholes," and buttons with buttonholes.

All publications, patents, and published patent applications mentioned in this specification are herein incorporated by reference, in their entirety, to the same extent as if each individual publication, patent, or published patent application was specifically and individually indicated to be incorporated by reference.

It will be readily understood by those persons skilled in the art that the various embodiments are susceptible to broad utility and application. Many embodiments and adaptations other than those herein described, as well as many variations, modifications and equivalent arrangements, will be apparent from or reasonably suggested by the various embodiments and foregoing description thereof, without departing from the substance or scope of the various embodiments.

Accordingly, while the various embodiments have been described here in detail in relation to its exemplary embodiments, it is to be understood that this disclosure is only illustrative and exemplary of the various embodiments and is made to provide an enabling disclosure of the various embodiments. Accordingly, the foregoing disclosure is not intended to be construed or to limit the various embodiments or otherwise to exclude any other such embodiments, adaptations, variations, modifications or equivalent arrangements.

What is claimed is:

1. A convertible bag, comprising:

a bag unit having an internal compartment formed by an external surface of the bag unit, the external surface having an upper extremity forming a top opening to the internal compartment, the external surface having a first side and a second side opposite the first side;

four straps, comprising a first strap, a second strap, a third strap, and a fourth strap, each strap having one free end and one end that is permanently secured to the bag unit, the four straps each being configured with at least one attachment mechanism;

a first set of attachment points comprising a plurality of attachment points for the attachment mechanism on the four straps, the first set of attachment points extending, in a set of horizontally spaced apart rows on the first side, upward from a lower extremity of the bag unit towards the upper extremity such that the first set of attachment points are located on the external surface of the bag unit and outwardly facing;

a second set of attachment points comprising a plurality of attachment points for the attachment mechanism on the four straps, the second set of attachment points extending, in a set of horizontally spaced apart rows on the second side, upward from a lower extremity of the bag unit towards the upper extremity on an opposite side of the bag unit from the first set of attachment points such that the second set of attachment points is located on the external surface of the bag unit and outwardly facing;

the bag unit comprising a first configuration such that the attachment mechanism of each of the four straps is configured to be mated with at least one of the first and second set of attachment points on opposite sides of the bag unit such that the bag unit is configured with each of the first, second, third, and fourth straps being located proximal the top opening of the bag to form four top handles to allow the bag unit to be carried in a manner of a purse or handbag and a length of each of the four straps is configured by mating the attachment mechanism of a strap with one or more of the first and second set of attachment points; and the bag unit comprising a second configuration such that the attachment mechanism of each of the four straps is configured to be mated with at least one of the second set of attachment points to allow the bag unit to be carried in a manner of a backpack and the length of each of the four straps is configured by mating the attachment mechanism of a strap with one or more of the second set of attachment points with the first and second straps forming one shoulder strap and the third and fourth straps forming a second shoulder strap.

2. The convertible bag of claim 1, wherein the bag unit is selected from the group consisting of a purse, a handbag, a satchel, a hobo bag, a shoulder bag, a crossbody bag, a laptop bag, a messenger bag, a tote bag, and combinations thereof.

3. The convertible bag of claim 1, wherein a material of the bag unit is selected from the group consisting of leather, fabric, synthetic material, plastic, recycled material, 3D printed material, and combinations thereof.

4. The convertible bag of claim 1, wherein the four straps are comprised of a same material.

5. The convertible bag of claim 1, wherein the four straps are both each comprised of two or more materials.

6. The convertible bag of claim 1, wherein each of the first and second attachment points comprise one or more magnets configured to mate with corresponding magnets on each strap, or one or more snaps configured to mate with corresponding snaps on each strap, or one or more knobs configured to mate with corresponding keyholes on each strap, or one or more buttons configured to mate with corresponding buttonholes on each strap, or one or more locking mechanisms configured to mate with corresponding locking receiving mechanisms on each strap.

7. The convertible bag of claim 1, wherein:

the set of horizontally spaced apart rows on the first side comprises at least two horizontally spaced apart rows; and the set of horizontally spaced apart rows on the second side comprises at least four horizontally spaced apart rows.

8. The convertible bag of claim 1, each strap being of equal dimensions.

9. The convertible bag of claim 1, wherein the first and second attachment points comprise a set of keyholes configured to mate with the attachment mechanism of each of the four straps that comprises one or more knobs, or the first and second attachment points comprise a set of buttonholes configured to mate with the attachment mechanism of each of the four straps that comprises one or more buttons, or the first and second attachment points comprise a set of locking receiving openings configured to mate with at least one locking mechanisms of each of the four straps.

10. A convertible bag, comprising:

a bag unit having an internal compartment formed by an external surface of the bag unit, the external surface having an upper extremity forming a top opening to the internal compartment, the external surface having a first side and a second side opposite the first side;

four straps, comprising a first strap, a second strap, a third strap, and a fourth strap, each strap having two free ends which are completely detachable from the bag unit and each being configured with at least one attachment mechanism on each free end;

a first set of attachment points and a second set of attachment points configured to couple with the attachment mechanism on each of the four straps;

the first set of attachment points comprising a plurality of attachment points extending, in a set of horizontally spaced apart rows on the first side, upward from a lower extremity of the bag unit towards the upper extremity such that the first set of attachment points are located on the external surface of the bag unit and outwardly facing;

the second set of attachment points comprising a plurality of attachment points extending, in a set of horizontally spaced apart rows on the second side, upward from a lower extremity of the bag unit towards the upper extremity on an opposite side of the bag unit from the first set of attachment points such that the second set of attachment points is located on the external surface of the bag unit and outwardly facing;

the bag unit comprising a first configuration such that the attachment mechanism of each of the four straps is configured to be mated with at least one of the first and second set of attachment points on opposite sides of the bag unit such that the bag unit is configured with each of the first, second, third, and fourth straps being located proximal the top opening of the bag to form four top handles to allow the bag unit to be carried in a manner of a purse or handbag and a length of each of the four straps is configured by mating the attachment mechanism of a strap with one or more of the first and second set of attachment points; and the bag unit comprising a second configuration such that the attachment mechanism of each of the four straps is configured to be mated with at least one of the second set of attachment points to allow the bag unit to be carried in a manner of a backpack and the length of each of the four straps is configured by mating the attachment mechanism of a strap with one or more of the second set of attachment points with the first and second straps forming one shoulder strap and the third and fourth straps forming a second shoulder strap.

11. The convertible bag of claim 10, wherein each of the first and second attachment points comprise one or more magnets configured to mate with corresponding magnets on each strap, or one or more snaps configured to mate with corresponding snaps on each strap, or one or more knobs configured to mate with corresponding keyholes on each strap, or one or more buttons configured to mate with corresponding buttonholes on each strap, or one or more locking mechanisms configured to mate with corresponding locking receiving mechanisms on each strap.

12. The convertible bag of claim 10, wherein the bag unit is selected from the group consisting of a purse, a handbag, a satchel, a hobo bag, a shoulder bag, a crossbody bag, a laptop bag, a messenger bag, a tote bag, and combinations thereof.

13. The convertible bag of claim 10, wherein a material of the bag unit is selected from the group consisting of leather, fabric, synthetic material, plastic, recycled material, 3D printed material, and combinations thereof.

14. The convertible bag of claim 10, wherein the four straps are comprised of a same material.

15. The convertible bag of claim 10, wherein the four straps are each comprised of two or more materials.

16. The convertible bag of claim 10, wherein:

the set of horizontally spaced apart rows on the first side comprises at least two horizontally spaced apart rows; and the set of horizontally spaced apart rows on the second side comprises at least four horizontally spaced apart rows.

17. The convertible bag of claim 10, each strap being of equal dimensions.

18. The convertible bag of claim 10, wherein the first and second attachment points comprise a set of keyholes configured to mate with the attachment mechanism of each of the four straps that comprises one or more knobs, or the first and second attachment points comprise a set of buttonholes configured to mate with the attachment mechanism of each of the four straps that comprises one or more buttons, or the first and second attachment points comprise a set of locking receiving openings configured to mate with at least one locking mechanisms of each of the four straps.

* * * * *